US012575635B2

(12) United States Patent
Bidal et al.

(10) Patent No.: US 12,575,635 B2
(45) Date of Patent: Mar. 17, 2026

(54) GOLF SHOE WITH INTERNAL STRUCTURE

(71) Applicant: Acushnet Company, Fairhaven, MA (US)

(72) Inventors: Jean-Marie Bidal, Bridgewater, MA (US); Robert S. Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 48 days.

(21) Appl. No.: 18/137,603

(22) Filed: Apr. 21, 2023

(65) Prior Publication Data

US 2023/0255308 A1 Aug. 17, 2023

Related U.S. Application Data

(63) Continuation-in-part of application No. 17/970,817, filed on Oct. 21, 2022, and a continuation-in-part of application No. 17/360,583, filed on Jun. 28, 2021, now Pat. No. 11,963,582, which is a continuation-in-part of application No. 16/576,854, filed on Sep. 20, 2019, now Pat. No. 11,425,959, which is a continuation-in-part of application No. 16/550,516, filed on Aug. 26, 2019, now Pat. No. 11,425,958, which is a continuation-in-part of application No. 29/694,176, filed on Jun. 7, 2019, now Pat. No. Des. 918,554.

(60) Provisional application No. 63/490,070, filed on Mar. 14, 2023.

(51) Int. Cl.
*A43B 5/00* (2022.01)
*A43B 13/12* (2006.01)

(52) U.S. Cl.
CPC ..... *A43B 5/001* (2013.01); *A43B 13/12* (2013.01)

(58) Field of Classification Search
CPC ..... A43B 5/001; A43B 13/12; A43B 13/183; A43B 13/186; A43B 13/141
USPC ..... 36/107, 108
See application file for complete search history.

(56) References Cited

U.S. PATENT DOCUMENTS

| | | | |
|---|---|---|---|
| 6,763,611 | B1 | 7/2004 | Fusco |
| 6,775,930 | B2 | 8/2004 | Fuerst |
| 7,096,605 | B1 | 8/2006 | Kozo et al. |
| 7,276,191 | B2 | 10/2007 | Park |
| 7,421,805 | B2 | 9/2008 | Geer |
| 7,434,337 | B2 | 10/2008 | Gibert et al. |

(Continued)

FOREIGN PATENT DOCUMENTS

| | | |
|---|---|---|
| WO | 2017123726 | 7/2017 |

*Primary Examiner* — Haley A Smith

(57) ABSTRACT

A golf shoe with an upper, a sole assembly, and an insert integrated with the sole assembly. The insert may provide an elastic response during a golf-related movement. The insert may comprise a plurality of legs extending from a central region of the insert to stiffen the shoe, the plurality of legs including a first set of symmetric legs extending between the central region and a forefoot region of the sole assembly and a second set of symmetric legs extending between the central region and a rearfoot region of the sole assembly. The first set of symmetric legs comprises a first and second leg that diverge to provide a longitudinally flexible forefoot region between the first and second leg. The second set of symmetric legs comprises a third and fourth leg that diverge to provide a longitudinally flexible rearfoot region between the third and fourth leg.

19 Claims, 37 Drawing Sheets

(56) References Cited

U.S. PATENT DOCUMENTS

| | | | | |
|---|---|---|---|---|
| 8,789,295 | B2 | 7/2014 | Burch et al. | |
| 8,943,708 | B2 | 2/2015 | Spiller et al. | |
| 8,984,775 | B2 | 3/2015 | Dombrow et al. | |
| 9,282,785 | B2 | 3/2016 | Grondin | |
| 9,462,845 | B2 | 10/2016 | Auger et al. | |
| 9,578,920 | B2 | 2/2017 | Grott et al. | |
| 9,610,746 | B2 | 4/2017 | Wardlaw et al. | |
| 9,820,529 | B2 | 11/2017 | Droege et al. | |
| 9,849,645 | B2 | 12/2017 | Wardlaw et al. | |
| 9,883,714 | B2 | 2/2018 | Cavaliere et al. | |
| 9,907,353 | B2 | 3/2018 | Lester et al. | |
| 9,956,732 | B2 | 5/2018 | Murphy et al. | |
| 9,974,358 | B2 | 5/2018 | Miner | |
| 10,016,919 | B2 | 7/2018 | Cook et al. | |
| 10,932,521 | B2 | 3/2021 | Perrault et al. | |
| 10,974,447 | B2 | 4/2021 | Constantinou et al. | |
| 11,241,826 | B2 | 2/2022 | Constantinou et al. | |
| 11,730,228 | B2 * | 8/2023 | Diard | A43B 13/143 36/28 |
| 2011/0146110 | A1 | 6/2011 | Geer | |
| 2011/0185597 | A1 * | 8/2011 | Guest | A43B 5/001 36/127 |
| 2016/0044992 | A1 | 2/2016 | Reinhardt et al. | |
| 2019/0037969 | A1 | 2/2019 | Busbee et al. | |
| 2021/0177093 | A1 | 6/2021 | Perrault et al. | |
| 2022/0039506 | A1 * | 2/2022 | Diard | A43B 13/143 |
| 2022/0369764 | A1 * | 11/2022 | Goldston | F16F 3/02 |

* cited by examiner

GOLF SHOE WITH INTERNAL STRUCTURE

CROSS REFERENCE

This application is a Continuation-in-Part of co-pending and co-assigned U.S. patent application Ser. No. 17/970,817 filed on Oct. 21, 2022 and U.S. patent application Ser. No. 17/360,583 filed on Jun. 28, 2021, which is a Continuation-in-Part of U.S. patent application Ser. No. 16/576,854 filed on Sep. 20, 2019 (issued as U.S. Pat. No. 11,425,959), which is a Continuation-in-Part of U.S. patent application Ser. No. 16/550,516 filed on Aug. 26, 2019 (issued as U.S. Pat. No. 11,425,958), which is a Continuation-in-Part of U.S. Design patent application Ser. No. 29/694,176 filed on Jun. 7, 2019 (issued as U.S. Design Pat. No. D918,554), each of which is incorporated herein by reference in its entirety for all purposes. This application also claims priority to U.S. Provisional Patent Application No. 63/490,070 filed on Mar. 14, 2023, the entire disclosure of which is incorporated herein by reference for all purposes.

BACKGROUND

The sport of golf can involve a variety of actions that a subject (e.g., a golfer) may perform, such as swinging a golf club, walking a golf course, and/or crouching down to line up a putt. Having the proper equipment to play golf can affect how well a golfer performs golf-related actions or movements.

Golf shoes are one example of a piece of equipment that can affect a golfer's performance. For example, when a golfer swings a club, there are a number of forces that can be exerted on the sole assembly of the golf shoe. As such, golf shoes need to provide a comfortable and stable platform for golfers to execute an optimal swing.

SUMMARY

Recognized herein are various shortcomings and disadvantages of conventional golf shoes and traditional methods of manufacturing golf shoes. Some golf shoes may include an insert that is placed in a sole assembly of the golf shoe after the sole assembly is fabricated. The placement of the insert in the sole assembly after the fabrication of the sole assembly can involve additional steps, labor, and tooling/equipment, which can be both time and resource intensive. Additionally, in some cases, the integration of the insert in the sole assembly after the fabrication of the sole assembly can compromise the desired structural integrity of the original sole assembly if the insert is not properly integrated with the sole assembly. Given the existing challenges around manufacturing a shoe with an insert optimized to impart one or more desired structural properties in a sole assembly, commercially available shoes typically use more simplistic insert geometries or configurations. Such simplistic geometries and configurations might impart a limited number of favorable material characteristics in the sole assembly, but may not provide the full range of performance characteristics needed for a high performance golf shoe.

The present disclosure addresses the abovementioned shortcomings and disadvantages of conventional golf shoes and traditional methods of manufacturing golf shoes by providing various methods for fabricating a golf shoe with a sole assembly having an internal structure integrated with or embedded in the sole assembly. The methods disclosed herein may be used to efficiently fabricate shoes with complex internal structures that are embedded in or integrated with a midsole and/or an outsole of the sole assembly. In accordance with the various methods presently disclosed, the complex internal structure can be integrated with or embedded in the sole assembly as the sole assembly is being fabricated (e.g., in a mold), which can facilitate the production of a midsole or outsole with an integrated or embedded internal structure in a single manufacturing step (in some cases using a single mold).

The present disclosure also provides various embodiments of golf shoes that can be fabricated using the methods described herein. As described in greater detail below, the methods of the present disclosure may be implemented to produce golf shoes comprising midsoles and/or outsoles with various complex 3D structures (e.g., inserts, endoskeletons, etc.) that are impossible, impractical, and/or extremely difficult to integrate or embed in midsoles or outsole using traditional methods. The complex 3D structures disclosed herein may have an optimal geometry that can provide a wide range of favorable performance characteristics compared to other conventional shoes with more simplistic insert geometries and configurations. In any of the embodiments described herein, the complex 3D structures may be configured to (1) comfortably support loads exerted on the sole assembly during golf-related movements, (2) preserve the torsional stiffness of the sole assembly, (3) maintain favorable flex characteristics in transverse or longitudinal directions, (4) enhance traction with various ground surfaces, and/or (5) control a deformation of the midsole in response to one or more forces exerted on the midsole during a golf-related movement.

In some embodiments, the midsoles described herein may be configured to flex or deform during a golf-related movement in order to control, guide, and/or manage (i) a movement of a subject's feet during the golf-related movement, (ii) a distribution of one or more forces across the shoe to facilitate or execute the golf-related movement, and/or (iii) a direction or a magnitude of the one or more forces exerted on (a) the shoe or any components thereof or (b) a ground surface underneath the shoe. In some embodiments, the midsole may be configured to flex or deform in a particular manner based on (1) the unique anatomical or biomechanical characteristics of the subject wearing the shoe and/or (2) the unique properties or characteristics of the subject's swing. In some embodiments, the midsole may be configured to flex or deform in a manner that is optimal for a particular subject, based on his or her swing type, swing speed, anatomy, or biomechanical characteristics.

In some embodiments, the midsole may be configured to flex or deform optimally for a particular subject even if the subject is executing a golf-related action in a manner that is sub-optimal for the subject given his or her swing type, swing speed, anatomy, or biomechanical characteristics. In some cases, a sub-optimal execution of the golf-related action may involve an actual movement by the subject that deviates from an optimal movement that can provide (i) maximum consistency, e.g., tighter ball dispersions and/or (ii) maximum performance, e.g., longer carry distances. The actual movement or the optimal movement may include, for example, a movement of the subject's arms or wrists, a rotation of a subject's body (hips, waist, etc.), a change in weight distribution across the subject's feet, or a pivoting of the subject's feet during a golf swing. In some cases, a sub-optimal execution of the golf-related action may involve a deviation between an actual posture of the subject and an optimal posture that can provide (i) maximum consistency and/or (ii) maximum performance. The actual posture or the optimal posture may include, for example, a position or an orientation of the subject's feet relative to a golf ball or a ground surface, and/or a position or an orientation of a first body part of the subject relative to a second body part of the subject. In some non-limiting embodiments, the sub-optimal execution of the golf-related action may be associated with a sub-optimal loading profile on the midsole of the shoe or a ground surface underneath the shoe. In some cases, the sub-optimal loading profile may involve a sub-optimal application or exertion of pressure on the midsole or the ground surface before, during, and/or after a golf-related movement. In some cases, the sub-optimal loading profile may involve a sub-optimal change in the application or exertion of pressure on the ground surface or various portions of the midsole over a period of time. In some cases, the sub-optimal loading profile may involve a sub-optimal application or exertion of pressure on one or more portions or regions of the midsole before, during, and/or after a golf-related movement. The sub-optimal application or exertion of pressure may involve the application or exertion of one or more forces (either at various regions of the midsole or at various time points over a select period of time) with a magnitude or a direction that deviates from an optimal magnitude or direction that can translate to or facilitate a golf-related movement with (i) maximum consistency and/or (ii) maximum performance.

In some embodiments, the midsole may be configured to flex or deform in a controlled or predictable manner in order to assist with a subject's golf swing, regardless of any deviations between the actual movements or posture of the subject and the movements or posture which may be considered optimal for the subject given his or her swing type, swing speed, anatomy, or biomechanical characteristics. In some embodiments, the midsole may be configured to flex or deform in a controlled or predictable manner for multiple subjects in order to assist with their golf swings, regardless of any differences in or variations between each subject's swing type, swing speed, anatomy, biomechanical characteristics, or personal preferences for golf-related movements or postures.

In any of the embodiments described herein, the insert may provide different suspension characteristics in or along different zones of the midsole. The suspension characteristics may be associated with, for example, a resistance of the midsole material to compressive forces exerted on the midsole, or a reactionary spring force provided by the midsole material in response to various forces exerted on the midsole during a golf-related movement. In some cases, the suspension characteristics for the different zones can be optimized based on a subject's bodily characteristics (e.g., weight, stature, foot shape or profile, center of gravity or center of mass, etc.) and/or the subject's preferences for comfort, fit, and/or performance. In some cases, the suspension characteristics for the different zones can be optimized for a variety or a range of different subjects with different bodily characteristics or different preferences for comfort, fit, and/or performance.

In any of the embodiments described herein, the insert geometry and/or the insert material may provide or impart a desired set of properties or characteristics to the midsole. The desired set of properties or characteristics may include, for example, torsional stiffness, torsional rigidity, flexural stiffness, flexural rigidity, hardness, tensile strength, or any of the other material properties described elsewhere herein. In some non-limiting embodiments, the insert geometry and/or the insert material may favor a particular set of torsional characteristics for the midsole. In some cases, the particular set of torsional characteristics may be biased in eversion (i.e., the torsional characteristics may promote or facilitate the tilting of the sole of the foot outwards, away from the midline of the body during a golf-related movement). In other cases, the particular set of torsional characteristics may be biased in inversion (i.e., the torsional characteristics may promote or facilitate the tilting of the sole of the foot inwards towards the midline of the body during a golf-related movement). In some cases, the particular set of torsional characteristics may be directionally neutral (i.e., may not be biased in either inversion or eversion, or may be biased equally in eversion and inversion).

In any of the embodiments described herein, the insert geometry and/or the insert material may assist with a golfer's specific/unique swing characteristics and effectively (1) realign a golfer's swing with an optimal swing path or trajectory, (2) align a golfer's body or movements with an optimal posture and/or an optimal set of movements in or along one or more optimal axes or planes in three-dimensional space, and/or (3) compensate for any deviations or variations between (a) the golfer's actual posture or movements and (b) the optimal posture or the optimal set of movements for the golfer. In any of the embodiments described herein, the insert geometry and/or the insert material may be configured to reduce the occurrence or likelihood of any undesirable shot trajectories (e.g., pull, push, hook, and/or slice) that may result from the actual movements or posture of a particular golfer (whether preferred or unintentional).

In one aspect, the present disclosure provides a golf shoe comprising an upper and a sole assembly connected to the upper. In some embodiments, the sole assembly may include a midsole and/or an outsole.

In some embodiments, at least one of the midsole or the outsole may comprise (i) a foamed material and (ii) a structure integrated with or embedded in the foamed material. In some embodiments, the foamed material comprises ethylene vinyl acetate (EVA). In some embodiments, the structure may comprise a different material than the foamed material.

In some embodiments, the structure may comprise a spineless structure with one or more members extending between a medial side and a lateral side of the midsole or the outsole to enhance lateral support and/or a torsional strength or stiffness of the midsole or the outsole. In some embodiments, the structure comprises a structural shape or profile that is different than a shape or profile of a bottom of a subject's foot. In some embodiments, the structure comprises a unitary or integrally formed structure.

In some embodiments, the one or more members of the structure may comprise a rigid member. In some embodiments, the rigid member includes a beam or a plate. In some embodiments, the one or more members comprise a torsion bar, an arm, an arch, or a wing structure. In some embodiments, the one or more members may be configured to distribute forces exerted on the sole assembly or a portion thereof to one or more select traction elements of the golf shoe in order to enhance a stability and a traction of the golf shoe.

In some embodiments, the structure is configured to control a deformation or a flex of the sole assembly in or along two or more axes. In some embodiments, the structure is configured to provide cushioning or suspension support in a first axis and torsional strength or stiffness in or along a second axis.

In some embodiments, the structure comprises a lattice. In some embodiments, the lattice comprises a first region having a first lattice property and a second region having a second lattice property. In some embodiments, the first lattice property and the second lattice property are selected from the group consisting of a lattice geometry, a lattice density, and a lattice material composition.

In some embodiments, the structure comprises an additively manufactured part or a machined part. In some embodiments, the structure comprises a true to size insert.

In some embodiments, the structure is attachable or fixable to a mold corresponding to the midsole or the outsole to fix a position and an orientation of the structure within the mold such that the structure is at least partially covered or encapsulated by a molding agent and a foaming agent during a molding process based on the mold. In some embodiments, the mold comprises a single 1:1 scale mold. In some embodiments, the structure comprises a higher melting temperature than the foamed material to resist thermal degradation, warping, or shape shifting during the molding process.

In another aspect, the present disclosure provides a golf shoe comprising an upper; a sole assembly connected to the upper, the sole assembly comprising a midsole and an outsole; and an insert positioned between the midsole and the outsole to provide an elastic response during one or more golf-related movements executed by a subject wearing the golf shoe.

In some embodiments, the insert comprises a plurality of legs extending from a central region of the insert to stiffen the shoe. In some embodiments, the plurality of legs include a first set of symmetric legs extending between the central region and a forefoot region of the sole assembly and a second set of symmetric legs extending between the central region and a rearfoot region of the sole assembly. In some embodiments, the first set of symmetric legs include a first leg and a second leg that diverge from the central region to provide a longitudinally flexible forefoot region between the first and second leg. In some embodiments, the second set of symmetric legs comprises a third leg and a fourth leg that diverge from the central region to provide a longitudinally flexible rearfoot region between the third and fourth leg.

In some embodiments, the first leg and the second leg each have a sloped surface with an orientation or curvature that varies along a length of the first or second leg. In some embodiments, the third leg and the fourth leg each have a sloped surface with an orientation or curvature that varies along a length of the third or fourth leg. In some embodiments, the sloped surfaces of the first leg and the second leg are oriented or curved in or along a different direction than the sloped surfaces of the third leg or the fourth leg. In some embodiments, the sloped surfaces of the first and second leg are oriented towards a lateral side or a medial side of the sole assembly. In some embodiments, the sloped surfaces of the third leg and the fourth leg are oriented towards a central longitudinal axis extending between the third and fourth legs. In some embodiments, the sloped surfaces of the first and second leg are oriented towards a central longitudinal axis extending between the first and second legs. In some embodiments, the sloped surfaces of the third leg and the fourth leg are oriented towards a lateral side or a medial side of the sole assembly.

In some embodiments, the sloped surfaces of the first leg or the second leg have at least one concave curvature and/or at least one convex curvature. In some embodiments, the sloped surfaces of the third leg or the fourth leg have at least one concave curvature and/or at least one convex curvature.

In some embodiments, the insert is concave downwards to enhance the elastic response provided by the insert. In some embodiments, the central region of the insert is positioned further from a ground surface under the golf shoe than the first or second sets of symmetric legs.

In some embodiments, the first leg and the second leg converge at a first point in the central region. In some embodiments, the third leg and the fourth leg converge at a second point in the central region. In some embodiments, the first point and the second point are positioned at different heights.

In some embodiments, the first leg, the second leg, the third leg, and the fourth leg comprise one or more extensions with a substantially flat surface for supporting one or more loads exerted on the insert during the one or more golf-related movements. In some embodiments, the one or more extensions are configured to curve outwards towards a lateral side or a medial side of the sole assembly to enhance stability. In some embodiments, the first leg and the second leg are disposed at an angle ranging from about 10 degrees to about 135 degrees. In some embodiments, the third leg and the fourth leg are disposed at an angle ranging from about 10 degrees to about 135 degrees. In some embodiments, the first leg and the third leg are disposed at an angle ranging from about 45 degrees to about 170 degrees. In some embodiments, the second leg and the fourth leg are disposed at an angle ranging from about 45 degrees to about 170 degrees. In some embodiments, the first and second sets of symmetric legs collectively form an X-shaped member.

In another aspect, the present disclosure provides a method for manufacturing a sole assembly with an internal structure. In some embodiments, the method may comprise providing a mold for producing a midsole or an outsole of the sole assembly. In some embodiments, the method may comprise securing the internal structure to the mold or a surface feature of the mold. The internal structure may have a structural shape or profile that is different than a shape or profile of a bottom of a subject's foot.

In some embodiments, the method may comprise providing a composition comprising a molding agent and a foaming agent to the mold to produce, in a single manufacturing step, the midsole or the outsole with the internal structure at least partially embedded therein. In some embodiments, said composition comprising the molding agent and the foaming agent may be flowed around the internal structure to surround or encapsulate the internal structure. In some embodiments, the internal structure may include a spineless structure comprising a different material than the composition surrounding or encapsulating the internal structure.

In some embodiments, producing the midsole or the outsole does not involve expanding the composition or the molding agent in the mold. In some embodiments, the midsole or the outsole is produced using a single mold comprising the mold and without any post molding manufacturing operation to integrate the internal structure with the midsole or the outsole. In some embodiments, the mold comprises a 1:1 scale mold. In some embodiments, the internal structure comprises a true to size insert.

Additional aspects and advantages of the present disclosure will become readily apparent to those skilled in this art from the following detailed description, wherein only illustrative embodiments of the present disclosure are shown and described.

As will be realized, the present disclosure is capable of other and different embodiments, and its several details are capable of modifications in various obvious respects, all without departing from the disclosure.

Accordingly, the accompanying drawings and descriptions are to be regarded as illustrative in nature, and not as restrictive.

BRIEF DESCRIPTION OF THE DRAWINGS

Non-limiting and non-exhaustive examples are described with reference to the following figures.

DETAILED DESCRIPTION

Figure 1:
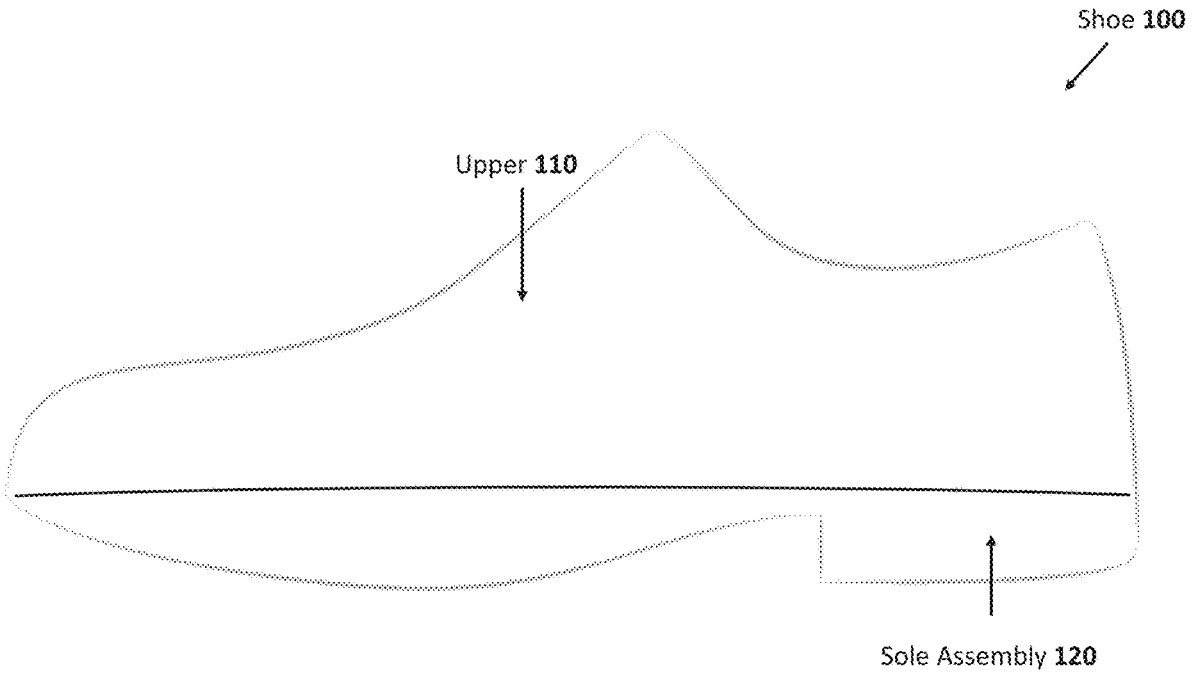
FIG. 1 depicts an exemplary golf shoe, in accordance with some embodiments.

The present disclosure will now be described more fully in reference to the accompanying figures, in which various non-limiting embodiments are shown. However, this disclosure should not be construed as limited to the embodiments set forth herein. In the drawings, like numbers refer to like elements throughout. Thicknesses and dimensions of some components may be exaggerated for clarity. The views shown in the Figures are of a right shoe and it is understood that in some cases, the components for a left shoe can be mirror images of the right shoe. It also should be understood that the shoe may be made in various sizes and thus the size of the components or features (e.g., internal grooves) of the shoe may be adjusted depending on the shoe size.

The terminology used herein is for the purpose of describing various embodiments only and is not intended to be limiting. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element (with or without any intervening elements). In contrast, when an element is referred to as being "directly attached," directly coupled" or "directly connected" to another element, there may not or need not be any intervening elements present.

It is noted that any one or more aspects or features described with respect to one embodiment may be incorporated in a different embodiment. That is, all embodiments and/or features of any embodiment can be combined in any way and/or in any order. Applicant reserves the right to modify any originally filed claim or file any new claim(s) accordingly, including the right to amend any originally filed claim to depend from and/or incorporate any feature of any other claim although not originally claimed in that manner. The various aspects and features of the present disclosure are explained in further detail in the specification set forth below.

From a performance standpoint, a golf shoe needs to be rigid and flexible so that a subject wearing the golf shoe can perform various different golf-specific actions (e.g., walking a golf course, addressing a golf ball, swinging a golf club, and/or crouching down to line up a shot). A golf shoe should also provide ample support, cushioning, and stability because many golf-related movements can involve significant pressure and/or torsion being applied to the sole assembly.

The present disclosure provides various examples of golf shoes having structures (e.g., three-dimensional (3D) structures) that can be embedded in or integrated with a sole assembly (e.g., the midsole or outsole of a shoe) to enhance various material properties of the sole assembly, such as stiffness, rigidity, flexibility, and/or underfoot cushioning or support. In some cases, the three-dimensional (3D) structures may be configured to distribute forces exerted on the sole assembly (e.g., during a golf-related movement) to different portions or regions of the shoe. The different portions or regions of the shoe may correspond to (i) a lateral and/or medial side of the shoe and/or (ii) a forefoot, midfoot, or rearfoot region of the shoe. In some cases, the forces exerted on the sole assembly may be distributed to an outsole region of the shoe (or to a traction element coupled to the outsole region of the shoe) to improve traction on various different ground surfaces. The three-dimensional (3D) structures disclosed herein may be embedded in or integrated with the midsole and/or the outsole of the golf shoe to help control (i) the movement of a golfer's feet during a golf-related action and (ii) a deformation or flexing of the sole assembly in response to forces exerted by the golfer's feet during the golf-related action, in order to provide a comfortable, high-performance sole assembly for golfers.

In an aspect, the present disclosure provides a golf shoe. The golf shoe may comprise an article of footwear (e.g., a shoe) that can be worn by a subject to aid in a physical activity such as golf, or any other physical activity involving one or more actions or movements that can be used in the sport of golf.

The golf shoe may be worn by a subject. The subject may be, for example, an athlete or a golf player. When worn by the subject, the golf shoe may provide an optimal balance of comfort and control that allows the subject to focus on his or her game and maximize performance. The golf shoe may be sized, shaped, and configured to support the subject's foot and/or control a movement of the subject's foot during a golf-related movement to enhance (i) comfort, (ii) stability, and/or (iii) the subject's stance, swing, stability, or overall performance (e.g., accuracy or precision).

FIG. 1 depicts an exemplary golf shoe 100, also referred to herein generally as a shoe 100. In some embodiments, the shoe 100 may comprise a shoe upper 110 and a sole assembly 120. In some cases, the upper 110 may include an insole. The insole may comprise an insole component such as an insole footbed and/or an insole board. In some cases, the sole assembly 120 may include a midsole and/or an outsole. In some embodiments, the sole assembly may be connected to the upper.

In some embodiments, the golf shoe 100 may comprise an upper 110. In some cases, the upper 110 may comprise a vamp for covering at least a forefoot region of a subject's foot. In some cases, the upper 110 may comprise a quarter for covering and/or supporting one or more side or rear portions of a subject's foot (e.g., the area adjacent to, surrounding, and/or below the Achilles tendon, the posterior of the heel, and/or the talus and calcaneus bones).

In some embodiments, the heel region of the quarter may comprise a heel cup. In some cases, the heel cup may comprise a molded heel cup. In some embodiments, at least a portion of the quarter may form a part of the molded heel cup. In some embodiments, the quarter may comprise a plurality of layers that can be molded together to form the heel cup.

In some embodiments, the vamp and the quarter may comprise separate pieces of material that are connected or fused to each other mechanically, chemically, thermally, or adhesively. In some cases, the upper material may comprise various materials that are stitched or bonded together to form an upper structure.

In some embodiments, the upper 110 may comprise a continuous piece of material for the vamp and quarter. In some cases, the continuous piece of material may comprise a single material comprising a plurality of regions each having different material properties. In other cases, the continuous piece of material may comprise a plurality of materials having different material properties. The material properties associated with the plurality of regions or the plurality of materials may include, for example, density, porosity, water absorbency/repellence, strength, flexibility, elasticity, softness, durability, chemical resistance, thermal conductivity, and the like.

In some cases, the upper 110 may comprise, for example, natural leather, synthetic leather, knits, non-woven materials, natural fabrics, and/or synthetic fabrics. In other cases, the upper 110 may comprise breathable mesh and/or synthetic textile fabrics made from materials such as nylons, polyesters, polyolefins, polyurethanes, rubbers, foams, or any combinations thereof. The material of the upper 110 may be selected and/or optimized based on desired properties such as breathability, durability, flexibility, comfort, and/or water resistance.

In some embodiments, the shoe 100 may be waterproof. In some cases, at least a forefoot, midfoot, and/or rearfoot area of the upper may be constructed of one or more materials or layers (e.g., membranes) having water resistant properties. Additional features (e.g., non-porous or semi-porous membranes that permit a selective movement or passage of moisture) may be applied when fabricating the shoe 100 to provide additional waterproofing capabilities.

In some embodiments, the upper 110 may comprise an instep region with an opening for inserting a subject's foot. In some cases, the instep region may include a tongue member. In some embodiments, the upper 110 may comprise a heel collar extending around at least a portion of the opening. The heel collar may be configured to provide enhanced comfort and fit.

In some embodiments, the upper 110 may comprise an insole component (e.g., an insole footbed or an insole board). In some cases, the insole component may be designed to provide support for a subject's foot (e.g., as the subject exerts a force on the insole while walking, running, kneeling, squatting, or executing a swing). The insole component may be flexible, semi-rigid, or rigid. In some cases, the insole component may be a removable insert that can be positioned within the shoe 100. In some examples, the insole component can be worn inside the shoe 100 and may be designed to provide cushioning or support for the subject wearing the shoe 100.

In some embodiments, the forefoot region of the upper 110 may comprise an eye stay that may be attached to the vamp. In some cases, the eye stay may cover at least a portion of the tongue member. In some cases, the eye stay may comprise one or more eyelets through which one or more laces can be threaded.

In any of the embodiments described herein, a variety of tightening systems can be used for tightening the shoe 100 around the contour of the foot. For example, laces of various types of materials (e.g., natural or synthetic fibers, metal cable) may be included in the tightening system. In some cases, the shoe 100 may include a metal cable (lace)-tightening assembly that may comprise a dial, spool, and housing and locking mechanism for locking the cable in place.

In some cases, the upper 110 may have a traditional shape. In other cases, the upper 110 may comprise a shape that is non-traditional.

In some embodiments, the golf shoe 100 may comprise a sole assembly 120. The sole assembly 120 may comprise a midsole and/or an outsole. In some cases, the sole assembly 120 may be connected to the upper 110.

In some embodiments, the sole assembly 120 may comprise a midsole. The midsole may comprise a relatively lightweight material configured to provide cushioning and/or support to the shoe 100. In some embodiments, the midsole may be made from one or more midsole materials such as, for example, a foamed material. In some cases, the foamed material may comprise a material (e.g., a molding agent) that is foamed using a foaming agent. In some case, the foamed material may comprise a material that comprises a foam or foam-like structure. In some cases, the foamed material may comprise an open cell foam comprising one or more open or partially open cells. In other cases, the foamed material may comprise a closed cell foam comprising one or more closed or partially closed cells. In some non-limiting embodiments, the foamed material may comprise an elastic foam. The elastic foam may include, for example, ethylene vinyl acetate copolymer (EVA), an elasticized closed-cell foam with rubber-like softness and flexibility. In other non-limiting embodiments, the foamed material may comprise a viscous foam. The viscous foam may include, for example, a polyurethane foam or a polyethylene foam. In some alternate embodiments, the foamed material may comprise a viscoelastic foam. The viscoelastic foam may have the elastic properties of an elastic foam and the viscous properties of a viscous foam. In some cases, the viscoelastic foam may comprise a memory foam or a memory foam-like material. In any of the embodiments described herein, the midsole may comprise a plurality of different foamed materials (e.g., foamed ethylene vinyl acetate copolymer (EVA) and/or foamed polyurethane compositions). In any of the embodiments described herein, the foamed material (described with respect to the midsole above or the outsole below) may not or need not comprise particles of an expanded material that are processed (e.g., compressed, melted or fused together, or adhesively coupled) to form the midsole or the outsole without using a foaming agent and/or a molding agent.

In some embodiments, the sole assembly 120 may comprise an outsole. The outsole may be designed to provide support and traction for the shoe. In some embodiments, the outsole may be integrated with the midsole. For example, the midsole may be fused with the outsole or otherwise attached to outsole (e.g., using an adhesive or as part of a manufacturing process for the midsole and/or the outsole). In some cases, the midsole can be molded as a separate piece and then joined to a top surface of the outsole by stitching, adhesives, or other suitable means. For example, the midsole can be heat-pressed and bonded to the top surface of the outsole. In some examples, the midsole and the outsole can be molded using a 'two-shot' molding method. In any of the embodiments described herein, the midsole may be positioned above the outsole such that at least a portion of the midsole is between a subject's foot and the outsole.

In some embodiments, at least a portion of the outsole may comprise a foamed material as described elsewhere herein. In some cases, the foamed material may comprise an open cell foam comprising one or more open or partially open cells. In other cases, the foamed material may comprise a closed cell foam comprising one or more closed or partially closed cells. In some non-limiting embodiments, the foamed material may comprise an elastic foam. The elastic foam may include, for example, ethylene vinyl acetate copolymer (EVA). In other non-limiting embodiments, the foamed material may comprise a viscous foam. The viscous foam may include, for example, a polyurethane foam or a polyethylene foam. In some alternate embodiments, the foamed material may comprise a viscoelastic foam. The viscoelastic foam may have the elastic properties of an elastic foam and the viscous properties of a viscous foam. In some cases, the viscoelastic foam may comprise a memory foam or a memory foam-like material. In any of the embodiments described herein, the outsole may comprise a plurality of different foamed materials (e.g., foamed ethylene vinyl acetate copolymer (EVA) and/or foamed polyurethane compositions). In any of the embodiments described herein, the foamed material (described with respect to the midsole or the outsole) may not or need not comprise particles of an expanded material that are processed (e.g., compressed, melted or fused together, or adhesively coupled) to form the midsole or the outsole without using a foaming agent and/or a molding agent.

In some embodiments, a bottom surface of the outsole may include a plurality of traction members to help provide traction between the shoe 100 and the different surfaces of a golf course or other ground surfaces. The traction members may comprise any suitable material such as, for example, rubbers, plastics, and combinations thereof. Thermoplastics such as nylons, polyesters, polyolefins, and polyurethanes can also be used in combination or interchangeably. In some embodiments, the traction members may comprise thermoplastic polyurethane (TPU). Alternatively, different polyamide compositions including polyamide copolymers and/or aramids can be used to form the traction members. In one example, an elastomer comprising block copolymers of rigid polyamide blocks and soft polyether blocks can be used.

In some embodiments, the plurality of traction members may comprise spikes (e.g., hard spikes or soft spikes). The spikes may comprise a protrusion that is configured to at least partially penetrate or otherwise physically interface with or contact a ground surface.

In some embodiments, the plurality of traction members may not or need not comprise any spikes. For example, the traction members may comprise a grooved or textured surface or material that is configured to reduce a lateral or translational movement of the shoe relative to a ground surface when a force is exerted on the sole assembly of the shoe. In some cases, the grooved or textured surface may have a higher coefficient of friction (static and/or dynamic frictional coefficient) than other portions of the outsole. In some embodiments, at least one of the plurality of traction members may be removable or detachable from the outsole. In some embodiments, at least one of the plurality of traction members may be permanently attached or coupled to the outsole or another portion of the sole assembly. In some alternative embodiments, the outsole may not or need not comprise any traction elements.

In any of the embodiments described herein, the upper and/or the sole assembly and/or any components thereof (e.g., the insole footbed, the insole board, the midsole, and/or the outsole) may comprise a forefoot region, a midfoot region, and a rearfoot region. Each of the forefoot region, the midfoot region, and the rearfoot region may correspond to a respective forefoot, midfoot, and rearfoot anatomy of a subject's foot. In general, the anatomy of a human foot can be divided into three bony regions. A rearfoot region of the foot may include the ankle (talus) and heel (calcaneus) bones. A midfoot region of the foot may include the cuboid, cuneiform, and navicular bones that form the longitudinal arch of the foot. The forefoot region of the foot may include the metatarsals and the toes. The shoe, and accordingly, the components of the upper and/or the sole assembly (e.g., the insole footbed, the insole board, the midsole, and/or the outsole), may comprise a rearfoot region corresponding to the rearfoot and/or heel area, a midfoot region that corresponds to the midfoot, and a forefoot region corresponding to the forefoot and/or toe area.

In some cases, the rearfoot region (and heel area) can correspond to a posterior end of the shoe. In some cases, the forefoot area, including the toe area, can correspond to an anterior end of the shoe.

In addition to having a rearfoot region, midfoot region, and forefoot region, the shoe, and accordingly, the components of the upper and/or the sole assembly (e.g., the insole footbed, the insole board, the midsole, and/or the outsole), may also have a medial side and a lateral side that are opposite one another. The medial side may generally correspond to an inside area of the wearer's foot and a surface that faces towards the wearer's other foot. The lateral side may generally correspond to an outside area of the wearer's foot and a surface that faces away from the wearer's other foot. The lateral side and the medial side may extend through each of the rearfoot area, the midfoot area, and the forefoot area. In some cases, the medial side and a lateral side may extend around the periphery or perimeter of the shoe.

Figure 2:
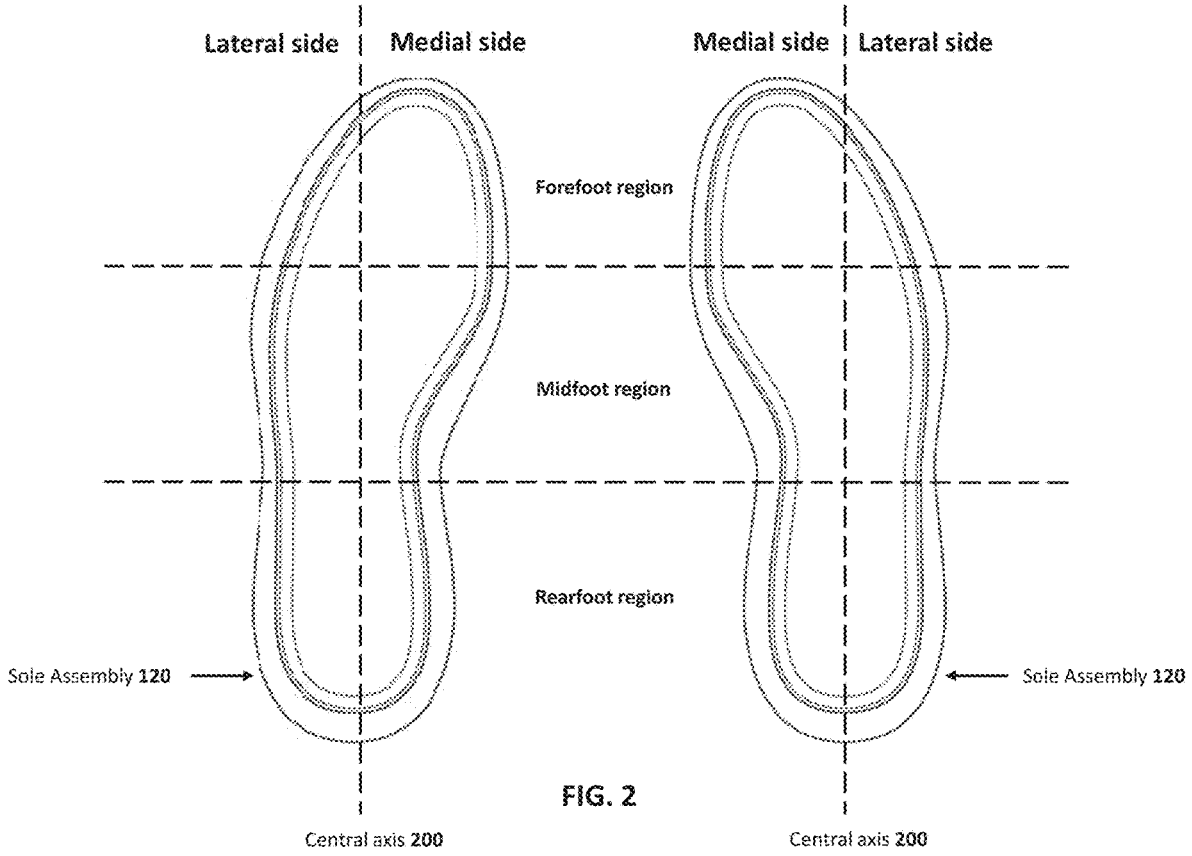
FIG. 2 depicts various regions of an exemplary sole assembly, as referenced and described herein.

FIG. 2 illustrates the various regions of an exemplary left and right sole assembly 120. The sole assembly 120 may comprise a forefoot region, a midfoot region, and/or a rearfoot region. The forefoot, midfoot, and rearfoot regions may extend laterally along a first dimension (e.g., a width) of the sole assembly 120. The forefoot, midfoot, and rearfoot regions may extend laterally between a medial side and a lateral side of the sole assembly, as described above. The forefoot, midfoot, and rearfoot regions may extend laterally along different portions or sections of a second dimension (e.g., a length) of the sole assembly 120. The forefoot, midfoot, and rearfoot regions may extend between a posterior end and an anterior end of the sole assembly 120, as described above.

Figure 3A:
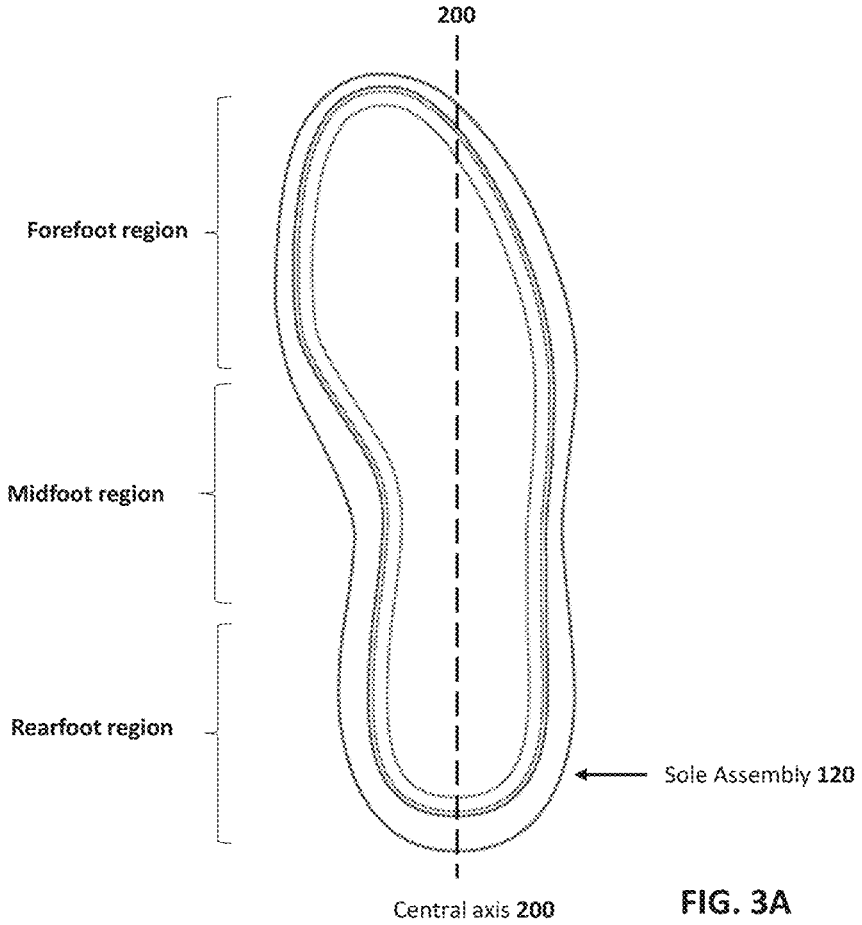
FIGS. 3A and 3B depict an exemplary sole assembly, in accordance with some embodiments.
Figure 3B:
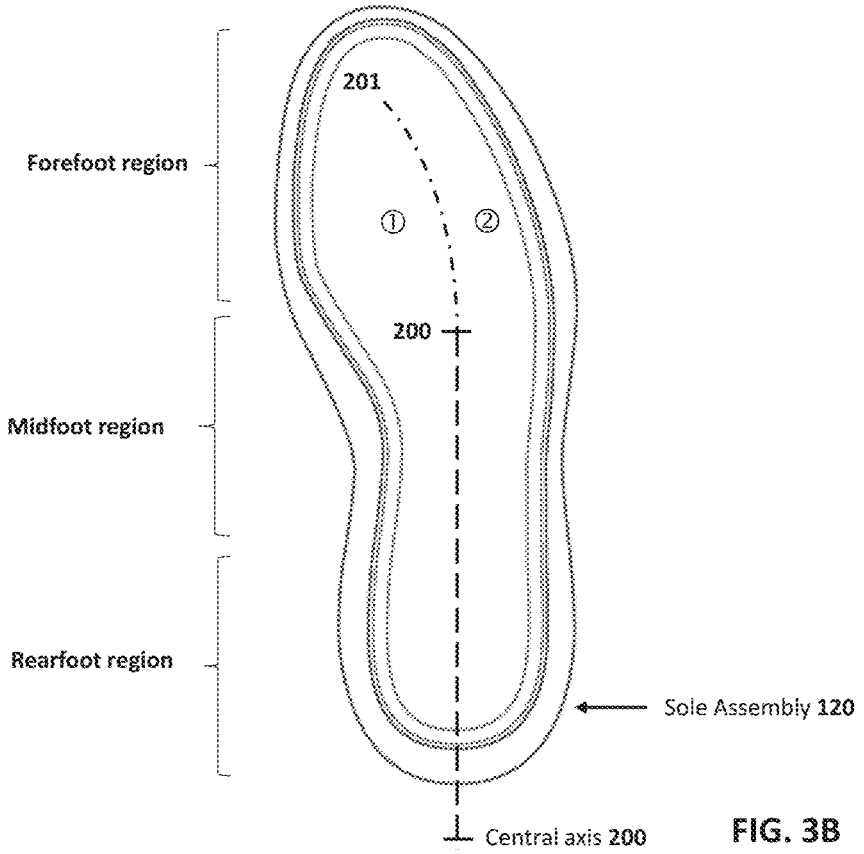

FIGS. 2, 3A, and 3B schematically illustrate a central axis 200 of the sole assembly 120. The central axis 200 may extend from a rear most portion of the rearfoot region of the sole assembly 120 towards the midfoot and/or forefoot regions of the sole assembly 120. In some embodiments, the central axis 200 may extend in a direction that is perpendicular or normal to an axis tangential to the rear most portion of the rearfoot region of the sole assembly 120.

Referring to FIG. 3A, in some embodiments, a portion of the central axis 200 (e.g., the portion extending through at least the rearfoot and/or midfoot regions of the sole assembly 120) may divide or bisect the sole assembly 120 into a medial side and a lateral side as described above. In some cases, a portion of the central axis 200 (e.g., the portion extending from the midfoot region of the sole assembly 120 to the forefoot region of the sole assembly 120) may not precisely divide or bisect the sole assembly 120 into a medial side and a lateral side. As shown in FIG. 3B, in some embodiments, the medial side ① and lateral side ② of the forefoot region of the sole assembly may be divided along a curved axis 201 that deviates from the central axis 200. Any references herein to a medial side or lateral side of an insole, a midsole, or an outsole may contemplate a delineation of the medial and lateral sides of the insole footbed, the insole board, the midsole, or the outsole along the central axis 200 and/or the curved axis 201 as shown in FIGS. 3A and 3B.

In one aspect, the present disclosure provides a golf shoe comprising an upper and a sole assembly connected to the upper. As described elsewhere herein, the sole assembly may include a structure that is embedded in or integrated with the midsole and/or the outsole of the sole assembly.

In some embodiments, at least one of the midsole or the outsole may comprise a structure integrated with or embedded in a foamed material of the midsole or the outsole. The foamed material may form all or a part of the midsole and/or the outsole. In some cases, at least one of the midsole and the outsole may comprise the foamed material. The foamed material may comprise, for example, any of the foamed materials described elsewhere herein, including EVA and other foam materials that can be foamed within a mold (such as the 1:1 scale molds disclosed herein).

In some embodiments, the structure may be embedded in or integrated with the foamed material used to form or shape the midsole or the outsole or any portions thereof. As used herein, embedded may refer to a configuration in which at least a portion of the structure is either partially or fully covered or encapsulated by the foamed material. As used herein, integration may refer to a configuration in which at least a portion of the structure that is placed adjacent or proximal to the foamed material. In some cases, integration may involve combining the structure with the foamed material or attaching the foamed material to the structure.

In some cases, the embedding of the structure in the foamed material may result in the foamed material covering or encapsulating at least a portion of the surface area of the structure. In some cases, at least about 5%, 10%, 15%, 20%, 25%, 30%, 35%, 40%, 45%, 50%, 55%, 60%, 65%, 70%, 75%, 80%, 85%, 90%, or more of the surface area of the structure may be covered by the foamed material. In some cases, at least about 90%, 91%, 92%, 93%, 94%, 95%, 96%, 97%, 98%, 99%, or more of the surface area of the structure may be covered by the foamed material. In some cases, 100% of the surface area of the structure may be covered by the foamed material (i.e., the structure may be fully encapsulated by the foamed material such that the structure is insulated or covered by the foamed material on all sides).

In some cases, the foamed material encapsulating the structure may comprise a range of thicknesses. The thicknesses may correspond to a distance from (1) a point of contact between the structure and the foamed material and (2a) a point of contact between foamed material and another material or component of the shoe or (2b) an external surface of the foamed material that is exposed to the outside environment. In some cases, the thickness may range from about 0.1 millimeters (mm) to about 10 mm or more.

In some cases, the embedding of the structure in the foamed material may yield an assembly that comprises at least two separate pieces that are coupled or attached to each other (the structure being one piece, and the foamed material being another piece). The structure may be at least partially embedded in the foamed material. The two separate pieces may require a minimum amount of force to separate. The minimum amount of force may range from about 1 Newton (N) to about 100 Newtons (N) or more.

In some embodiments, the integration of the structure with the foamed material may result in a coupling or attachment of at least a portion of the structure to at least a portion of the foamed material. In some embodiments, the integration of the structure with the foamed material may involve a portion of the structure being coupled or attached to an inner portion, surface, or volume of the foamed material. In some embodiments, the integration of the structure with the foamed material may involve a portion of the structure being enveloped by or embedded in the foamed material.

In some cases, the integration of the structure and the foamed material may result in a contact between a surface of the structure and the foamed material. The surface area of contact between the structure and the foamed material may range from about 1 $cm^2$ to about 100 $cm^2$ or more.

In some cases, the integration of the structure and the foamed material may yield an assembly that comprises at least two separate pieces that are coupled or attached to each other (the structure being one piece, and the foamed material being another piece). The two separate pieces may require a minimum amount of force to separate. The minimum amount of force to separate the pieces may range from about 1 Newton (N) to about 100 Newtons (N) or more.

In some embodiments, the structure may comprise one or more structural members. The one or more structural members may comprise an element of the structure that is sized and shaped to distribute or redirect a load exerted on a shoe (e.g., during a golf-related action) to different portions of the structure, the sole assembly, or the overall shoe. In some cases, the one or more structural members may comprise a beam, a column, a brace, a strut, a rod, a post, a bar, a plate, a truss, a frame, a lattice, a support, or any other type of rigid or flexible component or construct that is capable of distributing or redirecting forces (compressive, rotational/torsional, etc.) exerted on a sole assembly of a shoe. In some cases, the one or more structural members may comprise a torsion bar, an arm, a wing, or an arch structure, as described in greater detail below.

In some embodiments, the one or more structural members may comprise a cross-section. In some cases, the cross-section may comprise a lateral cross-section along a plane that extends through a portion of the member. In some cases, the cross-section may comprise a lateral cross-section along a plane that extends vertically or horizontally through a portion of the member. In any of the embodiments described herein, the plane may be oriented at an angle relative to a surface of the structural members. In some cases, the angle may range from about 1 degree to about 179 degrees. In some non-limiting embodiments, the plane may be normal, orthogonal, or perpendicular to a surface of the one or more structural members.

In some embodiments, the cross-section may comprise a cross-sectional shape. The cross-sectional shape may correspond to a lateral or vertical cross-section of the structural members. In some cases, the cross-sectional shape may comprise a circular shape or a polygonal shape. In some cases, the cross-sectional shape may comprise, for example, a circle, an ellipse, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

In some embodiments, the one or more structural members may comprise a cross-sectional shape that changes along a dimension of the structural member. In some cases, the dimensions of the cross-sectional shape may also vary along a portion of the structural member. The dimension may include, for example, a length, a width, and/or a height of the cross-sectional shape.

In some embodiments, the member may comprise a solid cross-section. The solid cross-section may comprise a single material or a plurality of materials that are layered next to or on top of each other. In other cases, the member may comprise a hollow cross-section. The hollow cross-section may comprise a material or a plurality of materials having an opening, a gap, a void, or a channel within an inner volume of the material.

In some embodiments, the one or more structural members and/or the overall structure may be flat or substantially flat. In other embodiments, the structural members and/or the overall structure may have multiple regions with different heights (relative to a surface of the midsole, a surface of the outsole, or the ground surface on which the shoe is provided). In some cases, the structure may comprise a three-dimensional frame or endoskeleton that spans a width, a length, and/or a height of the insole (e.g., the insole footbed or the insole board) or the midsole. In some cases, the structure may comprise one or more members that extend or slope upwards (e.g., towards a top of the midsole). In some cases, the structure may comprise one or more members that extend or slope downwards (e.g., towards a bottom of the midsole). In some cases, the structure may comprise a plurality of members that extend or slope upwards and/or downwards. In some embodiments, the structure may comprise a plurality of members that extend or slope upwards or downwards towards different portions of the midsole. In other embodiments, the structure may comprise a plurality of members that extend or slope upwards or downwards towards a same portion of the midsole. In some embodiments, the structure may comprise a plurality of members that converge at a same portion or region of the midsole. In other embodiments, the structure may comprise a plurality of members that diverge towards multiple different regions of the midsole.

In some embodiments, the structure may comprise a plurality of members that are integrally formed as a single, continuous structure for distributing or redirecting loads. In some embodiments, the plurality of members may have a fixed position and orientation relative to each other. In other embodiments, the plurality of members may be configured to move (e.g., flex or bend) relative to each other under load. In some cases, the structure comprising the plurality of members may be fabricated as a single, unitary piece. In some cases, the structure may not or need not comprise separate subcomponents that need to be joined or coupled together. In some cases, the structure may not or need not comprise any joints or hinges, or any rotating or articulating components or structural features that are mechanically linked, fastened, or joined.

In some embodiments, the structure may be integrally formed as a single, unitary structure. The single, unitary structure may not or need not comprise any separate or distinct subcomponents that are (i) coupled to each other (e.g., using fasteners) and/or (ii) joined to form a mechanical connection (e.g., a hinge, a joint, a slide, or any other type of connection that permits a translation and/or a rotation of one subcomponent relative to another subcomponent).

In some embodiments, the structure may comprise a spineless structure. In some cases, the spineless structure may not or need not comprise an elongate member that extends between a forefoot region and a rearfoot region of the midsole or outsole. In some cases, the spineless structure may not or need not comprise rib members that are coupled or secured to an elongate member extending between a forefoot region and a rearfoot region of the midsole or outsole. In some embodiments, the single, unitary structure may comprise a plurality of structural members extending between the medial side and the lateral side of the midsole or the outsole. The plurality of structural members may not or need not be connected to any elongate member extending between the forefoot and rearfoot regions of the midsole or outsole.

In some embodiments, a portion of the structural members may have a fixed position and/or a fixed orientation relative to (i) another portion of the structure and/or (ii) a portion of the midsole or outsole in which the structural members are integrated or embedded. In some embodiments, a portion of the structural members may be configured to flex or deform when a force is exerted on the members. In some cases, a portion of the midsole or outsole that is adjacent or proximal to the structural members may be configured to flex or deform in response to the flexing or deformation of the structural members. In some cases, the portion of the member that is flexing or deforming may remain in a relatively fixed position and orientation relative to the portion of the midsole or outsole that is flexing or deforming in response to the flexing or deformation of the member. In some cases, a portion of the members may be configured to move relative to a surface of the midsole or outsole that is adjacent or proximal to the movable portion of the members. In some cases, the portion of the members that is configured to move relative to the midsole or outsole may be positioned in or near one or more windows, cavities, or voids within the foamed material surrounding or encapsulating the structure. In some cases, the foamed material surrounding or encapsulating the structure may not or need not comprise any windows, cavities, or voids to accommodate a motion of the members (e.g., a flexing, a bending, a twisting, a stretching, or a compressing of the members) under load.

In some embodiments, the structure may comprise a structural shape or profile that is different than a shape or profile of a bottom of a subject's foot. In one non-limiting example, the structure may comprise a cylindrical shape with a curved upper surface that slopes downwards towards the bottom of the sole assembly, similar to the exemplary structural configuration shown in FIGS. 4A and 4B. The curvature of the upper surface can have a different radius of curvature than a bottom surface or an arch of a subject's foot. In another example, the structure may comprise an arched profile that curves downwards towards the medial and lateral sides of the sole assembly, similar to the exemplary structural configurations shown in FIGS. 5A and 5B. The arched profile may not or need not conform to a shape or a profile of the subject's foot. In FIG. 5C, the upper portion of the structure may comprise fixed members that extend towards the lateral and medial sides of the sole assembly, and in some optional embodiments, wings that conform to a shape or a profile of (i) the lateral or medial side of the sole assembly and/or (ii) a sidewall of a mold used to fabricate the sole assembly. In some embodiments (e.g., as shown in FIGS. 6A-6B), the upper portion of the structure may be shaped to provide torsional stiffness in the midfoot region of the sole assembly, and may have a profile that is different than that of the bottom surface of a subject's foot. In other embodiments (e.g., as shown in FIGS. 7, 8A-8E, and 9A-9C), the upper portion of the structure may be curved upwards to provide a suspension effect. In some cases, the curvature of the upper portion of the structure may not or need not conform to a shape or a profile of a bottom surface of a subject's foot.

In some embodiments, the one or more members may extend between a first region of the sole assembly and a second region of the sole assembly. The first region or the second region of the sole assembly may include a lateral side or a medial side of the sole assembly. The first region or the second region of the sole assembly may include a forefoot region, a midfoot region, or a rearfoot region of the sole assembly.

In some embodiments, the one or more members may be configured to extend between the lateral side and the medial side of the sole assembly. In some embodiments, the one or more members may extend between the lateral side and the medial side of the midsole or the outsole. The extension of the one or more members between the lateral side and the medial side of the midsole or the outsole may enhance the stiffness and support provided by the midsole or the outsole.

In some embodiments, the one or more members may be configured to extend between (1) a central region of the midsole or outsole and (2) a medial side and/or a lateral side of the midsole or the outsole to enhance a lateral support and a torsional strength or stiffness of the midsole or the outsole. In some embodiments, the one or more members may be configured to extend through the central region of the midsole or outsole to both the medial and lateral sides of the midsole or the outsole.

In some non-limiting embodiments, the central region of the midsole or the outsole may correspond to a midfoot region of the midsole or the outsole (e.g., as shown in FIG. 2). In other alternative embodiments, the central region of the midsole or the outsole may correspond to a portion of the midsole or the outsole that is along or proximal to the central axis 200 or the curved axis 201 (e.g., as shown in FIGS. 3A and 3B). In some cases, the central region of the midsole or the outsole may be located in the forefoot, midfoot, and/or rearfoot region of the midsole or outsole, so long as the central axis 200 or the curved axis 201 is used as a point or frame of reference to approximately indicate the central region of the midsole or the outsole. In some embodiments, the central region of the midsole or the outsole may correspond to a midfoot region of the midsole or the outsole that further coincides with or is proximal to the central axis 200 or the curved axis 201 extending through or across the midsole or the outsole.

In some embodiments, the structure may comprise a three-dimensional (3D) structure. In some cases, the 3D structure may comprise an additively manufactured part. The additively manufactured part may be produced using, for example, 3D printing, laser sintering, welding, molding, or any other type of additive manufacturing process.

In some embodiments, the structure may comprise a machined part. In some embodiments, the structure may comprise a part that is fabricated using one or more subtractive manufacturing processes (e.g., milling, turning, laser cutting, electrical discharge machining (EDM), carving, etc.).

Figure 4A:
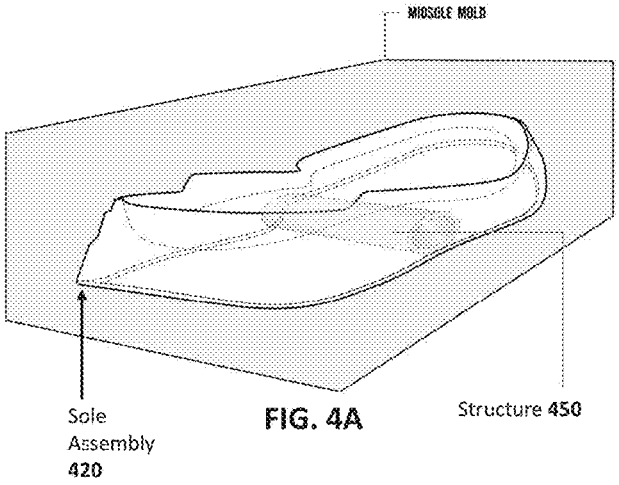
FIGS. 4A and 4B depict an example of a sole assembly comprising a structure for internal midsole reinforcement, in accordance with some embodiments.
Figure 4C:
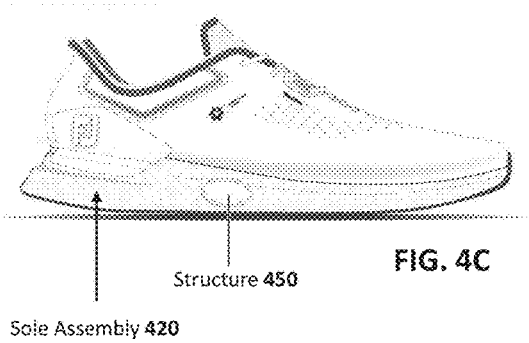
FIG. 4C depicts an example of an internal structure that can be visible through the sole assembly, in accordance with some embodiments.
Figure 4B:
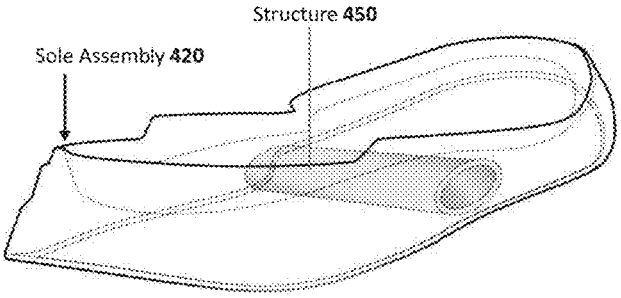

FIGS. 4A and 4B depict an exemplary sole assembly 420 comprising a structure 450 that can be embedded in or integrated with the sole assembly 420. The sole assembly 420 may comprise a midsole or an outsole as described above. In some embodiments, the structure 450 can be placed inside a mold, and the sole assembly 420 can be formed using the mold. In some cases, the sole assembly 420 may be formed around the structure 450.

In some embodiments, the structure 450 may comprise a reinforcement part. The reinforcement part may be configured for internal midsole reinforcement. In some cases, the reinforcement part may be configured to stiffen the midsole so that the midsole resists deformation under torsion or shear stress (e.g., when a golfer is executing a golf swing and shifts his/her weight or pivots his/her feet).

In some non-limiting embodiments, the structure 450 may comprise a rod or a tube that extends between a medial side and a lateral side of the sole assembly. In some cases, the rod or tube may comprise a hollow inner region. In some cases, an inner region of the rod or tube may be hollowed to reduce a total weight or mass of the structure 450. In some cases, the hollow inner region may be filled with a filler material (e.g., a foamed material as described elsewhere herein) to optimize a stiffness of the structure or the sole assembly in which the structure is embedded.

Referring to FIG. 4C, in some cases, the structure 450 that is embedded in the sole assembly 420 may be at least partially visible through the sole assembly 420. In some cases, the structure 450 may be visible on both the medial and lateral sides of the sole assembly. In some cases, the visible structure 450 may indicate that the shoe includes a reinforcement part embedded in or integrated with the sole assembly 420.

Figure 5A:
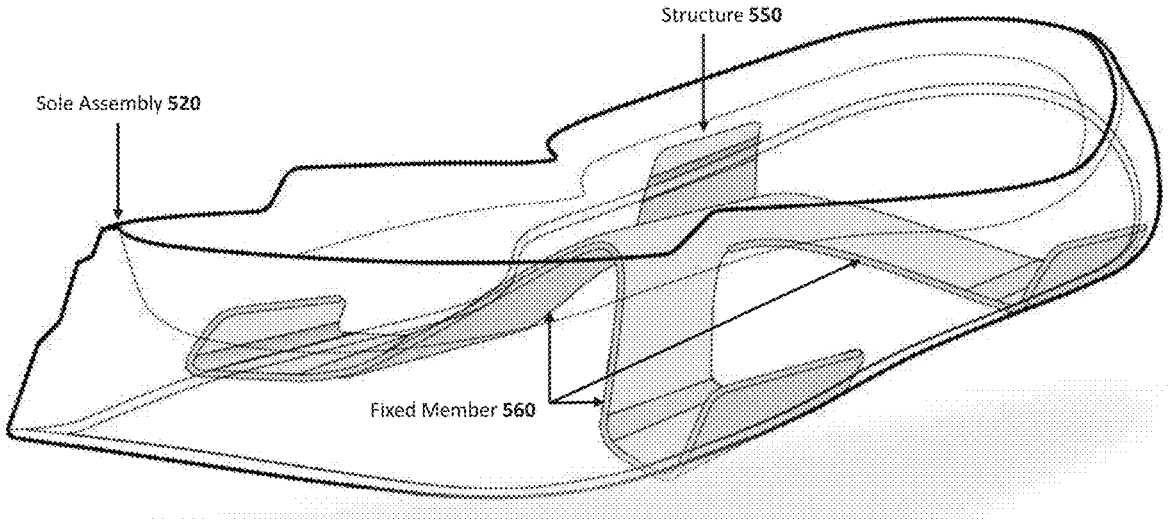
FIGS. 5A-5C depict various exemplary configurations of three-dimensional structures that can act as an internal torsion bar for a midsole or an outsole, in accordance with some embodiments.
Figure 5B:
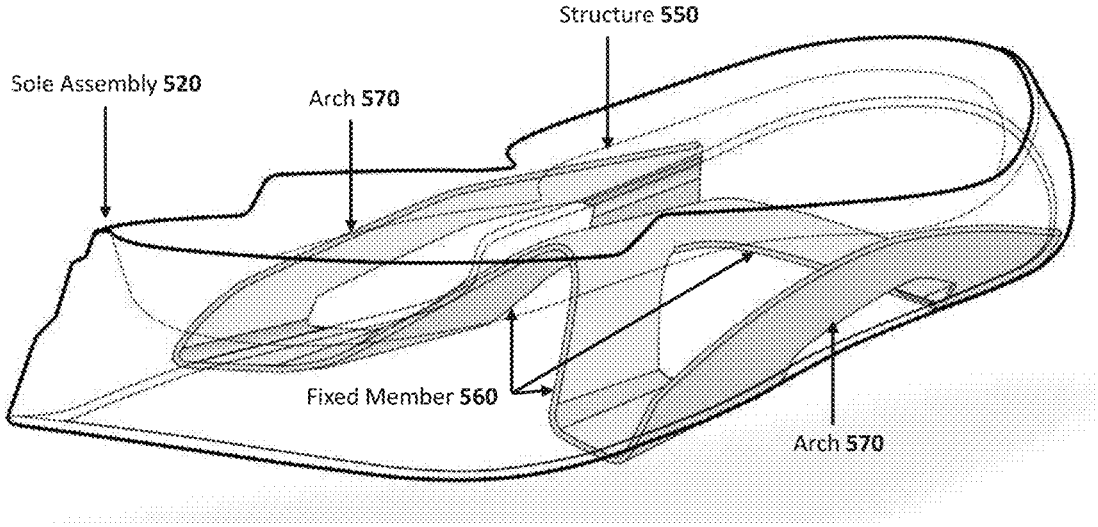
Figure 5C:
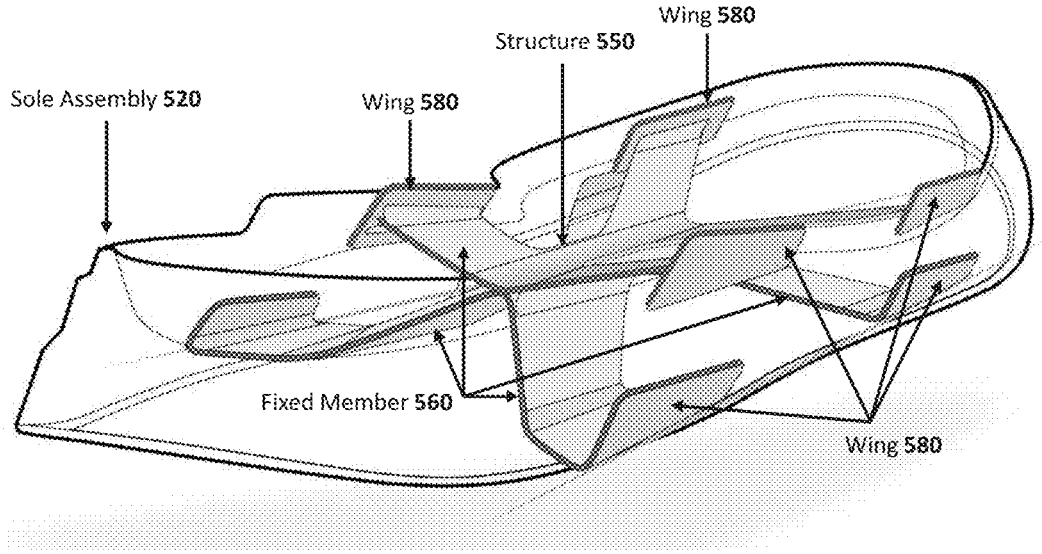
Figure 6A:
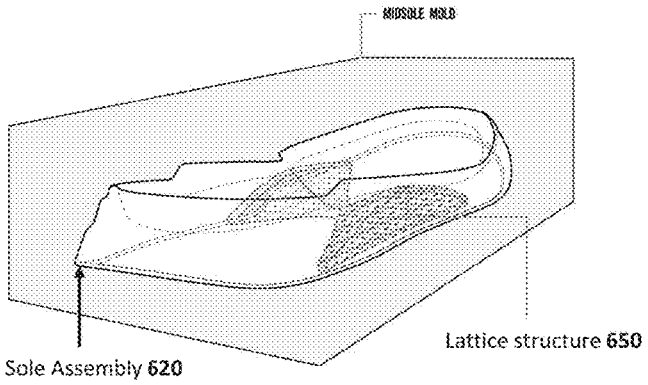
FIGS. 6A and 6B depict an exemplary sole assembly comprising a lattice structure, in accordance with some embodiments.

FIGS. 5A, 5B, and 5C illustrate various examples of a structure 550 that can act as an internal torsion bar for a sole assembly 520 of a shoe. As described elsewhere herein, the sole assembly 520 may comprise a midsole or an outsole.

In some embodiments, the structure 550 may comprise one or more members 560. The one or more members 560 may extend between a medial side and a lateral side of the sole assembly 520. In some cases, the one or more members 560 may extend from a center region of the sole assembly 520 to a lateral or medial side of the sole assembly. In some cases, the one or more members 560 may contact the medial and lateral sides of the sole assembly 520.

In some cases, the structure 550 and/or the one or more members 560 may comprise a straight or linear section. In some cases, the structure 550 and/or the one or more members 560 may comprise a curved or arched section. In some cases, the structure 550 and/or the one or more members 560 may comprise one or more straight or linear sections and one or more curved or arched sections.

In some embodiments, the structure 550 and/or the one or more members 560 may curve or slope upwards and/or downwards. In some cases, the structure 550 and/or the one or more members 560 may curve or slope upwards as the structure 550 or the one or more members 560 extend from (i) a medial or lateral side of the sole assembly 520 to (ii) a center region of the sole assembly 520. In some cases, the structure 550 and/or the one or more members 560 may curve or slope downwards as the structure 550 or the one or more members 560 extend from (i) a center region of the sole assembly 520 to (ii) a medial or lateral side of the sole assembly 520. In some cases, the structure 550 and/or the one or more members 560 may curve or slope upwards at the medial and/or lateral side(s) of the sole assembly 520. In some cases, the upward curvature of the structure 550 and/or the one or more members 560 at the medial and/or lateral side(s) of the sole assembly 520 may correspond to a curvature of a surface of the mold used to fabricate the sole assembly 520 with the embedded structure 550. In some cases, the shape or curvature of the structure 550 and/or the one or more members 560 may be configured to secure the structure 550 to the mold used to fabricate the sole assembly 520. The one or more members 560 may be configured to secure the structure 550 in a predetermined position or orientation within the mold used to fabricate the sole assembly 520.

In some embodiments, the one or more members 560 may extend from a center region of the sole assembly 520 to different medial or lateral regions of the sole assembly 520. In some cases, the one or more members 560 may comprise a member extending towards a lateral forefoot, midfoot, or rearfoot region of the sole assembly 520. In some cases, the one or more members 560 may comprise a member extending towards a medial forefoot, midfoot, or rearfoot region of the sole assembly 520.

In any of the embodiments described herein, the structure 550 may comprise a unitary structure comprising the one or more members 560. In some embodiments, the unitary structure 550 comprising the one or more members 560 may be formed from a single continuous piece of material. In some embodiments, the one or more members 560 may be connected to each other either directly or via an intermediary connecting region of the structure 550 that spans a dimension (e.g., a length, a width, or a height) of the sole assembly 520. The intermediary connecting region may be, for example, a spinal structure from which the members 560 can extend (or any other type of structure that can function as a central hub for the members 560). In some embodiments, the intermediary connecting region and the one or more members 560 may be formed from a single continuous piece of material.

Referring to FIG. 5B, in some embodiments, the structure 550 may further comprise one or more arches 570. The one or more arches 570 may be positioned at or near a medial side and/or a lateral side of the sole assembly 520. In some cases, the one or more arches 570 may extend from a forefoot region of the sole assembly 520 to a midfoot or rearfoot region of the sole assembly 520. In some cases, the one or more arches 570 may extend from a midfoot region of the sole assembly 520 to a rearfoot region of the sole assembly 520. The one or more arches 570 may span a dimension (e.g., a length, a width, or a height) of the sole assembly 520. In any of the embodiments described herein, the one or more arches 570 may be configured to provide additional structural support to further stiffen and/or reinforce the sole assembly 520.

Referring to FIG. 5C, in some embodiments, the structure 550 may comprise a plurality of members 560 extending from a central region of the sole assembly 520 to a lateral and/or medial side of the sole assembly 520. In some embodiments, the plurality of members 560 may comprise (i) a first set of members extending towards the lateral and/or medial side(s) of a first portion of the sole assembly 520 and (ii) a second set of members extending towards the lateral and/or medial side(s) of a second portion of the sole assembly 520. In some cases, the first portion of the sole assembly 520 and/or the second portion of the sole assembly 520 may correspond to a forefoot region, a midfoot region, and/or a rearfoot region of the sole assembly 520.

In some embodiments, the structure 550 may comprise one or more wings 580. In some cases, the one or more wings 580 may be disposed on a distal end of the one or more members 560. In some cases, the shape and/or curvature of the one or more wings 580 may correspond to a curvature of a mold used to fabricate the sole assembly 520. In some cases, the one or more wings 580 may be configured to secure the structure 550 to the mold used to fabricate the sole assembly 520. In some cases, the wings 580 may be configured to secure the structure 550 in a predetermined position or orientation within the mold used to fabricate the sole assembly 520.

In some embodiments, the one or more wings 580 may comprise (1) a first wing extending towards an upper region of a lateral or medial side of the sole assembly and (2) a second wing extending towards a lower region of a lateral or medial side of the sole assembly. The first wing may be disposed at an angle relative to the second wing. In some non-limiting embodiments, the angle between the first wing and the second wing may range from about 5 degrees to about 45 degrees or more. In some embodiments, the structure may comprise an upper wing and a lower wing disposed under or below the upper wing. In some cases, the angle between the upper wing and the lower wing may range from about 5 degrees to about 45 degrees or more.

In any of the embodiments described herein, the structure may have one or more desirable properties that allow the structure to support a subject's foot and optimally distribute forces or loads to different regions of the shoe to enhance traction, grip, stability, and comfort. In some embodiments, the structure may be configured to control a distribution of forces or loads on the midsole of the shoe and divert said forces or loads to one or more optimal locations or zones within the shoe or on a ground surface in order to assist a subject with executing an optimal golf-related motion (e.g., a golf swing). In some embodiments, the structure may be configured to control a distribution of forces or loads on the midsole of the shoe and divert said forces or loads to one or more optimal locations or zones within the shoe or on a ground surface in order to at least partially compensate for any deviations or variations between (i) an actual motion path or swing trajectory by the subject and (ii) an optimal motion path or swing trajectory for the subject. In some cases, the one or more desirable properties may comprise a strength of the overall structure or the various members of the structure. The strength may include, for example, a compressive strength, a tensile strength, or a shear strength. As used herein, compressive strength may refer to the ability of a structure or material to withstand compressive loads. As used herein, tensile strength may refer to an amount of stress that a structure or material can withstand while being stretched or pulled before deforming or breaking. As used herein, shear strength may refer to the strength of a material or component against yields or structural failures that can occur when a material or structure experiences shear loads. A shear load may comprise a force that produces a sliding failure in a material along a plane that is parallel to the direction of the force (e.g., by causing a portion of the internal structure of the material to slide against itself). In some cases, the structure may have a compressive strength ranging from about 10 Megapascals (MPa) to about 100 MPa or more. In some cases, the structure may have a tensile strength ranging from about 10 Megapascals (MPa) to about 100 MPa or more. In some cases, the structure may have a shear strength ranging from about 10 Megapascals (MPa) to about 100 MPa or more.

In some cases, the one or more desirable properties may comprise a stiffness of the overall structure or the various members of the structure. In some cases, the stiffness may include, for example, a flexural stiffness or a torsional stiffness. As used herein, flexural stiffness (also known as flexural rigidity) may refer to a force couple required to bend a structure or a material by a unit of curvature. The flexural stiffness may correspond to the resistance offered by the structure or material while undergoing a bending or flexing motion about an axis. As used herein, torsional stiffness may refer to the amount of torque required to twist an object or a material by a unit radian or degree. The torsional stiffness may be represented as a ratio of torque to the angular twist experience by a material. In some cases, the structure may have a flexural stiffness ranging from about 10 Newton-centimeters (N-cm) to about 100 N-cm or more. In some cases, the structure may have a torsional stiffness ranging from about 10 Newton-centimeters per degree (N-cm/deg) to about 100 N-cm/deg or more.

In some non-limiting embodiments, the structure may comprise a lattice structure. The lattice structure may comprise a collection or network of topologically ordered, three-dimensional open-celled structures comprising one or more unit cells. The one or more unit cells may be arranged in three-dimensional (3D) space based on a cell map. In some cases, the cell map may define or outline a relative position and orientation for each cell relative to one or more other cells of the lattice.

In some embodiments, the lattice may comprise a surface-based lattice that can be generated or modeled using one or more mathematical equations or expressions. In other embodiments, the lattice may comprise a strut-based lattice comprising one or more structural members (e.g., rods or beams) that intersect at one or more nodes. In some alternative embodiments, the lattice may comprise a planar lattice that can be created in a two-dimensional plane and extruded to create a 3D structure.

In some embodiments, the lattice may comprise a periodic lattice, a non-periodic lattice, or a stochastic lattice. In some embodiments, the lattice can be a beam lattice, a plate lattice, a honeycomb lattice, or a TPMS (triply periodic minimal surface) lattice. In some embodiments, the lattice structure may comprise a triangular lattice, a square lattice, a rectangular lattice, a rhombic lattice, an oblique lattice, or a hexagonal lattice.

In some embodiments, the lattice may comprise a homogeneous lattice structure with uniform lattice properties across the lattice structure. In other embodiments, the lattice may comprise a heterogenous lattice structure with lattice properties that vary across different regions or sections of the lattice structure.

In some embodiments, the structural members of the lattice may comprise a cross-section having a cross-sectional shape. The cross-sectional shape may correspond to a lateral or vertical cross-section of the structural members. In some cases, the cross-sectional shape may comprise a circular shape or a polygonal shape. In some cases, the cross-sectional shape may comprise, for example, a circle, an ellipse, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

In some embodiments, the structural members of the lattice may comprise a cross-section having a cross-sectional shape that changes or varies along a dimension of the structural member. In some embodiments, different structural members of the lattice may comprise different cross-sectional shapes. In any of the embodiments described herein, the dimensions of the cross-sectional shape of the structural members may change along a length, a width, or a height of the structural members.

In some embodiments, the cross-sectional shape may comprise a plurality of dimensions. In some cases, a dimensional ratio between (i) a length or a width of the cross-sectional shape and (ii) a height of the cross-sectional shape may range from about 10:1 to about 1:10. In some embodiments, the cross-sectional shape may comprise one or more diagonal lengths or widths. The one or more diagonal lengths or widths may correspond to a distance between two or more sides or vertices of the cross-sectional shape. In some cases, a dimensional ratio between (i) a diagonal length or width of the cross-sectional shape and (ii) a height of the cross-sectional shape may range from about 10:1 to about 1:10. In some embodiments, the cross-sectional shape may comprise a plurality of diagonal lengths or widths. In some cases, the plurality of diagonal lengths or widths may comprise a first diagonal length or width and a second diagonal length or width. The first diagonal length may correspond to a first distance between a first set of sides or vertices of the cross-sectional shape, and the second diagonal length may correspond to a second distance between a second set of sides or vertices of the cross-sectional shape. The first set of sides or vertices may be different than the second set of sides or vertices. In some non-limiting embodiments, a dimensional ratio between (i) a first diagonal length or width of the cross-sectional shape and (ii) a second diagonal length or width of the cross-sectional shape may range from about 10:1 to about 1:10.

In some embodiments, the cross-sectional shape of the structural members of the lattice may comprise one or more dimensions. The one or more dimensions may correspond to a length, a width, or a height of the structural members. In some embodiments, the length of the structural members may range from about 1 mm to about 10 mm or more. In some embodiments, the width of the structural members may range from about 1 mm to about 10 mm or more. In some embodiments, the height of the structural members may range from about 1 mm to about 10 mm or more.

In some embodiments, the entire lattice structure may span a length, a width, or a height of the midsole. In some embodiments, the lattice structure may span a first distance corresponding to the length of the midsole. The first distance may range from about 1 cm to about 30 cm. In some embodiments, the lattice structure may span a second distance corresponding to the width of the midsole. The second distance may range from about 1 cm to about 10 cm. In some embodiments, the lattice structure may span a third distance corresponding to the height of the midsole. The third distance may range from about 1 cm to about 5 cm.

Figure 6C:
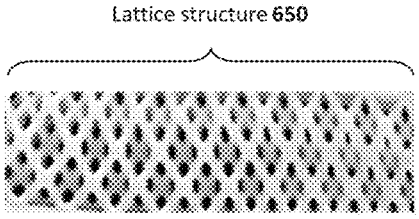
FIG. 6C depicts an exemplary lattice structure, in accordance with some embodiments.
Figure 6B:
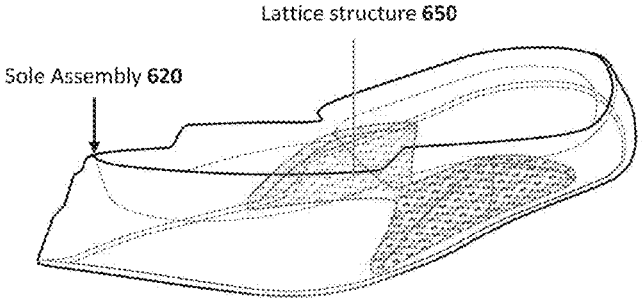

FIGS. 6A, 6B, and 6C illustrate various examples of lattice structures 650 that can be embedded in or integrated with a midsole or an outsole of a sole assembly 620. In some embodiments, the lattice structure 650 may be positioned at or near a midfoot region of the sole assembly 620 to internally reinforce and stiffen the sole assembly 620 (e.g., to resist deformation, flex, or wear due to torsional or shear forces).

In some embodiments, the lattice structure 650 may extend through a central portion or region of the sole assembly 620. In some embodiments, the lattice structure 650 may comprise one or more sides that fan out and span a length of the medial and lateral sides of the sole assembly 620. In some cases, the sides of the lattice may span a greater length of the sole assembly 620 than a medial region of the lattice that extends between the medial and lateral sides of the sole assembly 620. In some non-limiting embodiments, the thickness of the lattice structure 650 can gradually increase as the lattice extends from a central region of the sole assembly 620 to a lateral or medial side of the sole assembly 620. In some cases, the thickness of the lattice structure 650 may correspond to a vertical height of the sole assembly 620. In other non-limiting embodiments, the volume of the lattice structure 650 can gradually increase as the lattice extends from a central region of the sole assembly 620 to a lateral or medial side of the sole assembly 620.

In some embodiments, the lattice structure may comprise a first region having a first lattice property and a second region having a second lattice property. In some cases, the first lattice property and the second lattice property may provide or impart different material properties to different portions or regions of the shoe. The first lattice property and/or the second lattice property may be selected from the group consisting of a lattice geometry, a lattice density, and a lattice material composition. The different material properties imparted to the different portions of the shoe may include, for example, a strength (e.g., a compressive strength, a tensile strength, or a shear strength) or a stiffness (e.g., a flexural or torsional stiffness) of a forefoot, midfoot, or rearfoot region of the upper or the sole assembly (or any portion or layer thereof). In some embodiments, the different material properties imparted to the different portions of the shoe may include, for example, a strength (e.g., a compressive strength, a tensile strength, or a shear strength) or a stiffness (e.g., a flexural or torsional stiffness) of an insole component of the upper or a midsole or an outsole of the sole assembly.

In some embodiments, the first and second lattice property may include a lattice strength. The lattice strength may comprise a compressive strength, a tensile strength, or a shear strength. As used herein, compressive strength may refer to the ability of a structure or material to withstand compressive loads. As used herein, tensile strength may refer to an amount of stress that a structure or material can withstand while being stretched or pulled before deforming or breaking. As used herein, shear strength may refer to the strength of a material or component against yields or structural failures that can occur when a material or structure experiences shear loads. A shear load may comprise a force that produces a sliding failure in a material along a plane that is parallel to the direction of the force (e.g., by causing a portion of the internal structure of the material to slide against itself). In some cases, the structure may have a compressive strength ranging from about 10 Megapascals (MPa) to about 100 MPa or more. In some cases, the structure may have a tensile strength ranging from about 10 Megapascals (MPa) to about 100 MPa or more. In some cases, the structure may have a shear strength ranging from about 10 Megapascals (MPa) to about 100 MPa or more.

In some embodiments, the first and second lattice property may include a lattice stiffness. The lattice stiffness may comprise a flexural stiffness or a torsional stiffness. As used herein, flexural stiffness (also known as flexural rigidity) may refer to a force couple required to bend a structure or a material by a unit of curvature. The flexural stiffness may correspond to the resistance offered by the structure or material while undergoing a bending or flexing motion about an axis. As used herein, torsional stiffness may refer to the amount of torque required to twist an object or a material by a unit radian or degree. The torsional stiffness may be represented as a ratio of torque to the angular twist experience by a material. In some cases, the structure may have a flexural stiffness ranging from about 10 Newton-centimeters (N-cm) to about 100 N-cm or more. In some cases, the structure may have a torsional stiffness ranging from about 10 Newton-centimeters per degree (N-cm/deg) to about 100 N-cm/deg or more.

Figure 7:
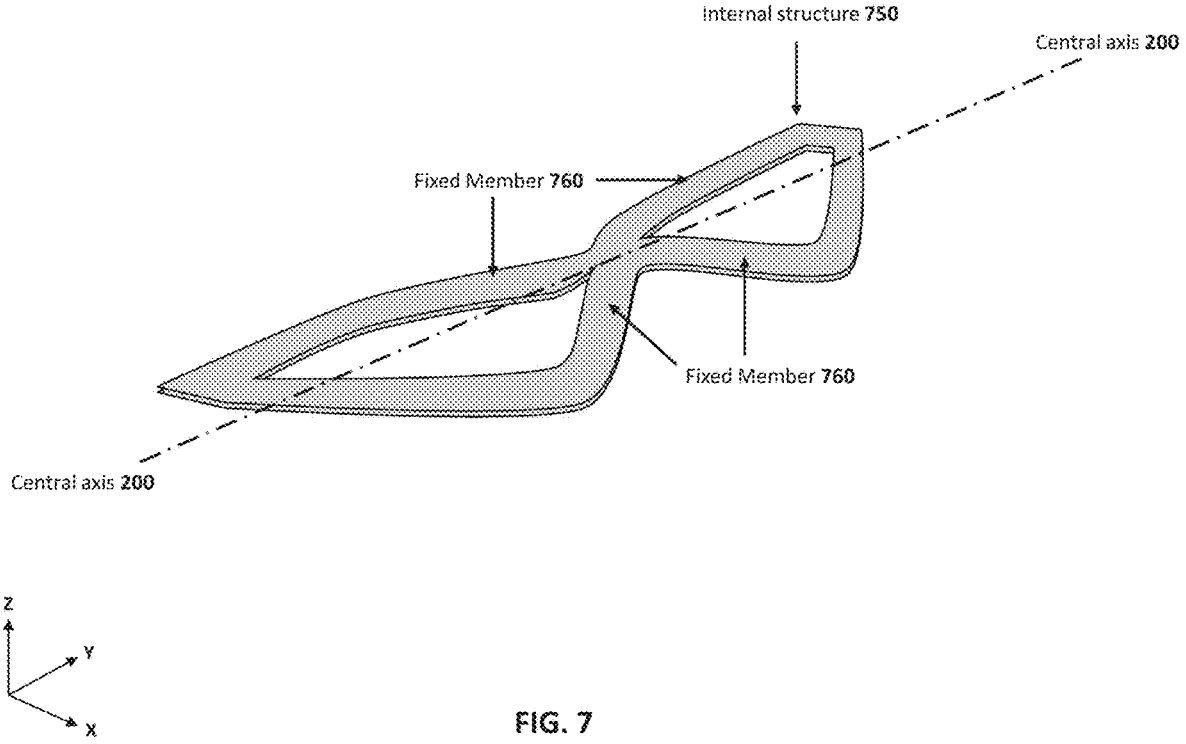
FIG. 7 depicts an example of a structure that can be embedded in or integrated with a midsole or an outsole, in accordance with some embodiments.

In some embodiments, (e.g., as shown in FIG. 7), the structure 750 embedded in or integrated with the sole assembly may comprise a plurality of members 760 extending from a central region of the sole assembly to a plurality of different lateral and/or medial regions of the sole assembly. In some cases, the central region of the sole assembly may be aligned with a central axis 200 of the sole assembly. In some cases, the plurality of members 760 may extend from a central region of the sole assembly to a plurality of different lateral and/or medial regions of the sole assembly. The plurality of different lateral and/or medial regions may be located at or near a forefoot, midfoot, or rearfoot region of the sole assembly. In some non-limiting embodiments, the plurality of members 760 may be joined at the posterior and/or anterior ends of the structure 750 to form a closed shape. In some cases, the closed shape may approximate the shape of a lemniscate (co) or a figure-8. In some cases, the closed shape may comprise one or more curved sections and/or one or more linear or angled sections. In some cases, the one or more linear or angled sections may diverge at or near a central portion of the structure 750. In some cases, the one or more linear or angled sections may converge at or near an anterior or posterior end of the structure 750.

Figure 8A:
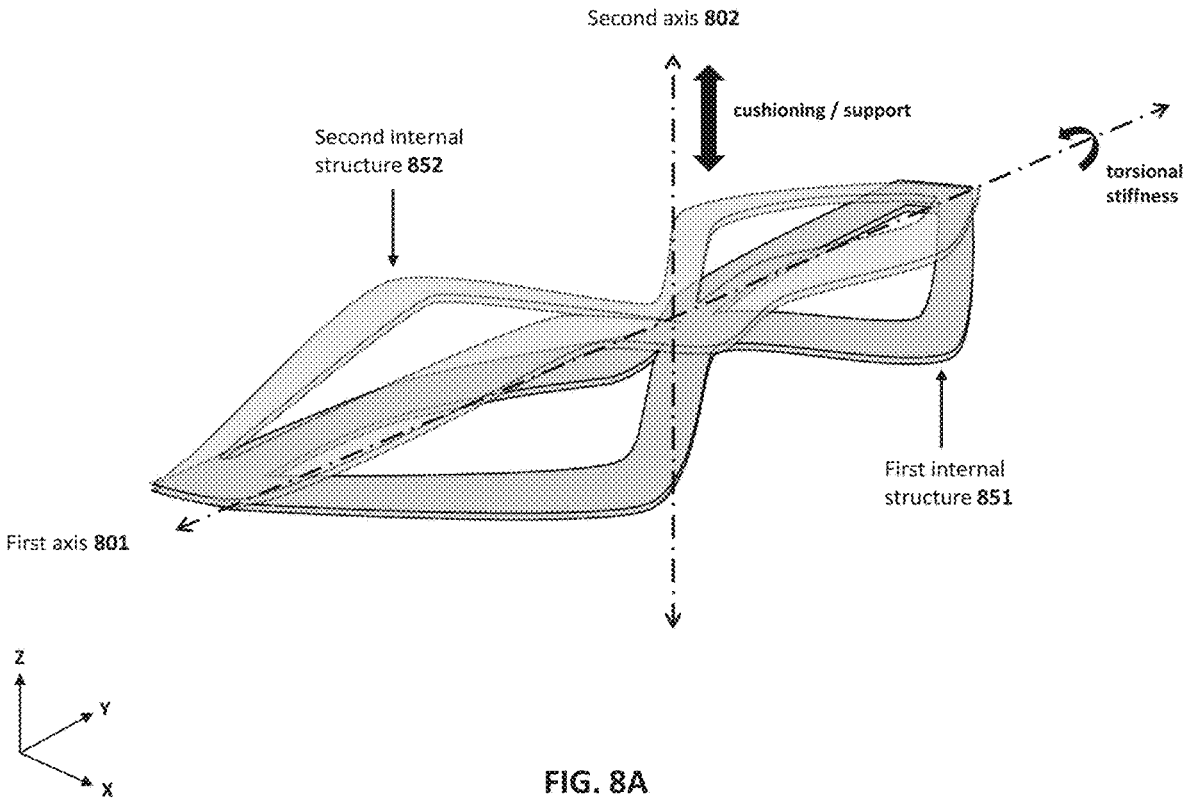
FIGS. 8A-8E depict various examples of a structure that can be embedded in or integrated with a midsole or an outsole to (i) enhance cushioning/support in or along a first axis and (ii) optimize torsional stiffness in or along a second axis, in accordance with some embodiments.
Figure 8B:
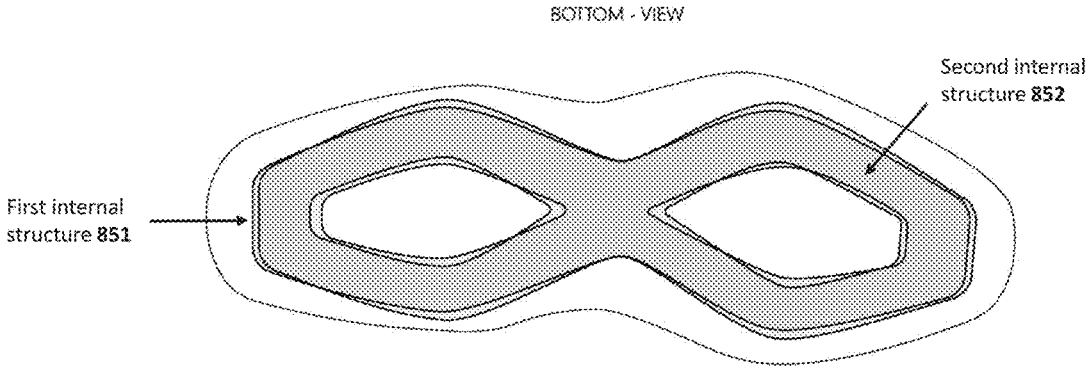
Figure 8C:
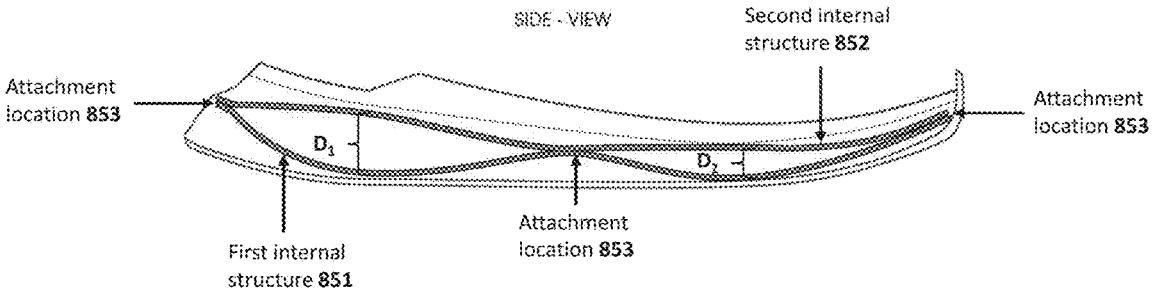

In some embodiments (e.g., as shown in FIG. 8A), the structure embedded in or integrated with the sole assembly may comprise a first internal structure 851 and a second internal structure 852 that is flexibly coupled or attached to the first internal structure 851. The first internal structure 851 and/or the second internal structure 852 may be provided in or as part of the midsole and/or outsole of the sole assembly. In some cases (e.g., as shown in FIGS. 8B and 8C), the second internal structure 852 may be positioned above the first internal structure 851. In some alternative embodiments, the first internal structure 851 may be positioned above the second internal structure 852.

In some embodiments, the first internal structure 851 and the second internal structure 852 may be attached at one or more locations 853 as shown in FIG. 8C. In some cases, the one or more attachment locations 853 may be located at or near a forefoot, midfoot, and/or rearfoot region of the sole assembly. In some embodiments, the first internal structure 851 and the second internal structure 852 may be joined at the one or more attachment locations 853. In some cases, the first internal structure 851 and the second internal structure 852 may be sized, shaped, positioned, and/or oriented such that the first internal structure 851 and the second internal structure 852 are separated by an adjustable distance at a first section within the sole assembly. In some cases, the first internal structure 851 and the second internal structure 852 may be sized, shaped, positioned, and/or oriented such that the first internal structure 851 and the second internal structure 852 are separated by an adjustable distance $D_2$ at a second section within the sole assembly. In any of the embodiments described herein, distance $D_1$ and/or distance $D_2$ can change as forces are exerted on the sole assembly and the first internal structure 851 and/or the second internal structure 852 flex or move relative to each other in response to the forces exerted on the sole assembly.

Referring back to FIG. 8A, in some embodiments, the structure embedded in or integrated with the sole assembly may comprise a first internal structure 851 and a second internal structure 852. In some embodiments, the first internal structure 851 and the second internal structure 852 may be configured to collectively and synergistically control a deformation or a flex of the sole assembly in or along two or more axes. For example, in some cases, the first internal structure 851 may be configured to provide torsional strength in or along a first axis 801, and the second internal structure 852 may be configured to provide cushioning or suspension support in or along a second axis 802.

In some embodiments, the first axis 801 may correspond to the central axis 200 schematically illustrated in the preceding figures. In some embodiments, the first axis 801 may be offset relative to the central axis 200. The offset may comprise, for example, an angular offset and/or an offset distance.

In some embodiments, the second axis 802 may correspond to a vertical or substantially vertical axis that is normal or substantially normal to a surface of the sole assembly. In some cases, the second axis 802 may intersect a midline axis extending between a lateral side and a medial side of the sole assembly. In other cases, the second axis 802 may not or need not intersect a midline axis extending between the lateral and medial sides of the sole assembly. The midline axis may, in some cases, intersect the central axis 200 of the sole assembly at a distance halfway or approximately halfway between the anterior and posterior ends of the shoe.

In some embodiments, the first axis 801 and the second axis 802 may form a plane comprising the first axis 801 and the second axis 802. Within the plane, the first axis 801 and the second axis 802 may be disposed at an angle relative to each other. In some cases, the angle may range from about 5 degrees to about 10 degrees, about 10 degrees to about 15 degrees, about 15 degrees to about 20 degrees, about 20 degrees to about 25 degrees, about 25 degrees to about 30 degrees, about 30 degrees to about 35 degrees, about 35 degrees to about 40 degrees, about 40 degrees to about 45 degrees, about 45 degrees to about 50 degrees, about 50 degrees to about 55 degrees, about 55 degrees to about 60 degrees, about 60 degrees to about 65 degrees, about 65 degrees to about 70 degrees, about 70 degrees to about 75 degrees, about 75 degrees to about 80 degrees, about 80 degrees to about 85 degrees, about 85 degrees to about 90 degrees, or more than 90 degrees.

Figure 8D:
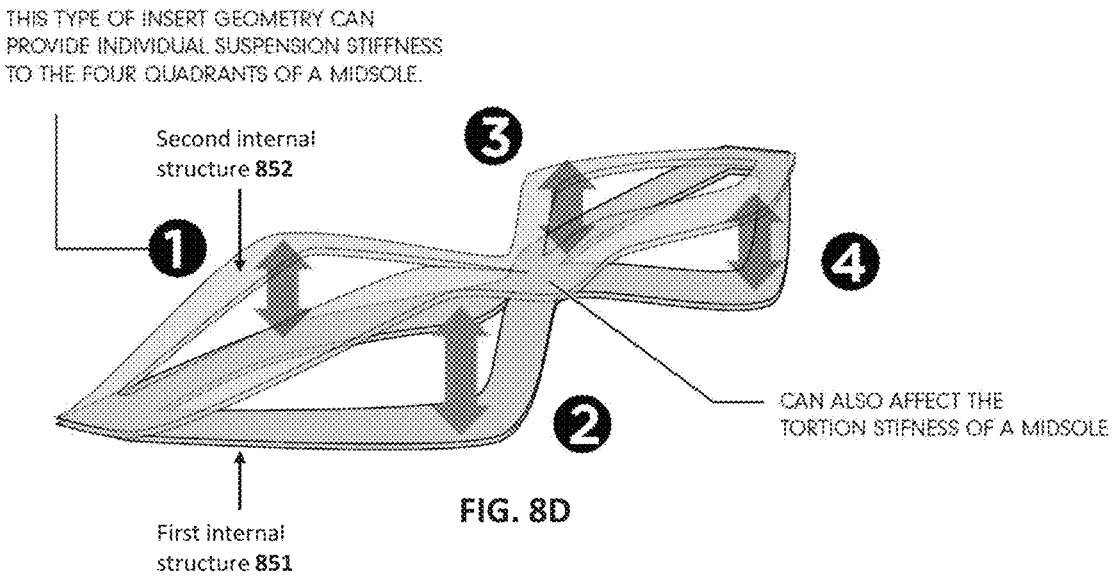

Referring to FIG. 8D, in some embodiments, the second internal structure 852 may be configured to flex or move relative to the first internal structure 851 positioned below the second internal structure 852. In some non-limiting embodiments, the flexing or movement of the second internal structure 852 may be in or along a vertical or substantially vertical axis (e.g., the second axis 802 shown in FIG. 8A). In other non-limiting embodiments, the flexing or movement of the second internal structure 852 may not or need not be in or along a vertical or substantially vertical axis. In some cases, the first internal structure 851 and/or the second internal structure 852 may be configured to provide suspension stiffness to various portions or quadrants of the sole assembly. In some cases, the first internal structure 851 and/or the second internal structure 852 may be further configured to enhance a torsional stiffness of the sole assembly.

Figure 8E:
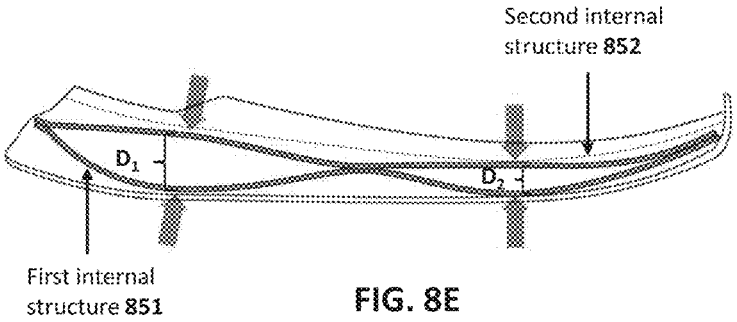

Referring to FIG. 8E, in some cases, the first internal structure 851 and/or the second internal structure 852 may be configured to flex towards each other when a force is exerted on the sole assembly. The force exerted on the sole assembly may include a compressive force and/or a torsional or shear force. In some embodiments, the flexing of the first internal structure 851 and/or the second internal structure 852 may help to cushion and support a subject's foot (e.g., during a golf-related action) and absorb or distribute forces exerted on the sole assembly to different components or sections of the shoe or sole assembly. In some cases, the flexing of the first internal structure 851 and/or the second internal structure 852 may change the gap distance $D_1$ and $D_2$ between the first internal structure 851 and/or the second internal structure 852.

In some embodiments, the arrangement and coupling of the first internal structure 851 and the second internal structure 852 may yield a structure with a vertical spring force constant. In some cases, the vertical spring force constant may range from about 0.01 N/m to about 10 N/m or more.

The structure embedded in or integrated with the midsole or the outsole may have various dimensions. In some cases, the structure may be sized and shaped to fit entirely within the midsole or the outsole. In some cases, the structure may be sized and shaped such that only a select portion of the structure is exposed or visible past the outer contours of the midsole or the outsole.

In some embodiments, the structure may have a width spanning at least a portion of the width of the midsole or the outsole. The width of the structure may vary depending on the width of the midsole or the outsole between the medial and lateral sides of the midsole or outsole. In some cases, the structure may have a width of at least about 5%, 10%, 15%, 20%, 25%, 30%, 35%, 40%, 45%, 50%, 55%, 60%, 65%, 70%, 75%, 80%, 85%, 90%, 95% or more of the width of the midsole or the outsole.

In some embodiments, the structure may have a length spanning at least a portion of the length of the midsole or the outsole. The length of the midsole or the outsole may correspond to a distance between the anterior and posterior ends of the midsole or outsole. In some cases, the structure may have a length of at least about 5%, 10%, 15%, 20%, 25%, 30%, 35%, 40%, 45%, 50%, 55%, 60%, 65%, 70%, 75%, 80%, 85%, 90%, 95% or more of the length of the midsole or the outsole.

In some embodiments, the structure may have a height spanning at least a portion of the height of the midsole or the outsole. The height of the midsole may correspond to (i) a distance between a portion of the midsole contacting the outsole and (ii) a portion of the midsole contacting the insole or the upper. The height of the outsole may correspond to (i) a distance between a portion of the outsole proximal to the ground and (ii) a portion of the outsole contacting the midsole, the insole, or the upper. In some cases, the structure may have a height of at least about 5%, 10%, 15%, 20%, 25%, 30%, 35%, 40%, 45%, 50%, 55%, 60%, 65%, 70%, 75%, 80%, 85%, 90%, 95% or more of the height of the midsole or the outsole.

In some embodiments, the structure may comprise one or more structural members extending through a portion of the midsole or outsole. The one or more structural members may comprise a cross-section having a cross-sectional shape as described elsewhere herein. The cross-sectional shape may comprise one or more dimensions. In some cases, the one or more dimensions may correspond to a length, a width, and/or a height of the one or more structural members. In some embodiments, the length or width of the cross-sectional shape may range from about 1 cm to about 10 cm or more. In some embodiments, the height of the cross-sectional shape may range from about 1 cm to about 5 cm or more.

In some embodiments, the cross-sectional shape may comprise a plurality of dimensions. In some cases, a dimensional ratio between (i) a length or a width of the cross-sectional shape and (ii) a height of the cross-sectional shape may range from about 10:1 to about 1:10. In some embodiments, the cross-sectional shape may comprise one or more diagonal lengths or widths. The one or more diagonal lengths or widths may correspond to a distance between two or more sides or vertices of the cross-sectional shape. In some cases, a dimensional ratio between (i) a diagonal length or width of the cross-sectional shape and (ii) a height of the cross-sectional shape may range from about 10:1 to about 1:10. In some embodiments, the cross-sectional shape may comprise a plurality of diagonal lengths or widths. In some cases, the plurality of diagonal lengths or widths may comprise a first diagonal length or width and a second diagonal length or width. The first diagonal length may correspond to a first distance between a first set of sides or vertices of the cross-sectional shape, and the second diagonal length may correspond to a second distance between a second set of sides or vertices of the cross-sectional shape. The first set of sides or vertices may be different than the second set of sides or vertices. In some non-limiting embodiments, a dimensional ratio between (i) a first diagonal length or width of the cross-sectional shape and (ii) a second diagonal length or width of the cross-sectional shape may range from about 10:1 to about 1:10.

In some embodiments, the entire structure may span a length, a width, or a height of the midsole. In some embodiments, the structure may span a first distance corresponding to the length of the midsole. In some cases, the first distance may range from about 1 cm to about 30 cm. In some embodiments, the structure may span a second distance corresponding to the width of the midsole. The second distance may range from about 1 cm to about 10 cm. In some embodiments, the structure may span a third distance corresponding to the height of the midsole. The third distance may range from about 1 cm to about 5 cm.

In any of the embodiments, the structure may comprise a true to size structure that can be integrated with or inserted or embedded in a midsole or an outsole. As used herein, the term "true to size" may refer to a structure that is sized and shaped according to one or more predetermined dimensions such that the size and shape of the structure when placed in a mold (to directly produce a midsole or outsole comprising the integrated or embedded structure integrated) is the same size and shape needed for the structure to support and stabilize the midsole or outsole. In some cases, the size and shape of the structure when placed in a mold may be the approximate size and shape needed to support and stabilize the midsole or outsole. In some cases, the size and shape of the structure when placed in a mold may be the exact size and shape needed to support and stabilize the midsole or outsole.

As described in further detail below, the use of true to size structures, in combination with molding techniques such as 1:1 scale molding, can greatly simplify and expedite the manufacturing process for golf shoes with sole assemblies comprising embedded or integrated structures or inserts. Compared to conventional methods, the presently disclosed methods leverage 1:1 scale molding and true to size structures to simultaneously or concurrently (i) fabricate a foamed midsole or outsole and (ii) integrate or embed the true to size structures within the foamed midsole or outsole, in a single molding process (in some cases using a single mold). The methods of the present disclosure can effectively enable high throughput manufacturing and production of golf shoes with midsoles or outsoles having embedded or integrated internal structures by simplifying the process for integrating internal structures in foamed midsoles or outsoles (and avoiding the need to wait for a foamed material to fully expand before integrating the internal structure with the midsole or outsole, which is traditionally required for conventional EVA foaming methods).

In some embodiments, the structure and/or the one or more members of the structure may comprise a rigid material. In some embodiments, the structure and/or the one or more members of the structure may comprise a deformable or elastic material. In some embodiments, the structure and/or the one or more members of the structure may be configured to bend or flex in response to a force exerted on the shoe by a subject (e.g., a golfer) during a golf-related movement or action.

In some embodiments, the structure and/or the one or more members of the structure may comprise a metallic material. The metallic material may include one or more of aluminum, calcium, magnesium, barium, scandium, titanium, vanadium, chromium, manganese, iron, cobalt, nickel, copper, zinc, yttrium, niobium, molybdenum, ruthenium, rhodium, silver, cadmium, actinium, and/or gold. In some cases, the metallic material may comprise a rare earth element. The rare earth element may include scandium, yttrium, or elements of the lanthanide series having atomic numbers 57-71.

In some embodiments, the structure and/or the one or more members of the structure may comprise an intermetallic material. The intermetallic material may be a solid-state compound exhibiting metallic bonding, defined stoichiometry and ordered crystal structure (i.e., alloys). The intermetallic material may include, for example, brass (copper and zinc), bronze (copper and tin), duralumin (aluminum, copper, manganese, and/or magnesium), gold alloys (gold and copper), rose-gold alloys (gold, copper, and zinc), nichrome (nickel and chromium), and stainless steel (iron, carbon, and additional elements including manganese, nickel, chromium, molybdenum, boron, titanium, silicon, vanadium, tungsten, cobalt, and/or niobium). In some cases, the intermetallic material may include superalloys. The superalloys may be based on elements including iron, nickel, cobalt, chromium, tungsten, molybdenum, tantalum, niobium, titanium, or aluminum.

In some embodiments, the structure and/or the one or more members of the structure may comprise a ceramic material. The ceramic material may comprise a metal (e.g., aluminum, titanium, etc.), a non-metal (e.g., oxygen, nitrogen, etc.), and/or a metalloid (e.g., germanium, silicon, etc.) having atoms primarily held in ionic and/or covalent bonds. Examples of the ceramic materials may include, for example, an aluminide, boride, beryllia, carbide, chromium oxide, hydroxide, sulfide, nitride, mullite, kyanite, ferrite, titania zirconia, yttria, and/or magnesia.

In some embodiments, the structure and/or the one or more members of the structure may comprise a composite material. The composite material may include, for example, a carbon composite material, a fiberglass composite material, a thermoplastic composite material, or any other material that can provide additional structural rigidity to the midsole or the outsole of a shoe.

In some embodiments, the structure and/or the one or more members of the structure may comprise a binding polymer matrix and reinforcing fiber. The binding polymer can include, for example, a thermoset material such as polyester, polyolefin, nylon, or polyurethane. In some cases, the reinforcing fiber may comprise one or more carbon fibers. The carbon fibers may comprise a material such as graphite. Other fibers, such as aramids (e.g., Kevlar™), aluminum, or glass fibers can also be used in addition to or in place of the carbon fibers.

In some embodiments, the structure and/or the one or more members of the structure may comprise a plastic material. The plastic material may include, for example, thermoplastic polyurethane (TPU), polyethylene terephthalate (PET), polypropylene (PP), polycarbonate (PC), polyvinyl chloride (PVC), and the like.

As described elsewhere herein, the structure comprising the one or more members may be integrated with or embedded in a foamed material. The foamed material and the structure embedded in or integrated with the foamed material may collectively form a midsole or an outsole of a golf shoe as presently described.

The structure and the foamed material surrounding or encapsulating the structure may comprise various different materials. In some cases, the structure and the foamed material may have different material properties. In some embodiments, the structure may have a higher melting temperature than the foamed material, which can help to prevent the structure from melting or otherwise deforming when the foamed material is being formed or processed (e.g., physically, chemically, thermally, or optically using one or more electromagnetic waves) in a mold. In some embodiments, the structure may have a greater flexural and/or torsional stiffness or rigidity than the foamed material. In other embodiments, the structure may have a greater compressive strength, tensile strength, or shear strength than the foamed material.

In any of the embodiments described herein, the structure integrated with or embedded in the midsole may have multiple regions with different material properties. The different material properties may include, for example, a hardness, a softness, a stiffness, a rigidity, a tensile strength, or any of the other material properties described elsewhere herein. In some cases, the multiple regions of the internal structure may have a same or similar material composition. In other cases, the multiple regions of the internal structure may have different material compositions.

In some non-limiting embodiments, the structure may comprise a first portion and a second portion. In some cases, the first portion and the second portion may be located in different regions of the midsole. The different regions of the midsole may include, for instance, a forefoot region, a midfoot region, a rearfoot region, a medial side, a lateral side, an anterior end, and/or a posterior end of the midsole. In some cases, the first portion and the second portion may be located in different subregions of the midsole. The different subregions of the midsole may include, for instance, different sections or locations within the various regions (e.g., forefoot, midfoot, rearfoot, lateral, medial, anterior, posterior, etc.) of the midsole. In any of the embodiments described herein, the first portion of the structure and the second portion of the structure may have a different hardness, softness, stiffness, rigidity, and/or tensile strength in order to enhance the overall comfort, fit, and/or performance of the shoes described herein.

In some embodiments, the material properties of various portions of the structure may change or vary depending on the material properties of the respective sections of the midsole in which the structure is embedded or integrated. In some embodiments, a first portion of the structure may be located in a first region of the midsole, and a second portion of the structure may be located in a second region of the midsole. In some embodiments, the first portion of the structure may have a greater hardness, stiffness, rigidity, and/or tensile strength than the second portion of the structure in order to increase or enhance the hardness, stiffness, rigidity, and/or tensile strength of the first region of the midsole relative to the second region of the midsole. In other embodiments, the second portion of the structure may have a greater hardness, stiffness, rigidity, and/or tensile strength than the first portion of the structure in order to increase or enhance the hardness, stiffness, rigidity, and/or tensile strength of the second region of the midsole relative to the first region of the midsole. In any of the embodiments described herein, the material properties of the various portions of the structure may be optimized or adjusted to complement or enhance the material properties of the various regions of the midsole, thereby improving the overall comfort, fit, and/or performance of the shoes described herein.

In some embodiments, the structures described herein may be configured to move (e.g., flex, bend, twist, or otherwise deform along or about one or more axes in three-dimensional space) relative to the midsole or outsole as a subject exerts one or more forces on the midsole or outsole during a golf-related movement. In some cases, the structures may be configured to flex, bend, twist, or otherwise deform in a controlled manner when forces are exerted on the midsole or outsole, in order to provide one or more desired performance characteristics that can aid the subject in performing various golf-related movements.

In some embodiments, the structures may be configured to deform in a controlled manner in order to provide lateral support for a golf-related action. For example, when a subject is walking or running, the structures may be configured to flex to absorb the impact forces exerted on the midsole or outsole. In some cases, a first member of the structure may flex or bend towards a second member of the structure. In other cases, the first member of the structure may flex or bend away from the second member of the structure. In some cases, one or more members of the structure may be configured to flex or bend towards a forefoot, midfoot, and/or rearfoot region of the midsole or outsole. In some cases, one or more members of the structure may be configured to flex or bend towards an upper or lower region of the midsole. In some cases, the one or more members of the structure may be configured to flex or bend towards a lateral and/or medial side of the midsole or outsole. In some cases, the flexing or bending of the structures or the members may provide an elastic spring force that promotes a rolling or a transition of the subject's foot during a walking or running motion. The rolling or transition may occur in a direction between a rearfoot region and a forefoot region of the subject's foot. In some cases, the rolling or transition may occur in a direction between a lateral side and a medial side of the subject's foot.

In some embodiments, the structures disclosed herein may be embedded in or integrated with a midsole or an outsole to enhance a lateral support characteristic of the midsole or the outsole. In some cases, the structure embedded in or integrated with the midsole or outsole may be configured to enhance a lateral support characteristic of the midsole or the outsole. The lateral support characteristic may be associated with a strength of the midsole or the outsole. In some cases, the structure may be configured to provide the midsole or outsole with a compressive strength ranging from about 10 Megapascals (MPa) to about 100 MPa or more. In some cases, the structure may be configured to provide the midsole or outsole with a tensile strength ranging from about 10 Megapascals (MPa) to about 100 MPa or more. In some cases, the structure may be configured to provide the midsole or outsole with a shear strength ranging from about 10 Megapascals (MPa) to about 100 MPa or more.

In some embodiments, the structures may be configured to resist deformation in order to enhance a torsional strength, stiffness, or rigidity of the midsole or outsole. In some cases, the structures may be configured to resist a deformation due to forces exerted on the midsole or outsole. The forces exerted on the midsole or outsole may comprise, for example, lateral or vertical forces and/or torsional or shear forces. Such forces may be exerted on the midsole or outsole during a golf-related action (e.g., a golf swing). In some cases, the forces exerted on the midsole or outsole may be associated with a weight shift or a pivoting of the subject's foot during a backswing or a downswing.

In some embodiments, the structures may be configured to resist a deformation due to compression in one or more directions in three-dimensional space. In some embodiments, the structures may be configured to resist a deformation due to a twisting or a sliding motion along one or more axes in three-dimensional space. In some cases, the structures may be configured to resist deformation in a plurality of directions and/or along one or more axes.

In some cases, the structures may be configured to (i) resist deformation in a first set of directions and/or along a first set of axes and (ii) deform more easily in a second set of directions and/or along a second set of axes (e.g., when a force profile that is exerted on the midsole or outsole changes). In some instances, when a subject is walking on a green or crouching down to line up a shot or, a portion of the structure may be configured to deform or bend in order to allow the subject to comfortably flex various regions of the shoe (e.g., the forefoot and/or midfoot regions of the midsole or outsole) relative to each other. However, when the subject is executing a golf swing and exerting compressive and/or shear stresses on the midsole or outsole, the structures may be configured to resist deformation due to such stresses, thereby stiffening and stabilizing the shoe for maximum performance and control.

In some embodiments, the structures disclosed herein may be embedded in or integrated with a midsole or an outsole to enhance a flexural and/or torsional strength, stiffness, or rigidity of the midsole or the outsole. In some cases, the structure embedded in or integrated with the midsole or outsole may be configured to enhance a flexural and/or torsional strength or rigidity of the midsole or the outsole. In some cases, the midsole or outsole may have a flexural rigidity ranging from about 10 Newton-centimeters (N-cm) to about 100 N-cm or more. In some cases, the midsole or outsole may have a flexural strength ranging from about 100 megapascals (MPa) to about 500 MPa or more. In some cases, the midsole or outsole may have a flexural modulus ranging from about 5,000 MPa to about 10,000 MPa or more. In some cases, the midsole or outsole may have a torsional rigidity ranging from about 10 Newton-centimeters (N-cm) to about 100 N-cm or more. In some cases, the midsole or outsole may have a torsional stiffness ranging from about 10 Newton-centimeters per degree (N-cm/deg) to about 100 N-cm/deg or more. In some cases, the midsole or outsole may have a torsional shear modulus ranging from about 0.1 MPa to about 100 MPa or more.

In some embodiments, the structures may be configured to absorb and distribute forces exerted on the midsole or outsole during a golf-related action or movement in order to stabilize and control a subject's foot while maximizing traction and grip. In some cases, the one or more members of the presently disclosed structures may be configured to distribute forces exerted on the sole assembly or a portion thereof to a plurality of regions of the golf shoe, thereby enhancing a stability and a traction of the golf shoe. The plurality of regions may comprise, for example, a lateral forefoot, midfoot, or rearfoot region of the golf shoe and/or a medial forefoot, midfoot, or rearfoot region of the golf shoe. In some cases, the one or more members may be configured to distribute forces exerted on the sole assembly or a portion thereof to two or more different sides, sections, or quadrants of the golf shoe. In some cases, the one or more members may be configured to selectively distribute the forces exerted on the sole assembly or a portion thereof to one or more traction elements of the golf shoe. The traction elements may be aligned with a vector corresponding to a direction in which a force is distributed or redirected by the members of the structure.

In some embodiments, the structure may be attachable or fixable to a mold corresponding to the midsole or the outsole in order to fix a position and an orientation of the structure within the mold such that the structure is at least partially covered or encapsulated by a molding agent and a foaming agent during a molding process based on the mold. In some cases, the mold may comprise a single 1:1 scale mold that is usable to simultaneously or concurrently (i) form a foamed material of a midsole or outsole and (ii) integrate a structure (e.g., an endoskeleton) in the foamed material.

In some cases, the structure may be configured to interface with a surface feature of the mold. In some cases, the surface feature may comprise (1) a protrusion or a depression disposed on a surface of a cavity of the mold or (2) a sidewall of the mold.

In some cases, the structure itself may comprise a surface feature for interfacing with a mold. In some cases, the surface feature of the structure may comprise (1) a protrusion or a depression disposed on a surface or a portion of the structure or (2) a side or a curvature of one or more members of the structure. In some cases, the structure may comprise a surface feature that is complementary to a corresponding surface feature of the mold. The complementary surface features of the structure and the mold may be configured to fix a position or an orientation of the structure within the mold.

In some embodiments, the sole assembly may comprise one or more negative regions or cavities corresponding to a surface feature (e.g., a guide pin or a positioning pin) of a midsole or outsole mold. The one or more negative regions or cavities may be formed in the sole assembly when a guide pin or positioning pin is used to fix the position and/or orientation of the structure within the mold. In some cases, the one or more negative regions or cavities can be at least partially filled with a filler material after the sole assembly is fabricated or produced. In some cases, the negative regions or cavities can be sized and shaped to enhance a structural or material property of the midsole or the outsole. The structural or material property may comprise, for example, stiffness, strength, rigidity, flex, and/or level of support or cushioning.

In some embodiments, if a guide pin or positioning pin is used to fix the position or orientation of the structure in the mold, the manufacturing process for the sole assembly may involve removing or repositioning the guide pin or positioning pin after the structure is initially fixed in place. In such cases, the sole assembly may be formed with the structure integrated or embedded therein, and without any negative regions or cavities in the midsole or outsole layer of the sole assembly.

In some embodiments, the structure to be embedded in the sole assembly may be affixed to the midsole or outsole mold (e.g., the sidewalls of the mold) using a snap fit or a form fit configuration. In such cases, the sole assembly may not or need not comprise one or more negative regions or cavities corresponding to a complementary protrusion provided on a surface of the mold.

In another aspect, the present disclosure provides a mold for fabricating a golf shoe comprising a sole assembly with a structure embedded in or integrated with a midsole or outsole portion of the sole assembly.

In some embodiments, the mold may comprise one or more surface features configured to (i) interface with an insert for a midsole or an outsole of a shoe and (ii) secure the insert in a predetermined position and orientation in the mold to enhance a structural or material property of the midsole or the outsole. The structural or material property may comprise, for example, a stiffness, a strength, or a rigidity of the midsole or outsole. In some cases, the structural or material property may comprise a level of support or cushioning provided by the midsole or outsole. In some embodiments, the mold may further comprise a cavity for receiving a molding agent and a foaming agent to directly produce the midsole or the outsole with the insert embedded therein.

In some embodiments, the mold may comprise one or more surface features. In some cases, the one or more surface features may be configured to fix the position and the orientation of the insert to facilitate a flow of the molding agent and the foaming agent around at least a portion of the insert during a molding process based on the mold. In some embodiments, the one or more surface features may comprise, for example, a depression (e.g., a cavity, an aperture, a hole, a groove, etc.). In other embodiments, the one or more surface feature may comprise a protrusion (e.g., a bump, a raised feature, etc.). In some cases, the one or more surface features may comprise one or more positioning or guide pins disposed on a portion of the mold (e.g., a surface of a cavity of the mold). In other cases, the one or more surface features may comprise one or more sidewalls of the mold.

In some embodiments, the mold may comprise a cavity for receiving a molding agent and a foaming agent to directly produce the midsole or the outsole with the insert embedded therein. In some cases, the cavity may comprise a flow path for the molding agent and foaming agent. In some cases, the one or more surface features described above may be configured to position and/or orient the insert along the flow path so that the molding agent and/or the foaming agent can at least partially cover or encapsulate the insert (e.g., during a molding process).

In another aspect, the present disclosure provides a method for manufacturing a golf shoe comprising a structure embedded within a sole assembly of the golf shoe. The structure may be embedded within the sole assembly of the golf shoe during a manufacturing process for a midsole and/or an outsole of the golf shoe.

The presently disclosed methods may be used to encapsulate (in a midsole and/or outsole) complex three-dimensional (3D) structures that would not otherwise be insertable or embeddable in a sole assembly using traditional molding methods and/or traditional manufacturing assembly methods. Examples of such 3D structures can include, for example, lattice structures as described in detail above. In some cases, the presently disclosed methods may also be used to encapsulate additively manufactured parts (e.g., 3D printed parts) during a molding and foaming process. In other cases, the methods of the present disclosure may be used to encapsulate machined parts (or any other parts formed using a subtractive manufacturing process). In some cases, the presently disclosed methods may be used to encapsulate thermoplastic polyurethane (TPU) parts and/or composite parts with various complex shapes, such as those described and referenced elsewhere herein. In some cases, the TPU parts may include, for example, injected TPU plastic parts, molded TPU plastic parts, extruded TPU plastic parts, machined TPU plastic parts, and/or 3D printed TPU plastic parts. In some cases, the composite parts may include, for example, injected composite parts, molded composite parts, extruded composite parts, machined composite parts, and/or 3D printed composite parts.

Traditionally, in order to have a structure embedded inside a midsole or outsole, the various different components, parts, sections, or layers of the midsole or outsole would need to be molded separately. The various different components, parts, sections, or layers of the midsole or outsole may include, for example, a top portion or layer of the midsole or outsole, a bottom portion or layer of the midsole or outsole, and/or an insert or endoskeleton that is embedded in or integrated with the midsole or outsole. In many cases, each discrete component, part, section, or layer of the midsole or outsole may require a specific set of tooling, which can be cumbersome and costly to design, implement, and manage. Further, after molding the various components or parts, the individual components and parts of the midsole or outsole would need to be assembled, which can involve additional manufacturing steps that are costly and time intensive and/or labor intensive.

The present disclosure provides a streamlined and efficient method for directly producing a midsole or outsole comprising a structure embedded therein. In some cases, the midsole or outsole comprising the structure embedded therein can be manufactured in a single molding step and/or using a single mold. The presently disclosed methods for directly producing midsoles or outsoles with embedded structures can be implemented to increase manufacturing capacities of factories and production lines, and facilitate the rapid and efficient production of shoes to meet or exceed product demand and/or production targets within shortened time frames.

In another aspect, the present disclosure provides a method for manufacturing a golf shoe having a structure embedded in the midsole or outsole of the golf shoe. The method may comprise placing the structure in a cavity region of a midsole or outsole mold and initiating a foaming process. The foaming process may involve flowing a molding agent and/or a foaming agent around at least a portion of the structure. The foaming agent may interact with the molding agent to form at least a portion of the midsole or outsole of the golf shoe. The portion of the midsole or outsole of the golf shoe that is formed using the molding agent and/or the foaming agent may at least partially encapsulate or cover the structure placed in the cavity region of the midsole or outsole mold prior to the foaming process. In some cases, the portion of the midsole or outsole of the golf shoe formed using the molding agent and/or the foaming agent may fully encapsulate or cover the structure. In such cases, the structure may be fully embedded or integrated within the foamed material that is formed during the foaming process.

The methods of the present disclosure address several disadvantages associated with conventional golf shoe fabrication methods, which utilize traditional molds (e.g., for EVA foams) that are designed at a smaller size to account for the expansion rate of the foamed material during the foaming process. Unlike other conventional methods (which require waiting for the EVA to fully expand before integrating an insert with the EVA material, making it infeasible or impractical to insert a 1:1 scale insert in a smaller size mold), the methods of the present disclosure leverage the capabilities of 1:1 scale molding to enable a manufacturing process in which a true to size structure can be placed in a 1:1 scale midsole or outsole mold to directly produce a golf shoe with a midsole or outsole having the structure integrated therein. The midsole or outsole having the structure integrated therein may be produced in a single molding process. As described elsewhere herein, the molding process may involve flowing a molding agent and/or a foaming agent around at least a portion of the structure to at least partially cover or encapsulate the structure. The presently disclosed methods for manufacturing golf shoes may be implemented to fabricate insert designs that are not achievable with traditional EVA foaming processes (including the insert designs presently disclosed). The presently disclosed methods for manufacturing golf shoes may also enable cost-effective manufacturing and minimize tooling expenses compared to traditional stock fit assembly methods, since the present methods can be used to produce a final part (e.g., a midsole or outsole with a structure integrated therein) directly from a single mold, without any post molding manufacturing operation to stock fit the parts together.

In another aspect, the present disclosure provides a method for manufacturing a golf shoe. The method may comprise providing a 1:1 scale mold. As used herein, a 1:1 scale mold may comprise a mold that is configured to produce a foamed material corresponding in size and shape to a cavity of the mold. The size and shape of the mold cavity may correspond to the final size and shape of the foamed material. In some cases, shape of the foamed material and the shape of the mold cavity may comprise similar shapes. In some cases, a difference or variation in a corresponding dimension of the foamed material and a corresponding dimension of the mold cavity may be within about 10% or less.

In some embodiments, the method may further comprise providing a structure (e.g., an insert or an endoskeleton) in a midsole or outsole mold. In some cases, the structure may be fixed or secured at a predetermined distance from a surface of the mold cavity so that the structure "floats" inside the mold. In some cases, the structure may be fixed or coupled to the mold using positioning pins. The positioning pins may be disposed on the structure itself. Alternatively, the positioning pins may be disposed on a surface of the mold. In some cases, the structure may be fixed or coupled to one or more features of the mold. The one or more features may include, for example, a sidewall of the mold (or any other structural component or feature of the mold or mold cavity).

In some embodiments, the method may involve providing a molding agent and/or a foaming agent to the mold. The method may involve providing the molding agent and/or the foaming agent according to one or more parameters. The molding agent and/or the foaming agent may flow around and encapsulate the structure to form a foamed material surrounding the structure.

In some embodiments, the method may comprise controlling an operation of a molding machine or a molding system to create a molded midsole or outsole having an internal structure embedded therein. The operation of the molding machine or molding system may be controlled by adjusting the one or more parameters referenced above. In some non-limiting embodiments, the one or more parameters may comprise various molding parameters that can be adjusted to control a molding processing. The molding parameters may include, for example, a flow rate of the molding agent or the foaming agent, a flow direction of the molding agent or the foaming agent relative to the internal structure, or a flow pattern of the molding agent or foaming agent throughout the mold cavity. In any of the embodiments described herein, the various molding parameters may be controlled using a processing unit (e.g., a computer, a processor, a logic circuit, etc.). The processing unit may be configured to control or adjust an operation of the molding machine or molding system based on the one or more molding parameters. In some cases, the one or more molding parameters may be set by an operator of the molding machine or molding system. In other cases, the one or more molding parameters may be set by an algorithm or an artificial intelligence or machine learning based system.

In some embodiments, one or more nozzles may be used to provide the molding agent and/or the foaming agent. In some embodiments, the one or more nozzles providing the molding agent and/or the foaming agent may be configured to spray or inject the molding agent and/or the foaming agent into one or more target regions in a cavity of the mold. In other embodiments, the one or more nozzles providing the molding agent and/or the foaming agent may be configured to pour the molding agent and/or the foaming agent into one or more target regions in a cavity of the mold (e.g., in cases where the midsole is created using a polymeric material such as polyurethane, which can be flowed into the mold cavity). In any of the embodiments described herein, the position and/or the orientation of the nozzles may be controlled or modulated using a drive unit (e.g., a motor) and/or based on one or more inputs from an operator controlling the operation of the one or more nozzles or any other computer or machinery operatively coupled to the one or more nozzles.

In some embodiments, the method may involve molding the midsole or outsole from the foamed material and the structure provided within the mold used to shape the foamed material for the midsole or outsole. The molding may comprise, for example, injection molding or compression molding. In some cases, the molding may involve concurrently (i) forming the foamed material in the shape of a midsole or outsole and (ii) integrating or embedding the structure in the foamed material.

In some embodiments, the molding agent and/or the foaming agent may be provided to the mold by way of a single shot operation (e.g., a single shot injection) or a multi-shot operation (e.g., a multi shot injection). In some embodiments, the molding agent and/or the foaming agent may be poured or flowed into the mold. In some embodiments, the molding agent and/or the foaming agent may be injected into a single location or region in the mold. In other embodiments, the molding agent and/or the foaming agent may be injected into multiple locations or regions in the mold. In some cases, the molding agent and/or the foaming agent may be injected into the multiple locations or regions in the mold simultaneously or concurrently. In other cases, the molding agent and/or the foaming agent may be injected into multiple locations or regions in the mold in series or in succession.

In any of the embodiments described herein, the sole material formed using the molding agent and/or the foaming agent may have a plurality of regions with different material properties. In some embodiments, the different material properties may include, for example, a hardness, a softness, a stiffness (e.g., flexural stiffness or torsional stiffness), a rigidity, a tensile strength, or any of the other material properties described herein. In some non-limiting embodiments, a forefoot region of the sole material may have a greater hardness, stiffness, or tensile strength than a midfoot region and/or a rearfoot region of the sole material. In some non-limiting embodiments, a hardness, stiffness, or tensile strength of the sole material may gradually change or vary across a dimension of the sole material. The dimension of the sole material may include, for example, a length, a width, and/or a depth of the sole material.

In another aspect, the present disclosure provides a method for manufacturing a sole assembly with an internal structure. The method may comprise providing a mold for producing a midsole or an outsole of the sole assembly. The mold may comprise any of the characteristics or features described herein with respect to molds. Alternatively, or in addition, the mold may have any characteristics or properties relating to any features (e.g., surface features) or components of the molds presently described in this disclosure.

In some embodiments, the method may further comprise securing the internal structure to the mold or a surface feature of the mold. The internal structure may be secured to the mold using various surface features (e.g., guide pins, positioning pins, protrusions, depressions, etc.) or by way of a snap fit or form fit attachment. The securing of the internal structure to the mold may involve fixing the position and orientation of the internal structure to facilitate the embedding or encapsulation of the internal structure within a foamed material.

In some embodiments, the method may further comprise providing a composition comprising a molding agent and a foaming agent to the mold to produce the midsole or outsole with the internal structure at least partially embedded therein. In some cases, the midsole or outsole with the internal structure at least partially embedded therein may be produced or fabricated in a single manufacturing step. The single manufacturing step may comprise a manufacturing step that can be performed using a single mold. The single mold may comprise, for example, a 1:1 scale mold as described elsewhere herein.

In some cases, providing the composition comprising the molding agent and the foaming agent to the mold may involve flowing the composition around the internal structure to surround or encapsulate the internal structure. Flowing the composition around the internal structure may involve flowing the composition towards one or more sides or surfaces of the internal structure. The angle at which various particles of the composition impinge or impact the side(s) or surface(s) of the internal structure may range from 0 degrees to about 90 degrees or more.

In some cases, flowing the composition around the internal structure may involve flowing the composition towards a plurality of sides or surfaces of the internal structure simultaneously. In some cases, the composition may be flowed towards (i) a first side or surface at a first angle and (ii) a second side or surface at a second angle. In some cases, the first side or surface and the second side or surface may be adjacent to one another. In other cases, the first side or surface and the second side or surface may be located apart or remote from each other. In some cases, the first angle may be the same as the second angle. In other cases, the first angle and the second angle may be different.

In some cases, flowing the composition around the internal structure may involve flowing the composition towards a plurality of sides or surfaces of the internal structure sequentially. In some cases, the composition may be flowed towards (i) a first side or surface at a first time instance and (ii) a second side or surface at a second time instance. In some cases, the first side or surface and the second side or surface may be adjacent to one another. In other cases, the first side or surface and the second side or surface may be located apart or remote from each other.

In any of the embodiments described herein, surrounding or encapsulating the internal structure with the composition comprising the molding agent and the foaming agent may result in a foaming process that occurs around the internal structure and within the mold for the midsole or the outsole. The foaming process may produce a foamed material from the molding agent. The foamed material may form at least a portion of the midsole or outsole. The portion of the midsole or outsole that is formed from the foamed material may comprise a size and a shape that is complementary to a size and a shape of any of the internal structures described herein. The portion of the midsole or outsole that is formed from the foamed material may surround or encapsulate the internal structures of the present disclosure, either partially or entirely.

In some cases, the foaming process may produce the foamed material from the molding agent. In some cases, the foaming agent may interact (physically and/or chemically) with the molding agent to produce a foamed material comprising one or more cells or cell structures. In some cases, the mold used to receive the composition comprising the molding agent and the foaming agent may be configured to release or vent any pressure buildup that may occur as a result of the foaming process, to ensure that the size and shape of the resulting foamed material corresponds to the size and shape of the mold or mold cavity.

In any of the embodiments described herein, producing the midsole or the outsole may not or need not involve expanding the composition or the molding agent in the mold. As described above, the mold may be configured to release or vent pressure buildup during the foaming process to ensure that the size and shape of the resulting foamed material corresponds to the size and shape of the mold or mold cavity. Utilizing the molds having the features described herein may allow manufacturers to utilize true to size inserts during a 1:1 scale molding operation, which can greatly simplify and accelerate the process of creating a midsole having a structure embedded therein. In any of the embodiments described herein, the midsole or outsole having the embedded or integrated internal structure can be produced using a single mold, and without any post molding manufacturing operation to embed or integrate the internal structure with the midsole or the outsole.

In another aspect, the present disclosure provides a method for constructing the golf shoes of the present disclosure. In some embodiments, the method may comprise constructing an upper. In some cases, the upper may comprise an insole or an insole component as described elsewhere herein. In some cases, various parts or components may be stitched, glued, or otherwise attached together to form the upper. In some embodiments, a footbed of the upper may be positioned above an insole board of the upper. In some embodiments, the insole board may be positioned between the footbed and the midsole of the shoe. In some embodiments, the upper may be connected or fused to the midsole using a cement assembly process.

In some embodiments, the method may comprise constructing a sole assembly. In some cases, the sole assembly may comprise a midsole and/or an outsole. In some cases, at least one of the midsole or the outsole may comprise an internal structure that is integrated with or embedded in the midsole or outsole. The internal structure may be integrated with or embedded in the midsole or the outsole by (1) placing the internal structure in a cavity of a mold corresponding to the midsole or the outsole and (2) flowing a molding agent and a foaming agent around the internal structure to encapsulate the internal structure in a foamed material that is produced from an interaction between the molding agent and the foaming agent. In some cases, the interaction may comprise a foaming process that produces one or more cells or cell structures that impart various favorable properties to the foamed material (e.g., to enhance stability or traction for golf-related actions or movements). In some embodiments, the method may involve venting or releasing a pressure build up that occurs during the foaming process, to ensure that (i) the resulting foamed material corresponds to a size and a shape of the mold, and (ii) the internal structure placed in the mold is properly sized for the foamed midsole or outsole that is produced in the mold.

In some embodiments, at least a portion of the sole assembly may comprise two or more distinct parts that are formed and integrated together in a single molding step. The two or more distinct parts may include, for example, a foamed material forming a portion of the midsole, a foamed material forming a portion of the outsole, and/or the internal structure to be embedded in the foamed material forming a portion of the midsole or the outsole. In some cases, the two or more distinct parts may comprise parts that have different material properties. In some cases, the two or more distinct parts may comprise parts that are made of different materials and/or made at different times or using different processes. In any of the embodiments described herein, the internal structure may be fabricated first before being placed in a mold corresponding to the midsole or the outsole in order to produce the midsole or the outsole with the internal structure integrated or embedded therein. In any of the embodiments described herein, the integration or embedding of the internal structure in the midsole or the outsole may occur in a single molding step in which the foamed material of the midsole or the outsole is also created concurrently or in parallel.

In some embodiments, constructing the shoe may comprise attaching the insole footbed or the insole board to the midsole or the upper. In some embodiments, the insole board may be bonded to the top surface of the midsole. In some cases, portions of the insole (e.g., a lasting board or an insole board) may be attached or otherwise fixed or coupled to a portion of the upper using a lasting process (e.g., a single lasting process or a double lasting process), a Strobel construction method, and/or a gasket hotmelt.

In some embodiments, the method may comprise assembling an outsole to the midsole. In some cases, at least a portion or a section of the bottom surface of the midsole may be bonded to a top surface of the outsole (e.g., using adhesives, glues, cements, fasteners, or any other attachment mechanisms or techniques).

In some embodiments, the method may comprise attaching the sole assembly to the upper. In some cases, prior to attachment to the sole assembly, the upper may be pulled onto a last, and a lasting board may be attached to the upper with an adhesive. The lasting board may then be attached to the sole assembly (e.g., with an adhesive, glue, or cement) to form the golf shoe.

In some alternative embodiments, the method may comprise attaching a material onto an open bottom of the upper, effectively closing off the open bottom of the upper to create a sock-like construction. In some embodiments, the method may further comprise attaching a portion of the upper (e.g., the insole footbed or the insole board) to a portion or a component of the sole assembly (e.g., the midsole and/or the outsole) to form the golf shoe.

In any of the embodiments described herein, the resulting sole assembly may provide an optimal combination of support, structural rigidity, stability, and flex characteristics. For example, a shoe with a sole assembly comprising the internal structures described herein may be able to provide the golfer with a comfortable and stable platform that structurally supports the golfer's feet during a golf-related action or movement while retaining an optimal or desired stiffness and flex characteristic.

Figure 9A:
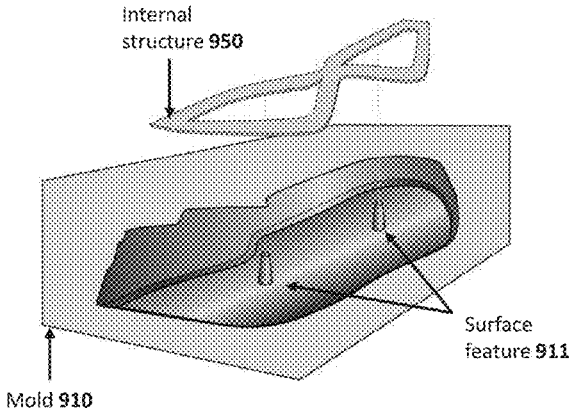
FIGS. 9A-9C depict an exemplary method for fabricating a sole assembly with a midsole or outsole having a structure that is embedded in or integrated with the midsole or outsole, in accordance with some embodiments.
Figure 9B:
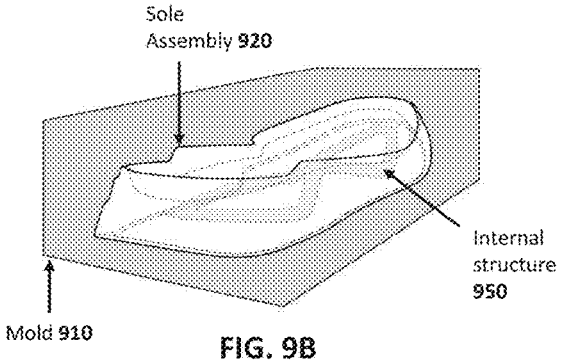
Figure 9C:
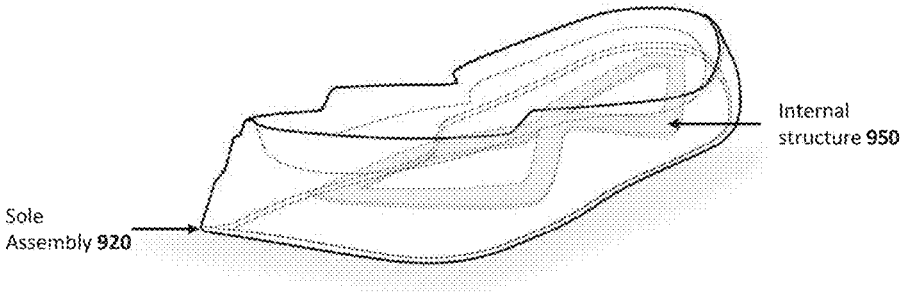

FIGS. 9A, 9B, and 9C illustrate an exemplary method for fabricating a sole assembly with a structure integrated with or embedded in a midsole or an outsole of the sole assembly. As shown in FIG. 9A, an internal structure 950 to be embedded in or integrated with a midsole or outsole may be initially placed in a mold 910 for forming the midsole or outsole. In some non-limiting embodiments, the mold 910 may comprise one or more surface features 911 configured to fix the position and/or orientation of the internal structure 950 relative to the mold 910. In some cases, the one or more surface features 911 may comprise guide pins or positioning pins as described elsewhere herein.

Referring to FIGS. 9B and 9C, once the internal structure 950 is placed in the midsole or outsole mold 910, a molding agent and/or a foaming agent may be flowed around the internal structure 950 to directly form a sole assembly 920 comprising an integrated or embedded internal structure 950. The sole assembly 920 may comprise a midsole or an outsole as described elsewhere herein. In some embodiments, the internal structure 950 may be integrated with or embedded in the midsole or outsole as the midsole or outsole is being created or formed around the internal structure 950. The exemplary method shown in FIGS. 9A-9C may be used to directly fabricate a midsole or outsole having an integrated or embedded internal structure or endoskeleton, using a single molding process and/or a single midsole or outsole mold.

Carbon Plate

In another aspect, the present disclosure provides various examples and embodiments of high performance golf shoes having a plate that can be integrated with a sole assembly of the golf shoes. In some cases, the plate may be a composite plate comprising one or more composite materials. In some cases, the plate may comprise a carbon plate.

In some embodiments, the plate may be positioned between the midsole and the outsole of the golf shoe. In some cases, a first side of the plate can be affixed to the bottom surface of the midsole, and a second side of the plate can be affixed to a portion of the outsole. The first side of the plate can be affixed to the bottom surface by way of a molding process (as described in greater detail elsewhere herein) or by using an adhesive. In some cases, the second side of the plate can be affixed to the outsole using any of the molding processes described herein, or by using an adhesive.

In some embodiments, the plate may have a structure that is concave downwards, i.e., the bottom surface or profile of the plate may be configured to curve upwards from the ends of the plate (and away from the ground surface) towards one or more local maxima at or near a central region of the plate. The central region may be further from the ground surface than the ends of the plate. In some embodiments, the curvature and concave structure of the plate may be configured to impart a spring effect or provide an elastic response when one or more loads are exerted on the structure (e.g., during a golf-related action or movement).

Figure 10:
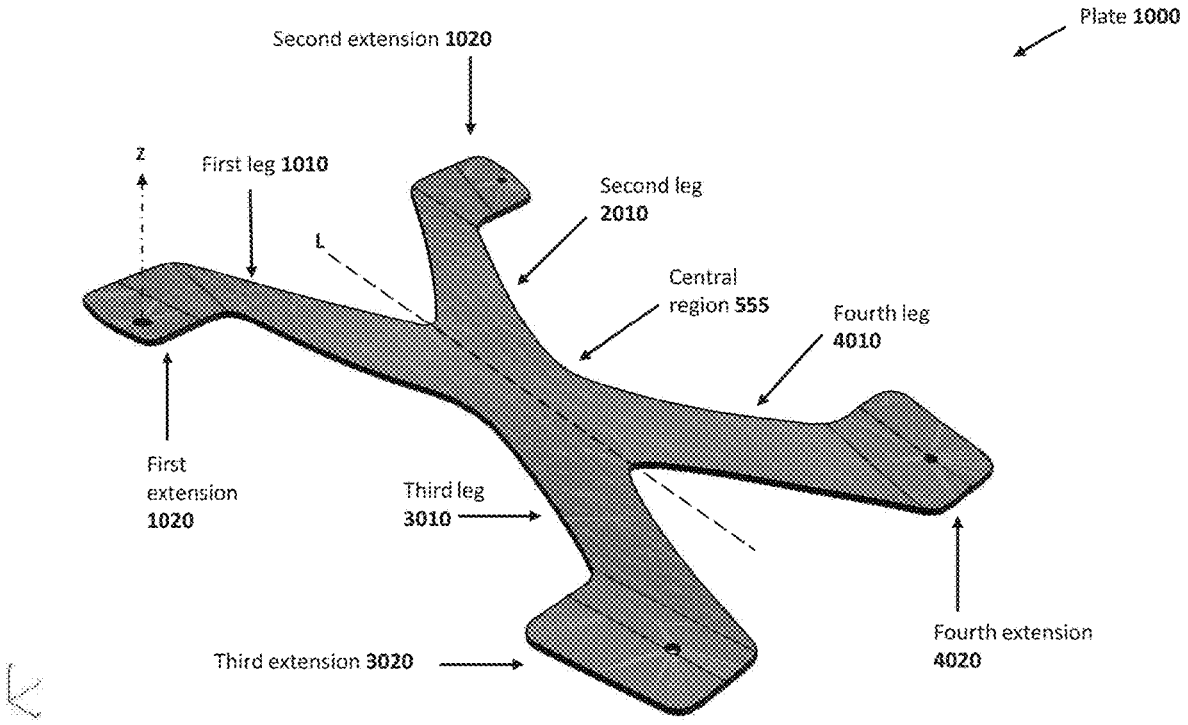
FIG. 10 depicts an example of a plate that can be integrated with a sole assembly of a high performance golf shoe, in accordance with some embodiments.

FIG. 10 illustrates a bottom surface of an exemplary plate 1000 that can be integrated with a sole assembly of a high performance golf shoe. The bottom surface may correspond to a surface of the plate 1000 that is configured or oriented to face a ground surface underneath the shoe. In some cases, the bottom surface may correspond to a surface of the plate 1000 that is visible when viewing the bottom of the shoe.

In some cases, the plate 1000 may include a first leg 1010, a second leg 2010, a third leg 3010, and a fourth leg 4010. The first, second, third, and fourth legs 1010, 2010, 3010, 4010 may extend outwards from a central region 555 of the plate in different directions and/or to different regions or quadrants of the shoe. In some cases, the first, second, third, and fourth legs 1010, 2010, 3010, 4010 may collectively form an X-shaped member that is configured to provide additional support and torsional stiffness across different regions or quadrants of the shoe.

In some embodiments, the first leg 1010 and the second leg 2010 may be configured to extend towards a forefoot region of the sole assembly. In other embodiments, the first leg 1010 and the second leg 2010 may be configured to extend towards a rearfoot region of the sole assembly.

In some embodiments, the third leg 3010 and the fourth leg 4010 may be configured to extend towards a rearfoot region of the sole assembly. In other embodiments, the third leg 3010 and the fourth leg 4010 may be configured to extend towards a forefoot region of the sole assembly.

In some embodiments, the first, second, third, and fourth legs 1010, 2010, 3010, 4010 may have sloped surfaces that converge at or near the central region 555 of the plate. In some cases, the sloped surfaces may include single curved surfaces (i.e., surfaces with a curvature about one point, line, or plane in three-dimensional space) or multi-curved surfaces (i.e., surfaces with two or more curvatures about two or more points, lines, or planes in three-dimensional space). In some cases, the multi-curved sloped surfaces may include a synclastic surface (i.e., a surface in which the centers of curvature are on the same side of the surface). In some cases, the synclastic surface may resemble or correspond to the shape, contour, or topology of a dome (or any portion thereof). In other cases, the multi-curved sloped surfaces may include an anticlastic surface (i.e., a surface in which the centers of curvature are located on opposing sides of the surface). In some cases, the anticlastic surface may resemble or correspond to the shape, contour, or topology of a saddle or a hyperbolic paraboloid.

In some embodiments, the first and second legs 1010, 2010 may converge at a first convergence point, and the third and fourth legs 3010, 4010 may converge at a second convergence point. In some cases, the first and second convergence points may have different heights. In some cases, the first convergence point may correspond to a local maximum, and the second convergence point may correspond to a local minimum. In other cases, the second convergence point may correspond to a local maximum, and the first convergence point may correspond to a local minimum.

Extensions

In some embodiments, the first leg 1010 may include a first extension 1020 provided on a distal end of the first leg 1010. In some cases, the first extension 1020 may have a flat or substantially flat support surface. In some cases, the flat or substantially flat support surface may include one or more surface regions that are generally oriented in the Z-direction. In some cases, the flat or substantially flat support surface may be configured to directly face and/or directly contact the ground surface or the traction elements directly adjacent to the ground surface. In some cases, the first extension 1020 may be configured to curve outwards towards a lateral side or a medial side of the sole assembly to provide additional lateral stability.

In some embodiments, the first, second, third, and fourth legs 1010, 2010, 3010, 4010 of the plate 1000 may include respective first, second, third, and fourth extensions 1020, 2020, 3020, 4020. The first, second, third, and fourth extensions 1020, 2020, 3020, 4020 may have a flat or substantially flat support surface. In some cases, the flat or substantially flat support surfaces may be configured to curve outwards towards a lateral side or a medial side of the sole assembly.

In some embodiments, the flat or substantially flat support surfaces of the legs may be fixed relative to the midsole and/or outsole. In other embodiments, one or more of the flat or substantially flat support surfaces of the legs may not or need not be fixed relative to the midsole and/or outsole. For example, in some cases, the one or more of the flat or substantially flat support surfaces of the legs may be configured to translate and/or rotate relative to other components of the shoe (e.g., in response to one or more loads exerted on the shoe during a golf-related action or movement).

In some cases, the flat or substantially flat support surfaces at the ends of each respective leg may be configured to extend towards a perimeter or edge portion of the outsole to provide additional structural stability. In some cases, the flat or substantially flat support surfaces may directly contact one or more traction elements positioned along or within the perimeter or edge portion of the outsole. In some cases, the flat or substantially flat support surfaces may extend directly over or above one or more traction elements positioned along or within the perimeter or edge portion of the outsole. In some cases, the flat or substantially flat support surfaces may be configured to extend directly between (i) one or more traction elements positioned along or within the perimeter or edge portion of the outsole and (ii) a bottom surface of the midsole. In some cases, a first side of the flat or substantially flat support surfaces may be directly affixed to the midsole of the sole assembly, and a second side may be affixed to the one or more traction elements positioned along or within the perimeter or edge portion of the outsole.

In some cases, a portion of the flat or substantially flat support surfaces may be covered by one or more traction elements extending around a perimeter or edge portion of the outsole (e.g., when viewing the bottom surface of the outsole). In other cases, the flat or substantially flat support surfaces may not or need not be covered by one or more traction elements extending around a perimeter or edge portion of the outsole (e.g., when viewing the bottom surface of the outsole).

In some cases, the one or more traction elements extending around the perimeter or edge portion of the outsole may not or need not cover the legs or the central region of the plate. In other cases, the one or more traction elements extending around the perimeter or edge portion of the outsole may cover a portion of the legs and/or the central region of the plate.

Sloped Surface

In some cases, the first leg 1010 may have a sloped surface extending between the first extension 1020 and the central region 555 of the plate. In some cases, the sloped surface may have a curvature and/or an orientation that varies along a length of the first leg 1010. In some cases, the sloped surface may have a concave and/or convex curvature with an orientation that varies along a length of the first leg 1010. In some cases, the sloped surface may have a combination of concave and convex curvatures along the length of the first leg 1010.

In some cases, the sloped surface may include a sloped bottom surface of the plate (i.e., a sloped surface of the plate that is oriented towards the ground surface under the shoe). The sloped bottom surface may be at least partially visible when viewing the bottom of the shoe. Exemplary views of the sloped bottom surfaces of the plate legs can be seen in at least FIGS. 10-19.

In some cases, the sloped surface may include a sloped top surface of the plate (i.e., a sloped surface of the plate that is oriented towards the midsole or upper of the shoe). In some cases, the sloped top surface may not be immediately visible when looking at the assembled shoe since the sloped top surface is directly coupled to the bottom surface of the midsole. Exemplary views of the sloped top surfaces of the plate legs can be seen in at least FIGS. 22-24.

In some embodiments, the second, third, and fourth legs 2010, 3010, 4010 of the plate 1000 may include corresponding sloped surfaces extending between the respective extensions 2020, 3020, 4020 and the central region 555 of the plate. The sloped surfaces may include sloped bottom surfaces and/or sloped top surfaces. The sloped bottom surfaces may correspond to one or more surfaces that are oriented towards the ground surface. The sloped top surfaces may correspond to one or more surfaces that are oriented towards the midsole or upper of the shoe.

In some cases, the sloped surfaces of the second, third, and fourth legs 2010, 3010, 4010 may have one or more concave and/or convex curvatures with orientations or curvatures that vary along the lengths of the legs. In some cases, the sloped surfaces of the first, second, third, and fourth legs 1010, 2010, 3010, 4010 may gradually level off or return to a pre-determined reference orientation R as the surfaces converge at or near the central region 555 (e.g., as shown in FIGS. 13 and 14).

In some non-limiting embodiments, the pre-determined reference orientation R may correspond to a surface orientation that is generally aligned in the positive or negative Z-direction. In some cases, one or more select surfaces in or near the central region 555 may be oriented such that a vector perpendicular to at least one point in the select surface region extends in the Z-direction. In some cases, the central region 555 may include one or more surface regions that are generally oriented in the Z-direction. In some cases, the one or more surface regions of the central region 555 may not or need not be oriented, skewed, or otherwise positionally biased towards the front, back, or side portions of the sole assembly. In other non-limiting embodiments, the pre-determined reference orientation R may correspond to a surface orientation that deviates from the positive or negative Z-direction by a pre-determined amount. In some cases, the pre-determined amount may range from about 1 degree to at most about 30 degrees in any direction in three-dimensional space.

Figure 11:
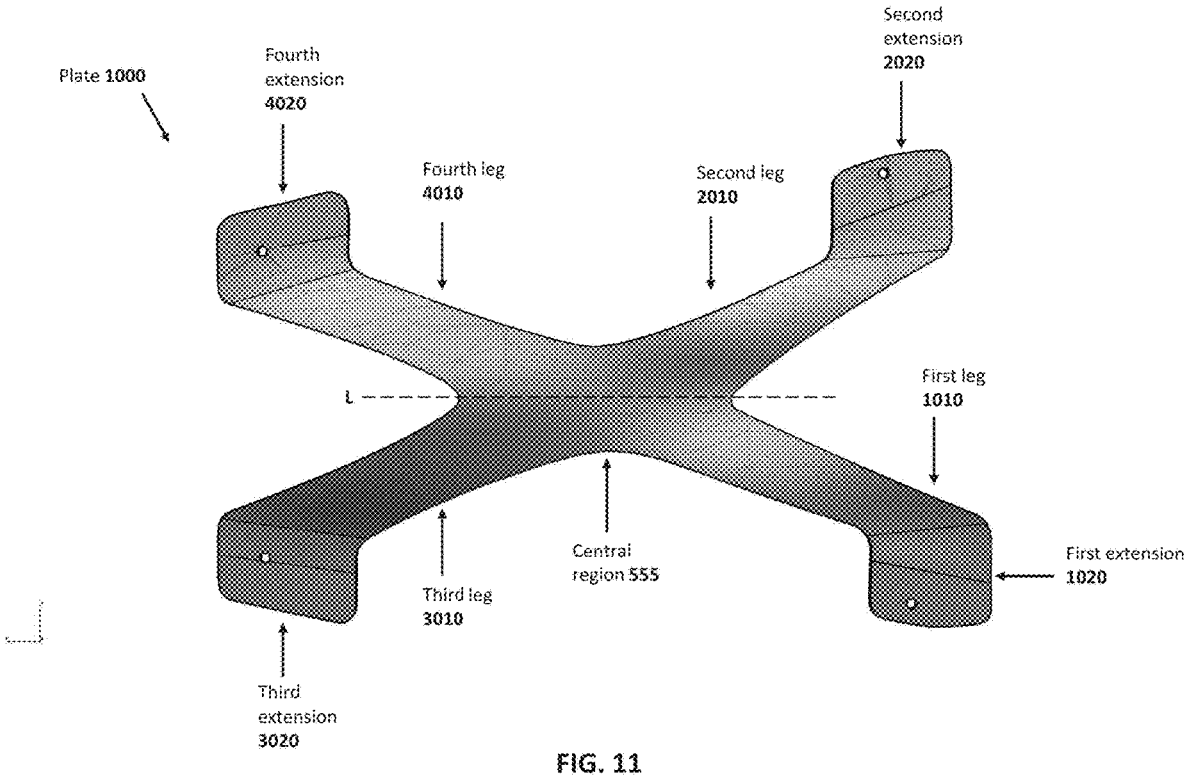
FIG. 11 depicts a top view of a plate that can be integrated with a sole assembly of a high performance golf shoe, in accordance with some embodiments.
Figure 12:
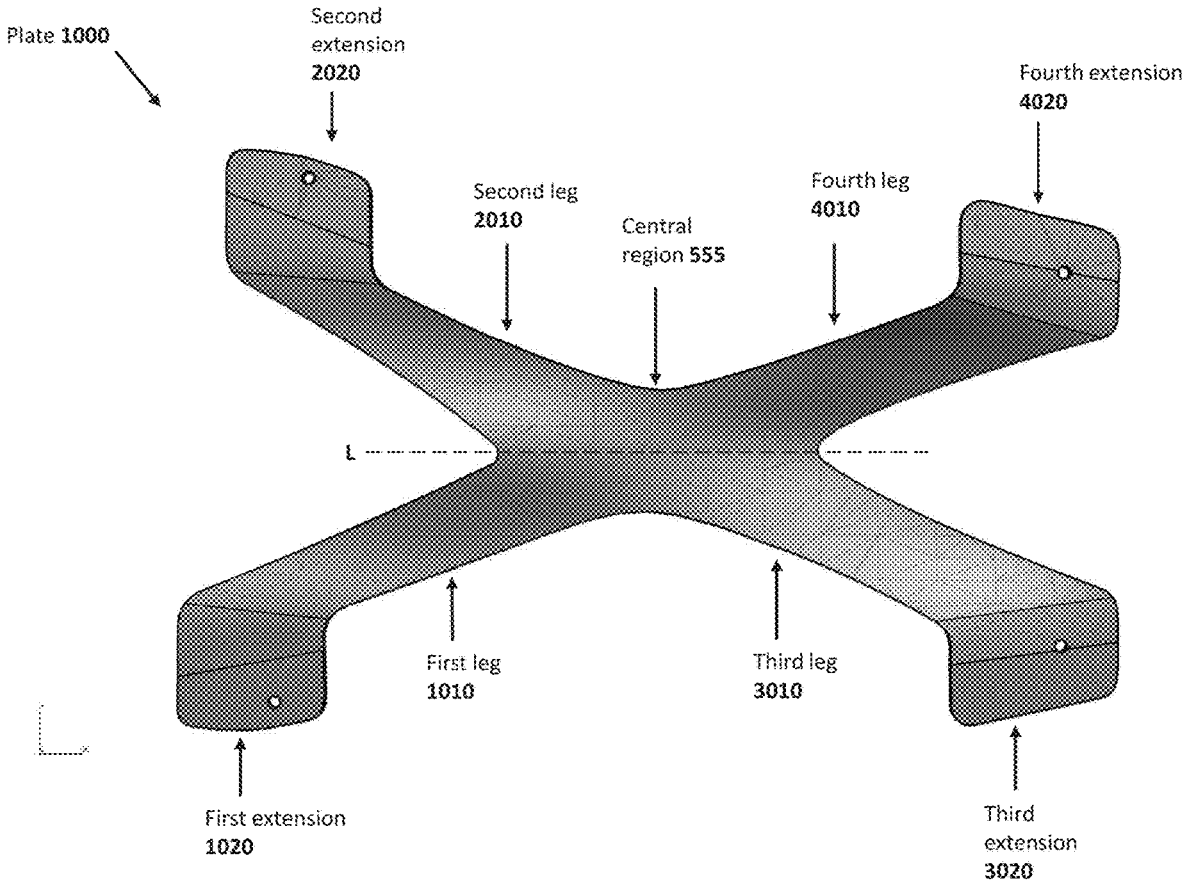
FIG. 12 depicts a bottom view of a plate that can be integrated with a sole assembly of a high performance golf shoe, in accordance with some embodiments.

FIG. 11 and FIG. 12 depict a top view and a bottom view of a plate 1000 that can be integrated with a sole assembly of a high performance golf shoe. The plate 1000 may include a plurality of legs 1010, 2010, 3010, 4010 extending outwards from a central region 555 of the plate 1000. In some cases, the first leg 1010 and the second leg 2010 may diverge at an angle ranging from about 10 degrees to about 135 degrees. In some cases, the third leg 3010 and the fourth leg 4010 may diverge at an angle ranging from about 10 degrees to about 135 degrees. In some cases, the first leg 1010 and the third leg 3010 may diverge at an angle ranging from about 45 degrees to about 170 degrees. In some cases, the second leg 2010 and the fourth leg 4010 may diverge at an angle ranging from about 45 degrees to about 170 degrees.

Figure 13:
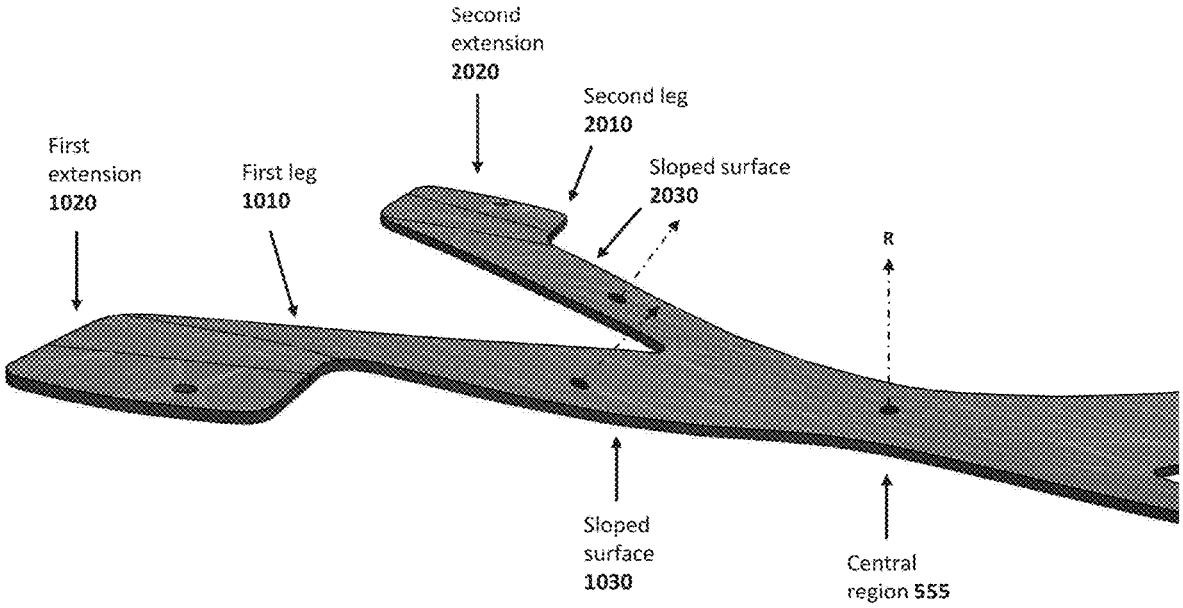
FIG. 13 depicts a perspective view of a first leg of a plate that can be integrated with a sole assembly of a high performance golf shoe, in accordance with some embodiments.
Figure 14:
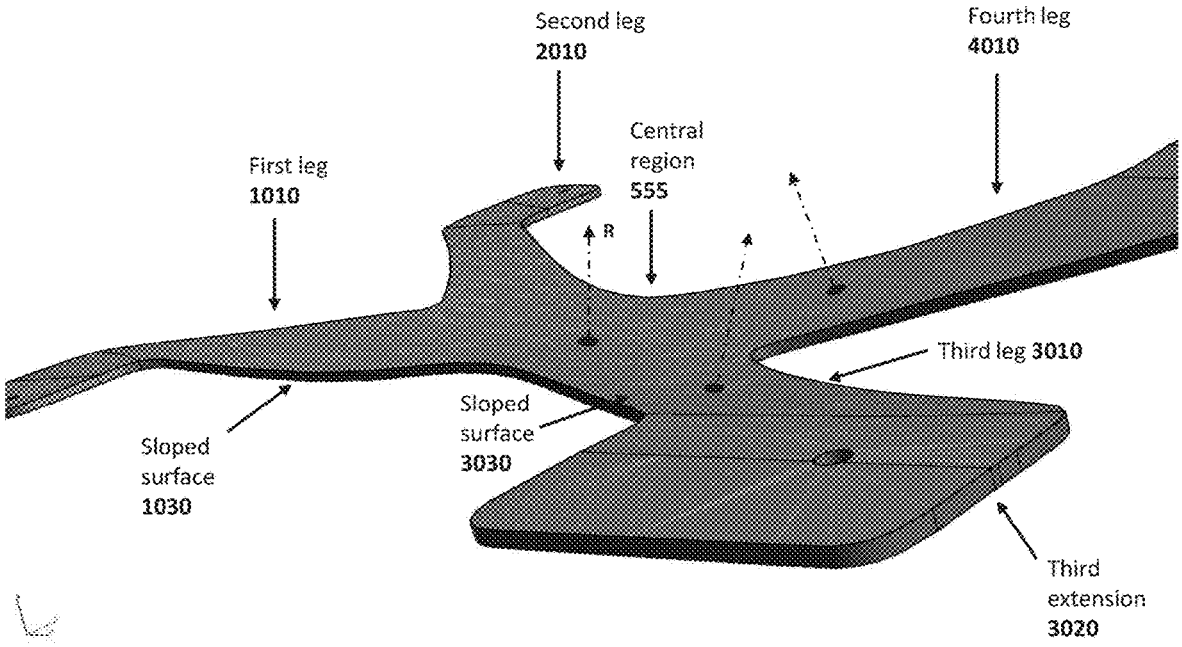
FIG. 14 depicts a perspective view of a third leg of a plate that can be integrated with a sole assembly of a high performance golf shoe, in accordance with some embodiments.

FIG. 13 provides a perspective view of a first leg 1010 of a plate that can be integrated with a sole assembly of a high performance golf shoe. The first leg 1010 may be positioned across from a second leg 2010 having a second extension 2020. The first leg 1010 and the second leg 2010 may be symmetric about a longitudinal axis L extending between the first and second legs 1010, 2010 (e.g., as shown in FIGS. 10-12).

In some cases, the first leg 1010 may include a sloped bottom surface 1030 that extends between the first extension 1020 and the central region 555 of the plate. In some cases, the sloped bottom surface 1030 may have a concave curvature and/or a convex curvature. In some cases, the sloped bottom surface 1030 of the first leg 1010 may be oriented outwards towards the lateral or medial side of the sole assembly. In some cases, the orientation of the sloped bottom surface 1030 may gradually change back towards a pre-determined reference orientation R as the sloped bottom surface approaches the central region 555. In some cases, at least a portion of the central region 555 may be generally oriented in the pre-determined reference orientation R.

In some cases, the plate may have a second leg 2010. The second leg 2010 may have a sloped bottom surface 2030 that is also oriented towards the medial or lateral side of the sole assembly. In some cases, the orientation of the sloped bottom surface 2030 may gradually change back towards a pre-determined reference orientation R as the sloped bottom surface approaches the central region 555, which may be oriented in the pre-determined reference orientation R.

FIG. 14 depicts a perspective view of a third leg 3010 of a plate that can be integrated with a sole assembly of a high performance golf shoe. The third leg 3010 may have a third extension 3020 as described elsewhere herein. In some cases, the third leg 3010 may have a sloped bottom surface 3030 extending between the third extension 3020 and the central region 555 of the plate. In some cases, the sloped bottom surface 3030 may have a concave and/or convex curvature. The sloped bottom surface 3030 may be oriented inwards towards a central longitudinal axis L extending between the third leg and the fourth leg (e.g., as shown in FIGS. 10-12). In some cases, the orientation of the sloped bottom surface 3030 may gradually change back towards a pre-determined reference orientation R as the bottom surface approaches the central region 555, which may be generally oriented in the pre-determined reference orientation R.

Figure 15:
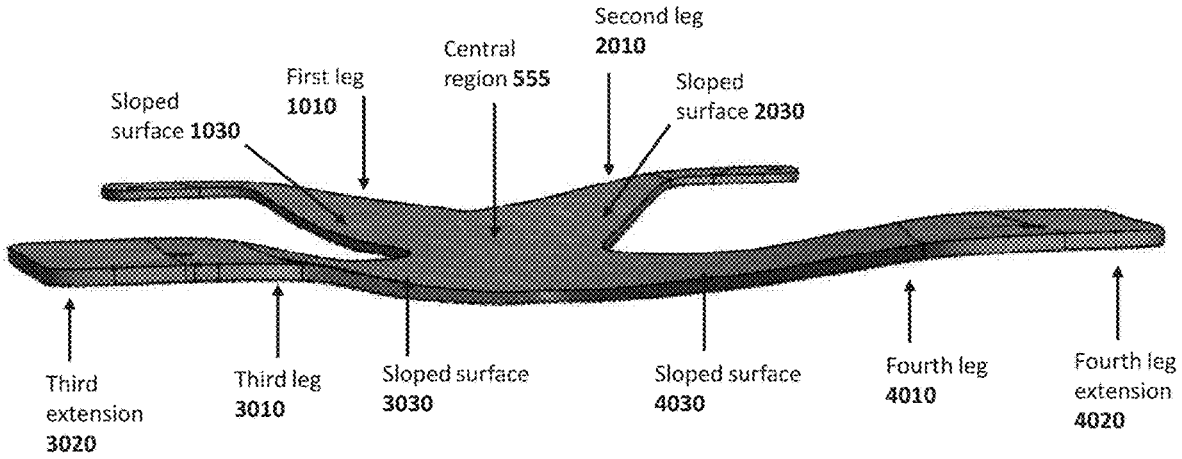
FIGS. 15 and 16 depict perspective views of a third leg and a fourth leg of a plate that can be integrated with a sole assembly of a high performance golf shoe, in accordance with some embodiments.
Figure 16:
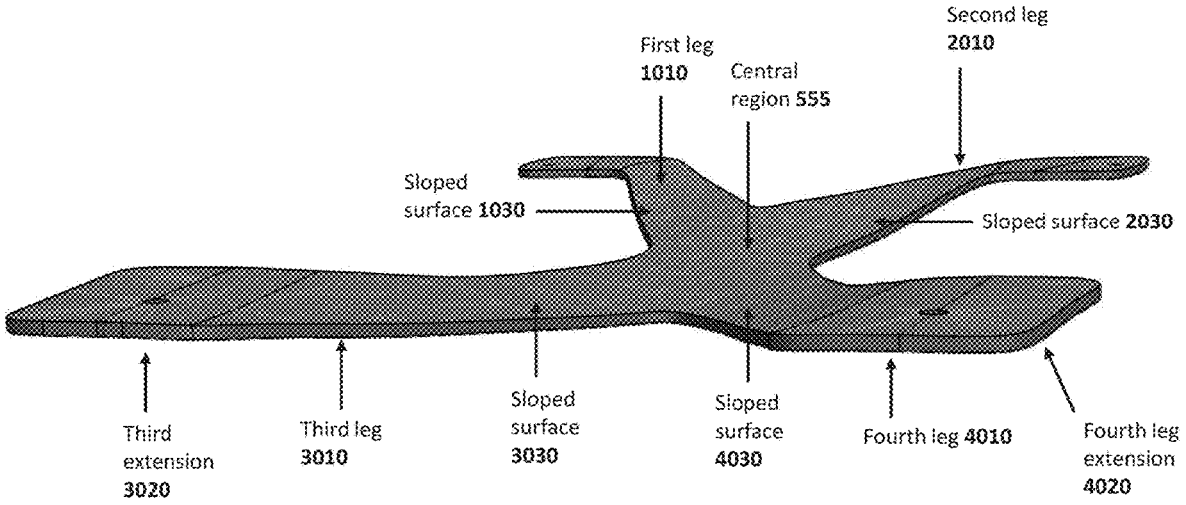

FIGS. 15 and 16 illustrate perspective views of a third leg 3010 and a fourth leg 4010 of a plate that can be integrated with a sole assembly of a high performance golf shoe. The third leg 3010 and the fourth leg 4010 may be positioned across from the first leg 1010 and the second leg 2010, respectively. In some cases, the third leg 3010 and the fourth leg 4010 may be symmetric about a central longitudinal axis L extending between the third leg and the fourth leg (e.g., as shown in FIGS. 10-12). The third and fourth legs 3010, 4010 may have respective third and fourth extensions 3020, 4020 disposed at the distal ends of the legs. The third and fourth legs 3010, 4010 may have sloped bottom surfaces 3030, 4030 that extend towards the central region 555. In some cases, the sloped bottom surfaces 3030, 4030 of the third and fourth legs 3010, 4010 may have a concave curvature and/or a convex curvature. In some cases, the orientation and/or curvature of the sloped bottom surfaces 3030, 4030 may vary along a length of the third and/or fourth legs 3010, 4010. In some cases, the sloped bottom surfaces 3030, 4030 of the third and fourth legs 3010, 4010 may be oriented towards a central longitudinal axis L extending between the third and fourth legs 3010, 4010 (e.g., as shown in FIGS. 10-12). In some cases, the orientation(s) of the sloped bottom surfaces 3030, 4030 may gradually change back towards a pre-determined reference orientation R as the bottom surfaces approach the central region 555, which may be generally oriented in the pre-determined reference orientation R.

In some embodiments, the sloped bottom surfaces of the third and fourth legs 3010, 4010 may have a different orientation and/or curvature than the sloped bottom surfaces of the first and second legs 1010, 2010. For example, in some cases, the sloped bottom surfaces 1030, 2030 of the first and second legs 1010, 2010 may be oriented away from a central longitudinal axis L extending between the first and second legs 1010, 2010. Further, in some cases, the sloped bottom surfaces 1030, 2030 may be oriented away from each other towards the medial or lateral sides of the sole assembly. In contrast, the sloped bottom surfaces 3030, 4030 of the third and fourth legs 3010, 4010 may be oriented towards a central longitudinal axis L extending between the third and fourth legs 3010, 4010. Further, the sloped bottom surfaces 3030, 4030 of the third and fourth legs 3010, 4010 may be oriented towards each other as the sloped bottom surfaces extend from the ends of the legs to the central region of the plate.

Figure 17:
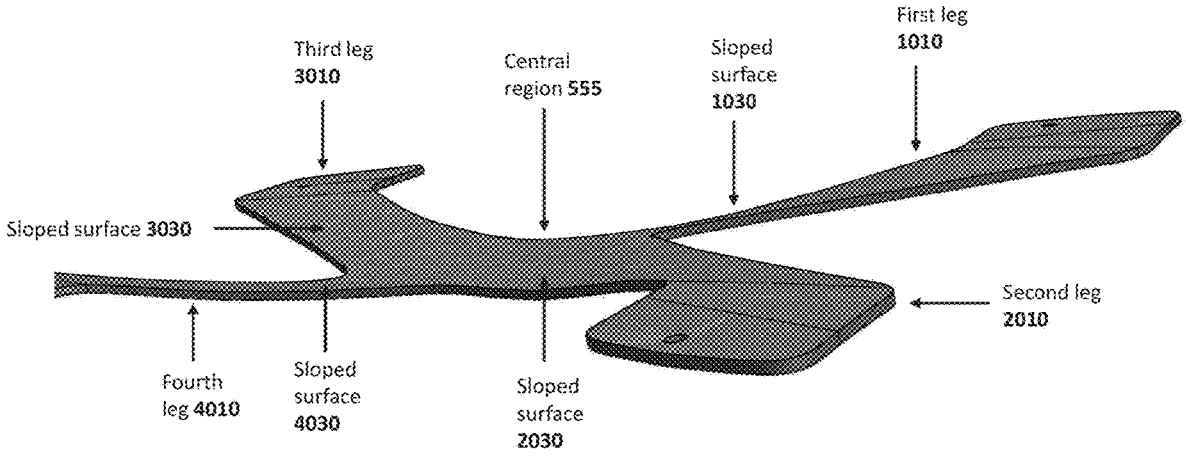
FIG. 17 depicts a perspective view of a second leg of a plate that can be integrated with a sole assembly of a high performance golf shoe, in accordance with some embodiments.
Figure 18:
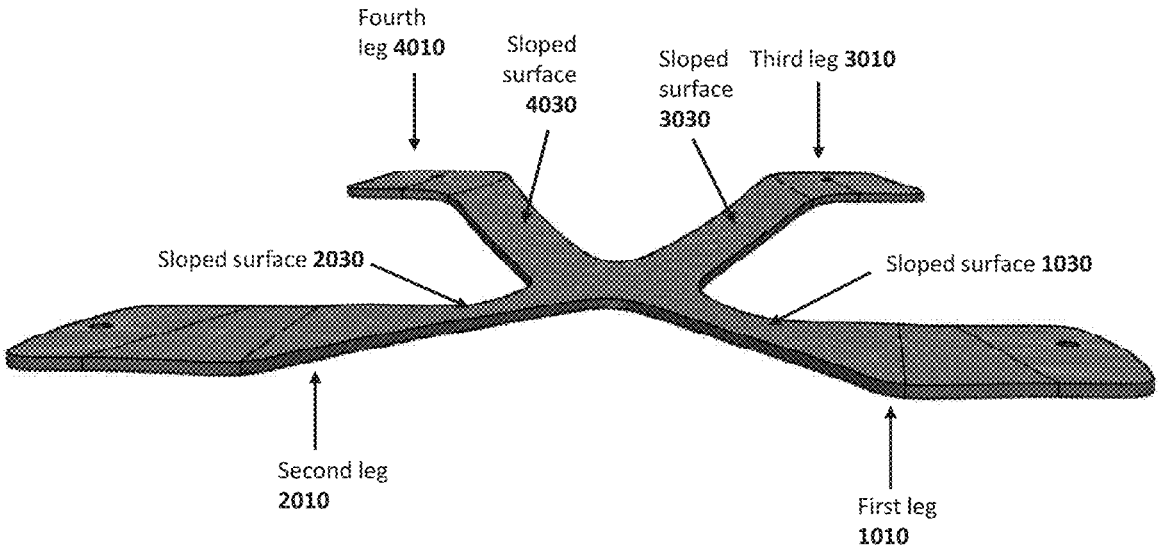
FIGS. 18 and 19 depict front and rear perspective views of a bottom surface of a plate that can be integrated with a sole assembly of a high performance golf shoe, in accordance with some embodiments.
Figure 19:
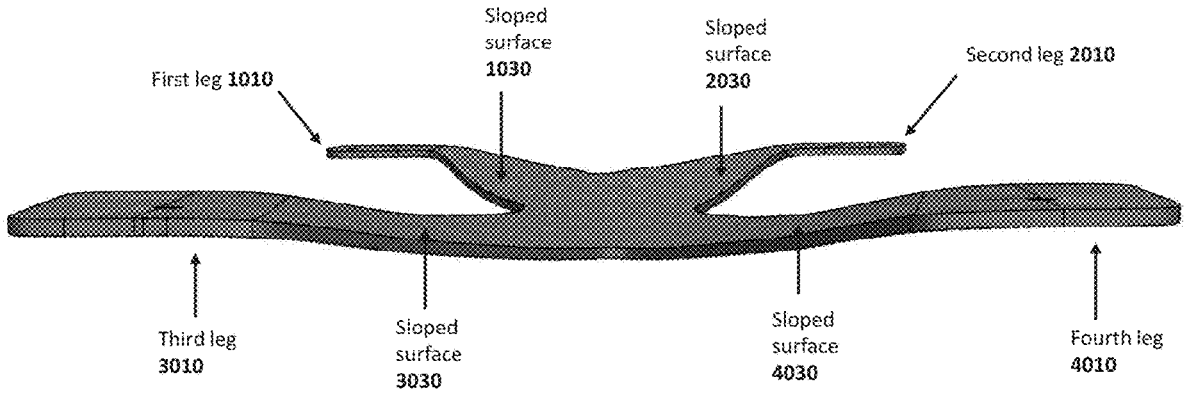
Figure 20A:
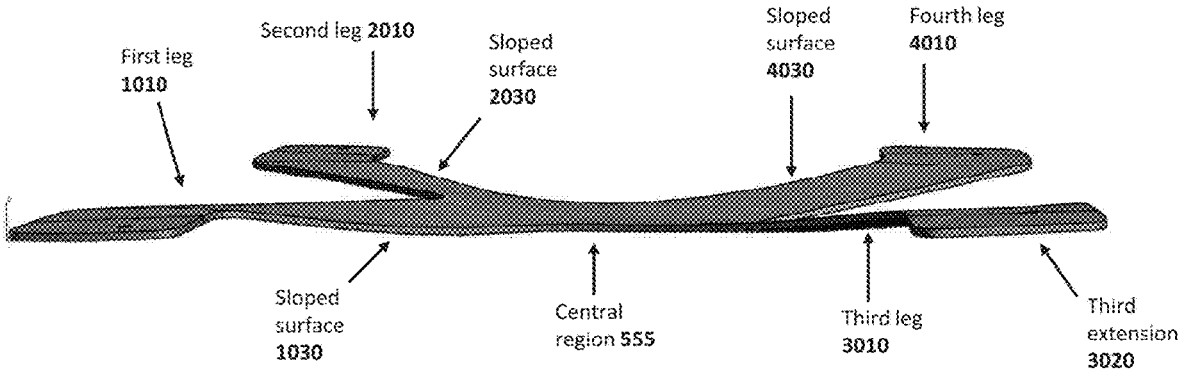
FIGS. 20A and 20B depict side views of a plate that can be integrated with a sole assembly of a high performance golf shoe, in accordance with some embodiments.
Figure 20B:
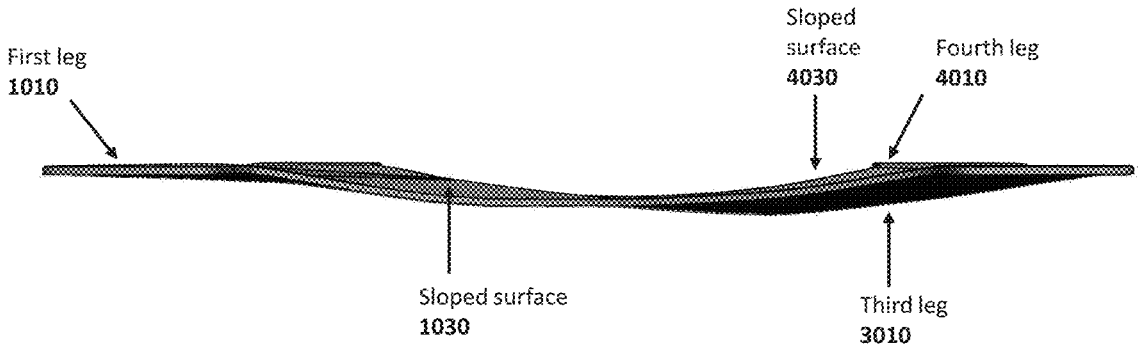
Figure 21A:
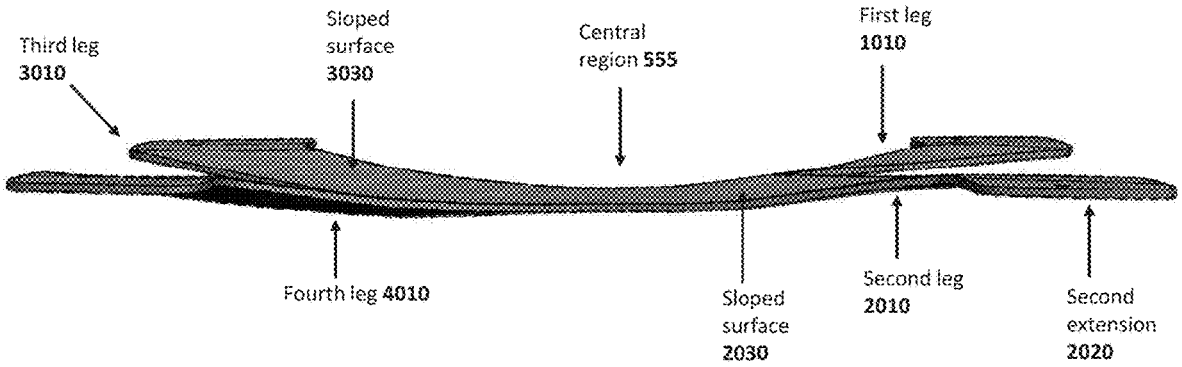
FIGS. 21A and 21B depict additional side views of a plate that can be integrated with a sole assembly of a high performance golf shoe, in accordance with some embodiments.
Figure 21B:
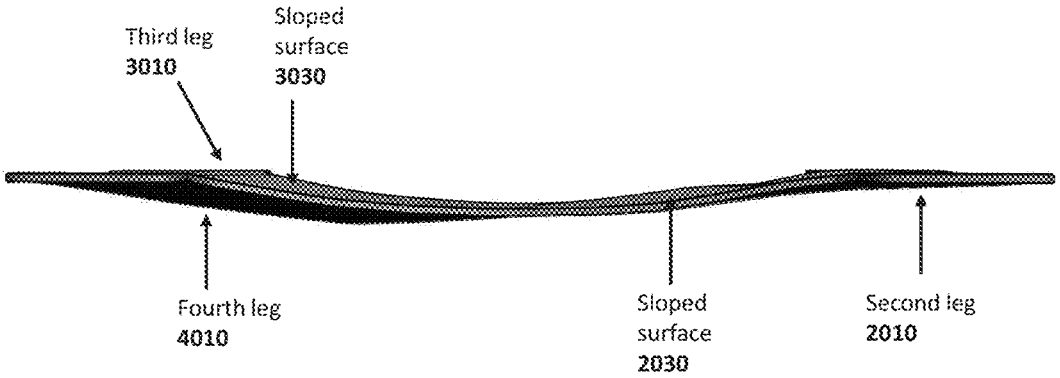

FIG. 17 provides a perspective view of a second leg 2010 of a plate that can be integrated with a sole assembly of a high performance golf shoe. FIGS. 18 and 19 provide additional front and rear perspective views of the plate shown in FIG. 17. In some cases, the second leg 2010 may have a sloped bottom surface 2030 that extends towards the central region 555 of the plate. In some cases, the sloped bottom surface 2030 may have a concave curvature and/or a convex curvature. In some cases, the sloped bottom surface 2030 may be oriented towards a lateral or medial side of the sole assembly. As described elsewhere herein, in some cases, the orientation of the sloped bottom surface 2030 may gradually change back towards a pre-determined reference orientation R as the sloped bottom surface approaches the central region 555, which may be generally oriented in the pre-determined reference orientation R.

In some cases, the sloped bottom surface 2030 of the second leg 2010 may be oriented towards the lateral or medial sides of the sole assembly, similar to the sloped bottom surface 1030 of the first leg 1010 (but in a different or opposite direction). In some cases, the sloped bottom surfaces 1030, 2030 of the first and second legs 1010, 2010 may be oriented in a different direction than the sloped bottom surfaces 3030, 4030 of the third and fourth legs 3010, 4010.

FIGS. 20A-20B and 21A-21B depict various side views of a plate that can be integrated with a sole assembly of a golf shoe. In some embodiments, the first leg 1010 and the second leg 2010 may have sloped bottom surfaces 1030, 2030 that are oriented outwards towards the lateral or medial sides of the sole assembly. The sloped bottom surfaces 1030, 2030 of the first and second legs 1010, 2010 may be seen in the side views shown in FIGS. 20A-20B and 21A— 21B. In some cases, the sloped bottom surfaces 1030, 2030 may have a concave curvature and/or a convex curvature. In some cases, the curvature and/or orientation of the sloped bottom surfaces 1030, 2030 may vary along a length of the first and/or second legs 1010, 2010.

In some embodiments, the third leg 3010 and the fourth leg 4010 may have one or more sloped bottom surfaces 3030, 4030 that are oriented towards a central longitudinal axis L extending between the third and fourth legs 3010, 4010. In some cases, the sloped bottom surfaces 3030, 4030 may have concave curvatures and/or convex curvatures. In some cases, the sloped bottom surface of the third leg 3010 may not be visible in the side view shown in FIG. 20A or 20B, and the sloped bottom surface of the fourth leg 4010 may not be visible in the side view shown in FIG. 21A or 21B, due to the orientation and/or curvature of these sloped surfaces. In some cases, a portion of the sloped bottom surface 4030 of the fourth leg 4010 may be seen in the side view shown in FIG. 20A or 20B, and a portion of the sloped bottom surface 3030 of the third leg 3010 may be seen in the side view shown in FIG. 21A or 21B, due to the orientation and/or curvature of these sloped surfaces.

Figure 22:
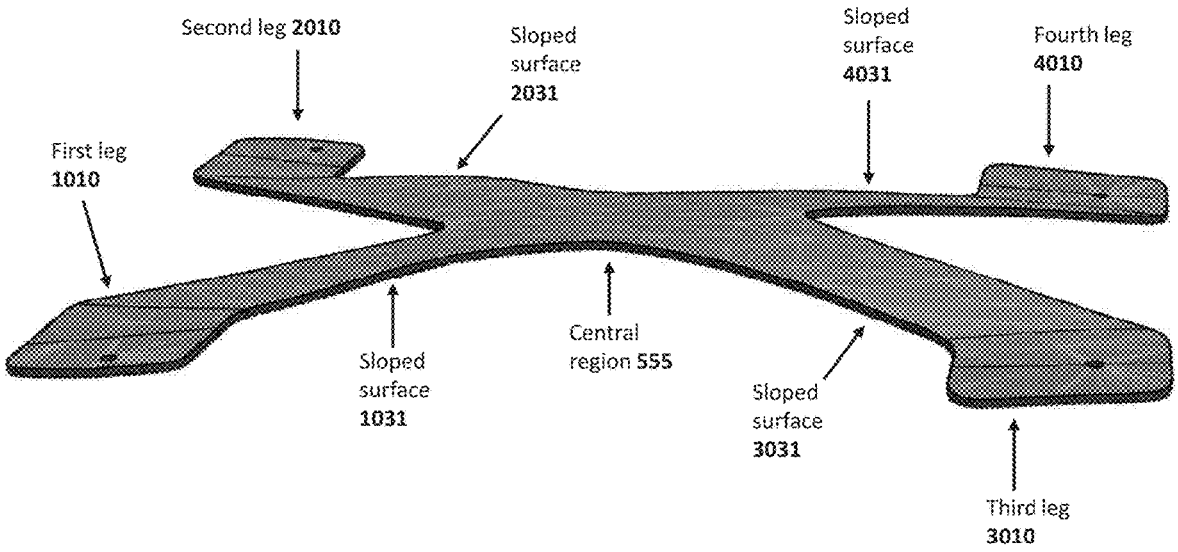
FIG. 22 schematically illustrates a perspective view of a top surface of a plate that can be integrated with a sole assembly of a golf shoe, in accordance with some embodiments.

FIG. 22 illustrates a perspective view of a top surface of a plate that can be integrated with a sole assembly of a golf shoe. The plate may include a first leg 1010, a second leg 2010, a third leg 3010, and a fourth leg 4010 as described elsewhere herein. In some cases, the first leg 1010, the second leg 2010, the third leg 3010, and/or the fourth leg 4010 may have a sloped top surface 1031, 2031, 3031, 4031 that extends between a distal end of the legs and the central region 555. In some cases, the sloped top surfaces 1031, 2031, 3031, 4031 may have a curvature and/or an orientation that changes or varies along a length of the legs. In some cases, the sloped top surfaces 1031, 2031, 3031, 4031 may have a concave curvature. In other cases, the sloped top surfaces 1031, 2031, 3031, 4031 may have a convex curvature.

Figure 23:
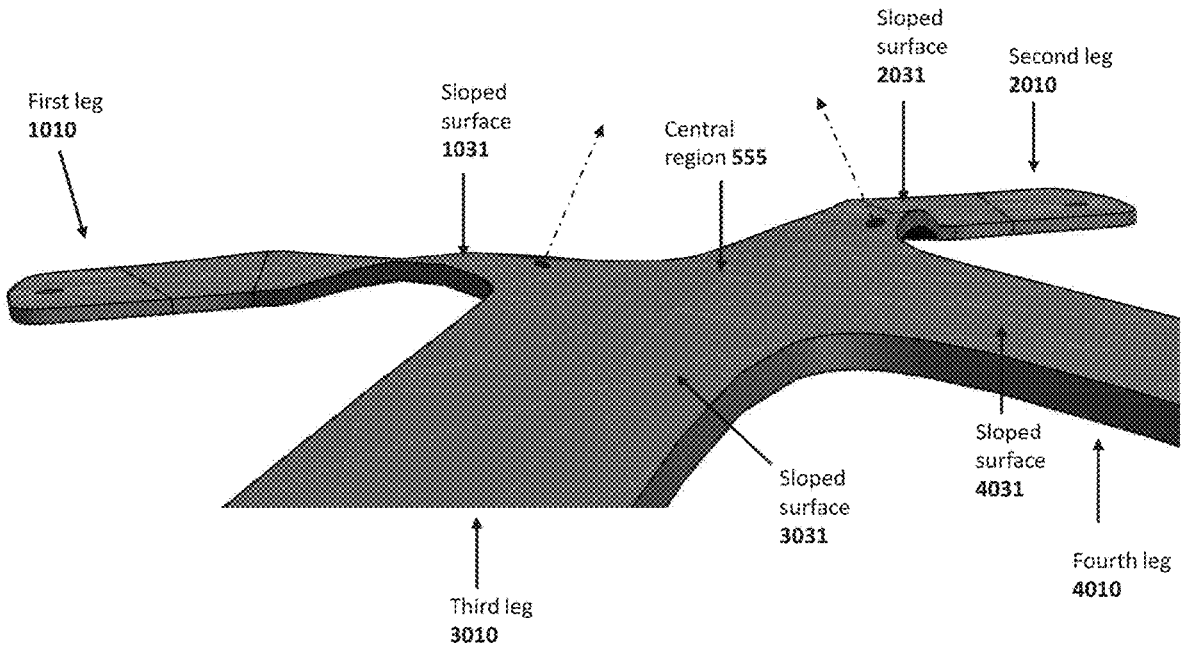
FIGS. 23 and 24 schematically illustrate additional perspective views of a top surface of a plate that can be integrated with a sole assembly of a golf shoe, in accordance with some embodiments.
Figure 24:
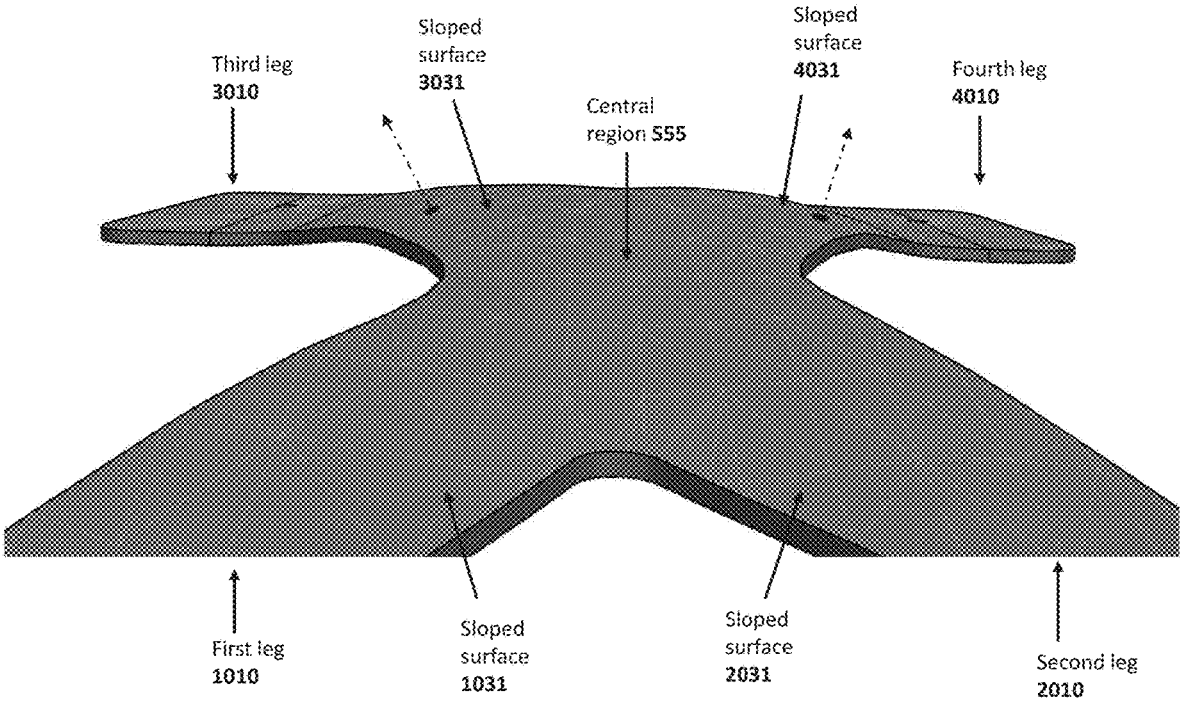

FIGS. 23 and 24 illustrate additional perspective views of a top surface of a plate that can be integrated with a sole assembly of a golf shoe. In some embodiments, the sloped top surfaces of the first and second legs 1010, 2010 may have a different orientation and/or curvature than the sloped top surfaces of the third and fourth legs 3010, 4010. For example, in some cases, the sloped top surfaces 1031, 2031 of the first and second legs 1010, 2010 may be oriented towards a central longitudinal axis L extending between the first and second legs 1010, 2010. Further, the sloped top surfaces 1031, 2031 of the first and second legs 1010, 2010 may be oriented towards each other as the sloped top surfaces extend from the ends of the legs to the central region of the plate (e.g., as shown in FIG. 23). In contrast, the sloped top surfaces 3031, 4031 of the third and fourth legs 3010, 4010 may be oriented away a central longitudinal axis L extending between the third and fourth legs 3010, 4010. Further, the sloped top surfaces 3031, 4031 of the third and fourth legs 3010, 4010 may be oriented away from each other towards the medial or lateral sides of the sole assembly (e.g., as shown in FIG. 24).

In some embodiments, the orientations of the sloped top surfaces 1031, 2031, 3031, 4031 may gradually change back towards a pre-determined reference orientation R as the sloped top surfaces approach the central region 555. In some cases, at least a portion of the central region 555 may be generally oriented in the pre-determined reference orientation R. In some non-limiting embodiments, the pre-determined reference orientation R may correspond to a surface orientation that is generally aligned in the positive and/or negative Z-direction. In other non-limiting embodiments, the pre-determined reference orientation R may correspond to a surface orientation that deviates from the positive or negative Z-direction by a pre-determined amount. In some cases, the pre-determined amount may range from about 1 degree to at most about 30 degrees in any direction in three-dimensional space.

Figure 25A:
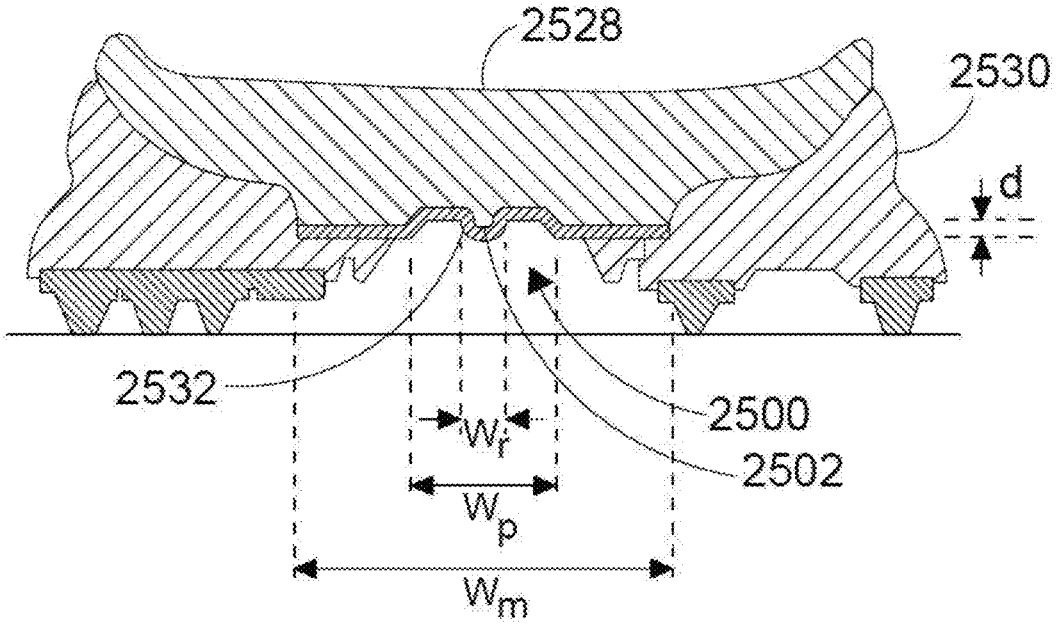
FIGS. 25A and 25B schematically illustrate an example of a golf shoe comprising a three-dimensional (3D) plate, in accordance with some embodiments.
Figure 25B:
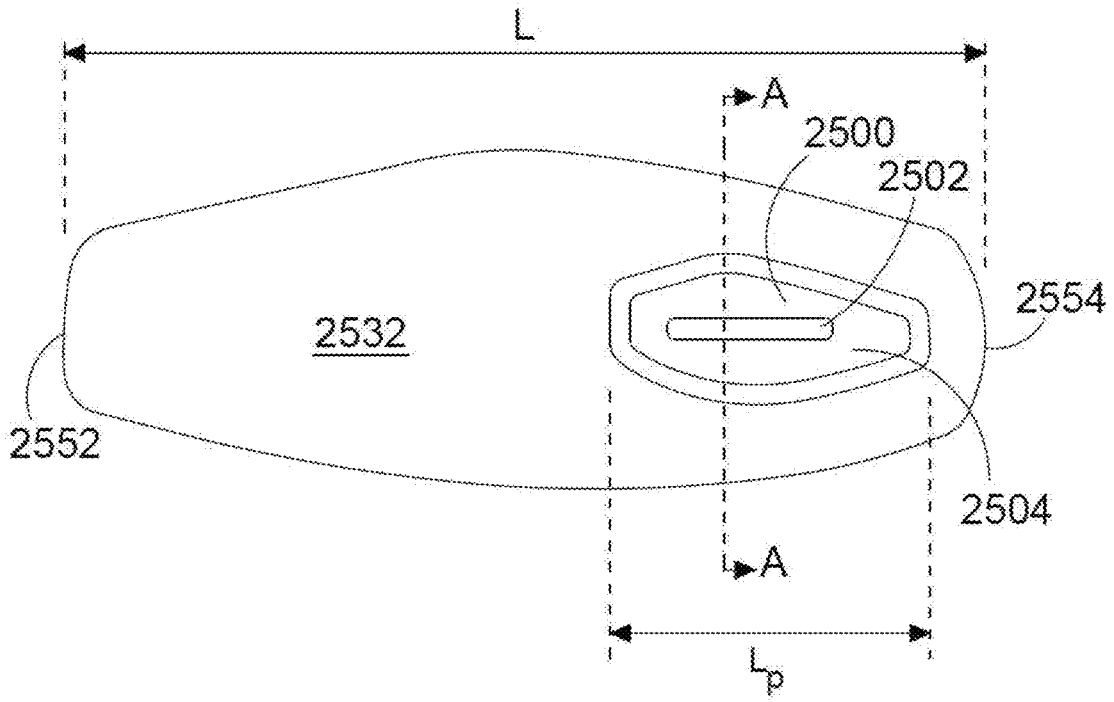

Referring now to FIGS. 25A and 25B, in some embodiments, the golf shoe may comprise a three-dimensional (3D) plate. In some cases, the 3D plate may comprise a molded fiber-reinforced composite plate 2532 disposed between an upper region 2528 and a lower region 2530 of the sole assembly. In some cases, the upper region may correspond to a midsole of the golf shoe. In some cases, the lower region may correspond to an outsole of the golf shoe. In some cases, the composite plate 2532 may be centered between the upper region 2528 and the lower region 2530 of the sole assembly, although it will be appreciated that the composite plate 2532 may be positioned anywhere between the upper region 2528 and the lower region 2530.

In some embodiments, the composite plate 2532 may comprise a molded pocket 2500 provided in the heel area or rear foot region of the shoe. In some embodiments, the pocket 2500 may have a preferable maximum depth (d) of about 1 mm to about 5 mm. It will be appreciated that the depth may vary across or along the pocket 2500.

In some embodiments, the composite plate 2532 may have a maximum width ($w_m$) and the pocket 2500 may have a maximum width ($w_p$). In some cases, the maximum width of the pocket ($w_p$) may be at least about 50% of the maximum width of the composite plate ($w_m$), more preferably between about 60% and 80% of the maximum width of the composite plate ($w_m$). It will be appreciated that the maximum width of the composite plate ($w_m$) and the pocket ($w_p$) may not or need not coincide with each other along the length of the composite plate. For example, in some cases, the maximum widths of the composite plate ($w_m$) and the pocket ($w_p$) may be offset from each other along the length of the composite plate.

As shown in FIG. 25B, in some cases, the composite plate 2532 may be positioned so that it extends between an anterior end 2552 of the sole assembly and a posterior end 2554 of the sole assembly. In some embodiments, the pocket 2500 may be centered in or near the posterior end 2554 of the sole assembly. In other embodiments, the pocket 2500 may not or need not be centered in or near the posterior end 2554 of the sole assembly. In some embodiments, the pocket 2500 may extend longitudinally in the rear foot region of the shoe. In some embodiments, the pocket 2500 may not or need not extend longitudinally into the forefoot region of the shoe.

In some embodiments, the pocket may have a length ($L_p$) that is at most about 40% of the length of the composite plate (L). In some embodiments, the pocket may have a length ($L_p$) that is about 20% to about 35% of the overall length of the composite plate (L).

In some embodiments, the composite plate 2532 may have a constant thickness. In other embodiments, the composite plate may have a variable thickness. In some cases, the thickness of the composite plate 2532 may vary along a dimension (e.g., a length and/or a width) of the composite plate.

In some embodiments, the pocket 2500 may have any suitable shape that can provide additional stiffness in the rear foot region of the shoe. In some embodiments, at least a portion of the pocket 2500 may mirror or correspond to the outer shape or profile of the composite plate 2532.

In some embodiments (e.g., as shown in FIGS. 25A-25B), the pocket 2500 may comprise a ridge 2502 extending along the longitudinal center region 2504 of the pocket 2500. The ridge 2502 may be provided within the pocket 2500 and may have any desired width, length, and/or depth. In some cases, the pocket 2500 and the ridge 2502 located within the pocket 2500 may be configured to provide additional stiffness in at least the rear foot region of the shoe.

Figure 26A:
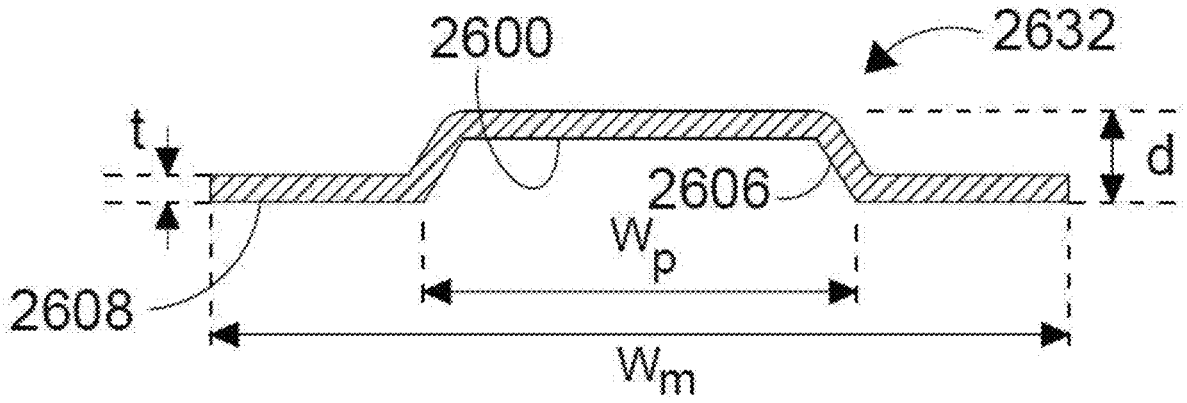
FIGS. 26A-26D illustrate cross-sectional views of various exemplary composite plates comprising a pocket and/or one or more ridge(s), in accordance with some embodiments.

FIGS. 26A-26D illustrate different cross-sectional views (taken along reference line A-A shown in FIG. 25B) of various non-limiting embodiments of a composite plate 2632 having a pocket 2600 and/or one or more ridge(s) 2602. FIG. 26A shows a cross-sectional view of a composite plate 2632 with a molded pocket 2600. In some embodiments, the sidewalls 2606 of the pocket 2600 may be angled, curved, or sloped relative to a surface 2608 of the composite plate 2632. In some embodiments, the composite plate 2632 may not or need not include a ridge. The maximum depth (d) of the pocket 2600 may be any suitable depth. In some cases, the pocket may have a depth (d) ranging from about 1 mm to about 5 mm. In some cases, the maximum width of the pocket ($w_p$) may be at least about 50% of the maximum width of the composite plate ($w_m$). It will be appreciated that the maximum width of the composite plate ($w_m$) and the pocket ($w_p$) may not or need not coincide with each other along the length of the composite plate. For example, in some cases, the maximum widths of the composite plate ($w_m$) and the pocket ($w_p$) may be offset from each other along the length of the composite plate.

Figure 26B:
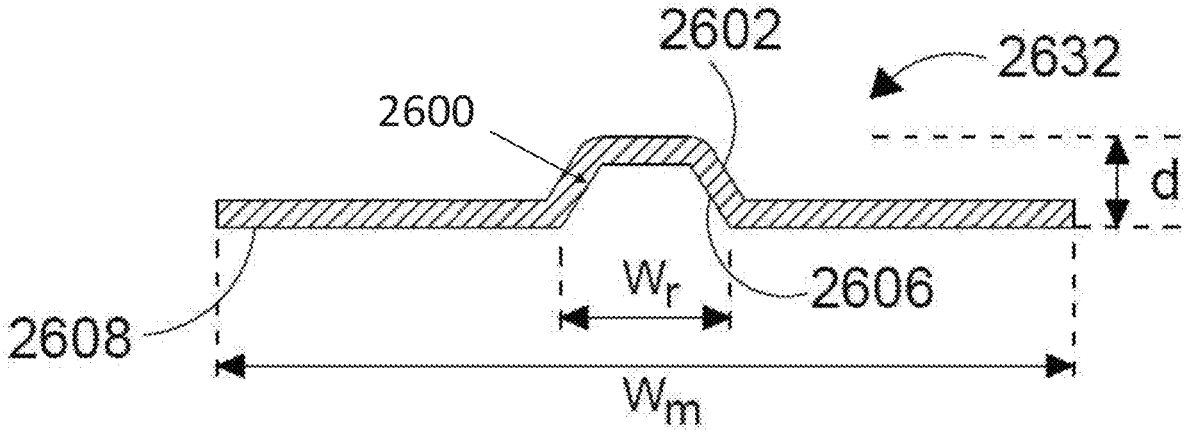

FIG. 26B illustrates an alternative example of a composite plate 2632. In some embodiments, the composite plate 2632 may comprise a pocket 2600. In some embodiments, the sidewalls 2606 of the pocket 2600 may be angled, curved, or sloped relative to a surface 2608 of the composite plate 2632. In some embodiments, the composite plate 2632 may comprise at least one ridge 2602 formed in or on the composite plate 2632. In some embodiments, the ridge 2602 may be formed along a portion of the pocket 2600 (e.g., an inner or outer portion of the pocket 2600). In some embodiments, the width of the ridge ($w_r$) may be less than the maximum width of the composite plate ($w_m$). The maximum depth (d) of the ridge may be any suitable depth. In some cases, the maximum depth (d) of the ridge may range from about 1 mm to about 5 mm. In some cases, the ridge 2602 may be provided in or on a portion of the composite plate 2632 that is positionable at or near the posterior end of the sole assembly. In some cases, the ridge 2602 may be configured to increase the stiffness of the shoe (e.g., in at least the rear foot region of the shoe).

Figure 26C:
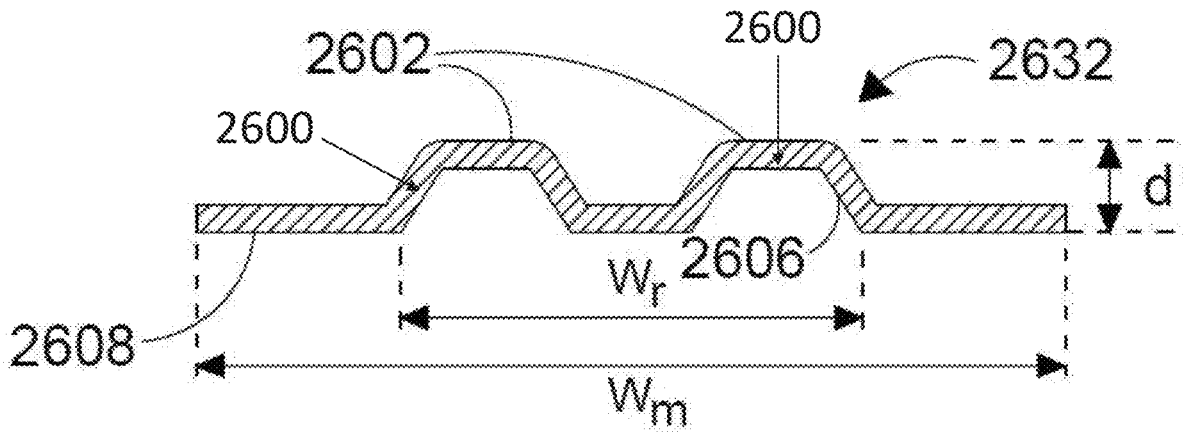

FIG. 26C shows an embodiment of the composite plate 2632 comprising two or more pockets 2600. In some embodiments, the two or more pockets 2600 may have a same or similar size or shape. In other embodiments, the two or more pockets 2600 may have different sizes or shapes. In some embodiments, the sidewalls 2606 of the pockets 2600 may be angled, curved, or sloped relative to a surface 2608 of the composite plate 2632. In some embodiments, the composite plate 2632 may have two or more ridges 2602 molded in or on the composite plate 2632. In some embodiments, the two or more ridges 2602 may be provided or formed along one or more pockets 2600 of the composite plate 2632. In some embodiments, the two or more ridges 2602 may be provided adjacent to one another. In some embodiments, the two or more ridges 2602 may be substantially parallel with each other along their respective lengths. In some embodiments, the total width of the ridges together ($w_r$) may be at least about 50% of the maximum width of the composite plate ($w_m$), and more preferably about 60% to 80% of the maximum width of the composite plate ($w_m$). The maximum depth (d) of the ridges 2602 may be any suitable depth. In some embodiments, the maximum depth (d) of the ridges 2602 may be about 1 mm to about 5 mm. In some embodiments, the two or more ridges may have a same or similar size or shape. In other embodiments, the two or more ridges may have different sizes or shapes.

Figure 26D:
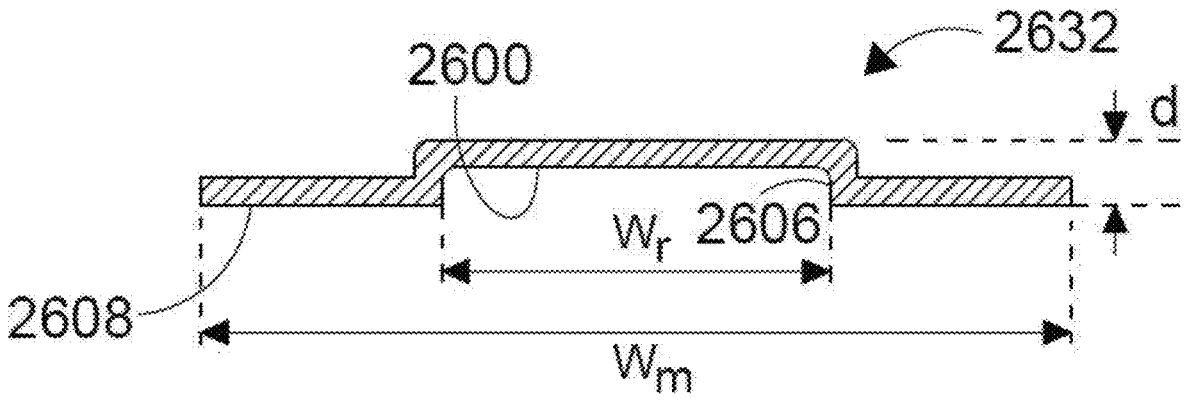

An additional embodiment of the composite plate 2632 is shown in FIG. 26D. In some embodiments, the composite plate 2632 may have a molded pocket 2600 with one or more sidewalls 2606. The sidewalls 2606 of the pocket 2600 may be angled, curved, sloped, or substantially perpendicular to a surface 2608 of the composite plate 2632. It will be appreciated that any of the pockets and/or ridges previously described may have one or more sidewalls that are sloped, angled, or substantially perpendicular to one or more surfaces of the composite plates disclosed herein.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "midfoot", and "rearfoot", and the like are relative terms used to refer to one position of an element based on one perspective and should not be construed as limiting the scope of the technology.

All patents, publications, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe, comprising:

an upper;

a sole assembly connected to the upper, wherein the sole assembly comprises a midsole and an outsole; and an insert positioned between the midsole and the outsole to provide an elastic response during one or more golf-related movements executed by a subject wearing the golf shoe, wherein the insert comprises a plurality of legs extending from a central region of the insert to stiffen the shoe, the plurality of legs including a first set of symmetric legs extending between the central region and a forefoot region of the sole assembly and a second set of symmetric legs extending between the central region and a rearfoot region of the sole assembly, wherein the first set of symmetric legs include a first leg and a second leg that diverge from the central region to provide a longitudinally flexible forefoot region between the first and second legs, wherein the first and second legs comprise (i) a first set of sloped top surfaces oriented inwards towards a central longitudinal axis of the insert and (ii) a first set of sloped bottom surfaces oriented outwards towards a medial side and a lateral side of the sole assembly, and wherein the second set of symmetric legs comprises a third leg and a fourth leg that diverge from the central region to provide a longitudinally flexible rearfoot region between the third and fourth legs, wherein the third and fourth legs comprise (i) a second set of sloped top surfaces oriented outwards towards the medial side and the lateral side of the sole assembly and (ii) a second set of sloped bottom surfaces oriented inwards towards the central longitudinal axis of the insert, wherein the first leg, the second leg, the third leg, and the fourth leg each comprise one or more anticlastic surfaces.

2. The golf shoe of claim 1, wherein the first leg and the second leg each have a sloped surface with an orientation or curvature that varies along a length of the first or second leg.

3. The golf shoe of claim 2, wherein the third leg and the fourth leg each have a sloped surface with an orientation or curvature that varies along a length of the third or fourth leg.

4. The golf shoe of claim 3, wherein the sloped surfaces of the first leg and the second leg are oriented or curved in or along a different direction than the sloped surfaces of the third leg or the fourth leg.

5. The golf shoe of claim 3, wherein the sloped surface is oriented towards the central longitudinal axis of the insert.

6. The golf shoe of claim 3, wherein the sloped surface is oriented towards the lateral side or the medial side of the sole assembly.

7. The golf shoe of claim 3, wherein the sloped surfaces of the third leg or the fourth leg have at least one concave curvature and/or at least one convex curvature.

8. The golf shoe of claim 2, wherein the sloped surface is oriented towards the lateral side or the medial side of the sole assembly.

9. The golf shoe of claim 2, wherein the sloped surface is oriented towards the central longitudinal axis of the insert.

10. The golf shoe of claim 2, wherein the sloped surfaces of the first leg or the second leg have at least one concave curvature and/or at least one convex curvature.

11. The golf shoe of claim 1, wherein the insert is concave downwards to enhance the elastic response provided by the insert.

12. The golf shoe of claim 1, wherein the central region of the insert is positioned further from a ground surface under the golf shoe than the first or second sets of symmetric legs.

13. The golf shoe of claim 1, wherein the first leg and the second leg converge at a first point in the central region, and wherein the third leg and the fourth leg converge at a second point in the central region, wherein the first point and the second point are positioned at different heights.

14. The golf shoe of claim 1, wherein the first leg, the second leg, the third leg, and the fourth leg comprise one or more extensions with a substantially flat surface for supporting one or more loads exerted on the insert during the one or more golf-related movements.

15. The golf shoe of claim 14, wherein the one or more extensions are configured to curve outwards towards the lateral side or the medial side of the sole assembly to enhance stability.

16. The golf shoe of claim 1, wherein the first and second sets of symmetric legs collectively form an X-shaped member.

17. The golf shoe of claim 1, wherein the first set of sloped top surfaces are oriented towards each other, and wherein the first set of sloped bottom surfaces are oriented away from each other.

18. The golf shoe of claim 1, wherein the second set of sloped top surfaces are oriented away from each other, and wherein the second set of sloped bottom surfaces are oriented towards each other.

19. The golf shoe of claim 1, wherein the first leg comprises a first extension and the second leg comprises a second extension that is detached or decoupled from the first extension, and wherein the third leg comprises a third extension and the fourth leg comprises a fourth extension that is detached or decoupled from the third extension.

* * * * *